US011739536B2

(12) United States Patent
Cooper et al.

(10) Patent No.: US 11,739,536 B2
(45) Date of Patent: Aug. 29, 2023

(54) MODULAR RAIL SYSTEM

(71) Applicant: Lustre Products Ltd., Chilliwack (CA)

(72) Inventors: Troy Sean Cooper, Abbotsford (CA); Dean Ivan Cooper, Delta (CA)

(73) Assignee: Lustre Products Ltd., Chilliwack (CA)

( * ) Notice: Subject to any disclaimer, the term of this patent is extended or adjusted under 35 U.S.C. 154(b) by 1165 days.

(21) Appl. No.: 16/224,570

(22) Filed: Dec. 18, 2018

(65) Prior Publication Data

US 2019/0186152 A1 Jun. 20, 2019

Related U.S. Application Data

(60) Provisional application No. 62/607,849, filed on Dec. 19, 2017.

(51) Int. Cl.
*E04F 11/18* (2006.01)

(52) U.S. Cl.
CPC ..... *E04F 11/1808* (2013.01); *E04F 11/1804* (2013.01)

(58) Field of Classification Search
CPC ..... E04F 11/1802; E04F 11/1804; E04F 11/1808; E04F 11/1836; E04F 11/1838; E04F 11/184; E04F 2011/1872; F16B 2/04

(Continued)

(56) References Cited

U.S. PATENT DOCUMENTS 3,574,367 A * 4/1971 Jankowski ..... B62D 33/044 403/201
4,952,092 A 8/1990 Ballerstein
(Continued)

FOREIGN PATENT DOCUMENTS

AT 10701 U2 * 8/2009
AT 10807 U2 * 10/2009
(Continued)

*Primary Examiner* — Jonathan P Masinick
(74) *Attorney, Agent, or Firm* — Oyen Wiggs Green & Mutala LLP

(57) ABSTRACT

A modular rail system is disclosed where the component modules can be easily assembled in different combinations and configurations to produce customized rails having the desired appearance and functionality. In some embodiments the rail system comprises at least one connector having a longitudinal axis and comprising a connector span and at least one expansion member, wherein the expansion member is adjustable between a first configuration having a first diameter and a second configuration having a second diameter larger than said first diameter; and at least one span member having an outer surface and an inner surface and at least one open end, wherein the expansion member is insertable into an interior of the span member in the first configuration and is adjustable to the second configuration within the span member to securely engage the inner surface of the span member to releasably couple the connector and the span member together. The rail system may also include an actuator for adjusting the expansion member between the first and second configurations within the span member. In some embodiments the rail system comprises at least one span member and/or at least one connector that is illuminated to enhance the aesthetic appearance of the assembled rail and/or to direct light as desired at the site of installation. In a particular aspect the system may comprise a plurality of span members and at least one of the span members is a light emitting span member configured for receiving a lighting element. The lighting element may be connectable through a connector and/or a span member to an electrical supply externally of the rail system.

65 Claims, 49 Drawing Sheets

(58) Field of Classification Search
USPC ..... 256/65.01, 68, 69, 65.15, 65.16
See application file for complete search history.

(56) References Cited

U.S. PATENT DOCUMENTS

| | | | | |
|---|---|---|---|---|
| 5,062,732 | A | 11/1991 | Ballerstein | |
| D329,013 | S | 9/1992 | Stoner, Jr. | |
| D329,589 | S | 9/1992 | Parduhn | |
| D373,069 | S | 8/1996 | McCarthy | |
| D380,959 | S | 7/1997 | Mitchell | |
| 5,657,604 | A * | 8/1997 | Malott | F16B 7/0473 403/255 |
| 5,765,812 | A | 6/1998 | Guenther | |
| 6,176,472 | B1 * | 1/2001 | Burger | E04F 11/1804 403/312 |
| 6,305,671 | B1 * | 10/2001 | Valentine | E04H 17/1439 256/65.13 |
| 6,565,069 | B2 * | 5/2003 | Morris | E04F 11/1836 256/73 |
| D553,477 | S | 10/2007 | Kuzukawa | |
| D558,037 | S | 12/2007 | Chelchowski | |
| D563,205 | S | 3/2008 | Kuzukawa | |
| 7,618,210 | B2 | 11/2009 | Wagner et al. | |
| D633,782 | S | 3/2011 | Tompkins | |
| D664,839 | S | 8/2012 | Bonhag | |
| 8,235,623 | B2 | 8/2012 | Wagner et al. | |
| D719,820 | S | 12/2014 | McGrath | |
| D721,266 | S | 1/2015 | Sun | |
| D761,100 | S | 7/2016 | Divers | |
| D780,558 | S | 3/2017 | Mouthaan | |
| D793,216 | S | 8/2017 | Divers | |
| 9,771,961 | B1 | 9/2017 | Tscherkaschin | |
| D799,938 | S | 10/2017 | Lowitz | |
| D799,939 | S | 10/2017 | Lowitz | |
| D821,859 | S | 7/2018 | Artino | |
| D866,309 | S | 11/2019 | McGrath | |
| D867,117 | S | 11/2019 | McGrath | |
| 10,480,195 | B2 * | 11/2019 | Warshaw | E04F 11/1834 |
| D880,284 | S | 4/2020 | Ferraro | |
| D915,994 | S | 4/2021 | Pratt | |
| 2002/0104187 | A1 | 8/2002 | Kakamu | |
| 2004/0074820 | A1 | 4/2004 | Sawall | |
| 2007/0086582 | A1 | 4/2007 | Goad | |
| 2008/0253112 | A1 * | 10/2008 | Nash | E04F 11/1808 362/217.05 |
| 2008/0277640 | A1 | 11/2008 | Striebel et al. | |
| 2009/0184303 | A1 | 7/2009 | Jones et al. | |
| 2011/0303811 | A1 | 12/2011 | Nash | |
| 2011/0308195 | A1 | 12/2011 | Dotsey | |
| 2012/0326108 | A1 * | 12/2012 | Eves | E04F 11/1836 256/60 |
| 2013/0299761 | A1 | 11/2013 | Heiling | |
| 2014/0097394 | A1 * | 4/2014 | Hsieh | E04F 11/1804 256/65.15 |
| 2015/0361671 | A1 | 12/2015 | Honein | |
| 2016/0377221 | A1 | 12/2016 | Honein | |
| 2018/0258648 | A1 | 9/2018 | Kuo | |
| 2018/0298616 | A1 | 10/2018 | Yu | |
| 2019/0119923 | A1 | 4/2019 | Winter | |
| 2019/0186152 | A1 | 6/2019 | Cooper | |
| 2020/0284041 | A1 | 1/2020 | Legault | |
| 2020/0040587 | A1 | 2/2020 | Yu | |
| 2020/0071933 | A1 | 3/2020 | Jorge | |
| 2020/0284040 | A1 | 9/2020 | Warshaw | |
| 2021/0002904 | A1 | 1/2021 | Moman | |
| 2021/0180328 | A1 | 6/2021 | Lin | |
| 2021/0222436 | A1 | 7/2021 | Burt | |

FOREIGN PATENT DOCUMENTS

| | | | | |
|---|---|---|---|---|
| CN | 201896415 | | 11/2010 | |
| CN | 306228411 | | 12/2020 | |
| CN | 306853097 | | 9/2021 | |
| DE | 4030978 | A1 | 4/1992 | |
| DE | 9217622 | U1 | 6/1993 | |
| DE | 9412899 | U1 * | 11/1994 | |
| DE | 29515370 | | 11/1995 | |
| DE | 29500655 | U1 * | 6/1996 | |
| DE | 10101782 | A1 * | 10/2001 | E04F 11/1804 |
| DE | 10100403 | A1 * | 7/2002 | E04F 11/1836 |
| DE | 10153435 | A1 * | 5/2003 | E04F 11/181 |
| DE | 10231250 | A1 * | 1/2004 | E04F 11/1812 |
| DE | 102004053758 | B4 | 11/2006 | |
| DE | 102006019172 | A1 * | 10/2007 | B66B 11/0226 |
| DE | 102007048099 | A1 * | 4/2009 | F21S 4/28 |
| DE | 102012100556 | A1 * | 8/2012 | E04F 11/1804 |
| DE | 102013110963 | A1 * | 4/2014 | E04F 11/1804 |
| EP | 1048799 | A1 | 11/2000 | |
| EP | 1600577 | A1 | 11/2005 | |
| EP | 1630320 | A2 | 3/2006 | |
| EP | 2199626 | A1 * | 6/2010 | A47B 47/0008 |
| FR | 2612543 | A1 * | 9/1988 | |
| FR | 2859254 | A1 * | 3/2005 | E04F 11/1836 |
| GB | 935252 | A * | 8/1963 | |
| GB | 2443193 | A * | 4/2008 | E04F 11/1804 |
| GB | 2500473 | A * | 9/2013 | E04F 11/1808 |
| IN | 332042-001-0001 | | 6/2021 | |
| JP | 03064789 | A * | 3/1991 | |
| JP | 09317116 | A * | 12/1997 | |
| JP | 10299211 | A * | 11/1998 | |
| JP | 3040771 | | 5/2000 | |
| JP | 2003161018 | A * | 6/2003 | |
| JP | 2006152726 | A * | 6/2006 | |
| KR | 200196540 | Y1 * | 9/2000 | |
| KR | 200410725 | Y1 * | 3/2006 | |
| KR | 20130033541 | A * | 4/2013 | |
| KR | 101464875 | B1 * | 11/2014 | |
| WO | 2016054676 | A1 | 4/2016 | |

* cited by examiner

MODULAR RAIL SYSTEM

RELATED APPLICATIONS

This application claims the benefit of U.S. provisional patent application No. 62/607,849 filed 19 Dec. 2017, which is hereby incorporated by reference in its entirety.

TECHNICAL FIELD

This application relates to a modular rail system. In some embodiments the modular rail system can be used to configure customized handrails, for example for use in elevator cabins.

BACKGROUND

Modular handrails are known in the prior art. For example European patent application EP 1048799A1, Milesi, describes a modular structure for making handrails comprising bearing elements, supports and junction inserts that can be coupled together in different configurations. The supports are designed for coupling a handrail to the wall of a building. Each support comprises an integral fastening portion for mounting a handrail on the support wall. The Milesi modular structure thus employs structurally different components for different dedicated functions. For example, the junction inserts for coupling a bearing element to a support cannot be adapted for mounting directly on a support structure. While a light unit may be mounted in a support, the bearing elements are not designed to be light-emitting.

Other modular rail systems are known in the prior art that include means for securely coupling rail components together. However, such systems often include fasteners that can only be deployed in a particular orientation and cannot be easily adapted for applications where it is desirable to alter the configuration of the modules while locating the fastening system hidden from view.

The need has therefore arisen for a modular rail system having enhanced versatility where the component modules can be easily assembled in different combinations and configurations to produce customized rails having the desired appearance and functionality. The need has particularly arisen for a modular rail system where modules of the system, including span members, can be optionally illuminated to enhance the aesthetic appearance of the assembled rail and/or to direct light as desired at the site of installation.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the disclosure provides a modular rail system comprising at least one connector having a longitudinal axis and comprising a connector span and at least one expansion member, wherein the expansion member is adjustable between a first configuration having a first diameter and a second configuration having a second diameter larger than said first diameter; and at least one span member having an outer surface and an inner surface and at least one open end, wherein the expansion member is insertable into an interior of the span member in the first configuration and is adjustable to the second configuration within the span member to securely engage the inner surface of the span member to releasably couple the connector and the span member together. In one embodiment the system includes an actuator insertable through an aperture in the span member for adjusting the expansion member between the first and second configurations within the span member.

Another aspect of the disclosure provides a modular rail system wherein at least one span member and/or at least one connector is illuminated. In a particular aspect the system may comprise a plurality of span members wherein at least one of the span members is a light emitting span member configured for receiving a lighting element. The lighting element may be connectable through a connector and/or a span member to an electrical power supply externally of the rail system.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

This application relates to a modular rail system 10. In some embodiments rail system 10 can be configured to form a handrail, for example a handrail for use in the interior cabin of an elevator.

Rail system 10 comprises a plurality of span members 12 and a plurality of connectors 14 for releasably coupling span members 12 together (FIGS. 1A-1D). As described below, span members 12 may be provided in different lengths, shapes, materials, colors and external finishes. By combining span members 12 and connectors 14 in different modular combinations and configurations the aesthetic appearance and/or functionality of the resultant rail system 10 can be varied.

Figure 1A:
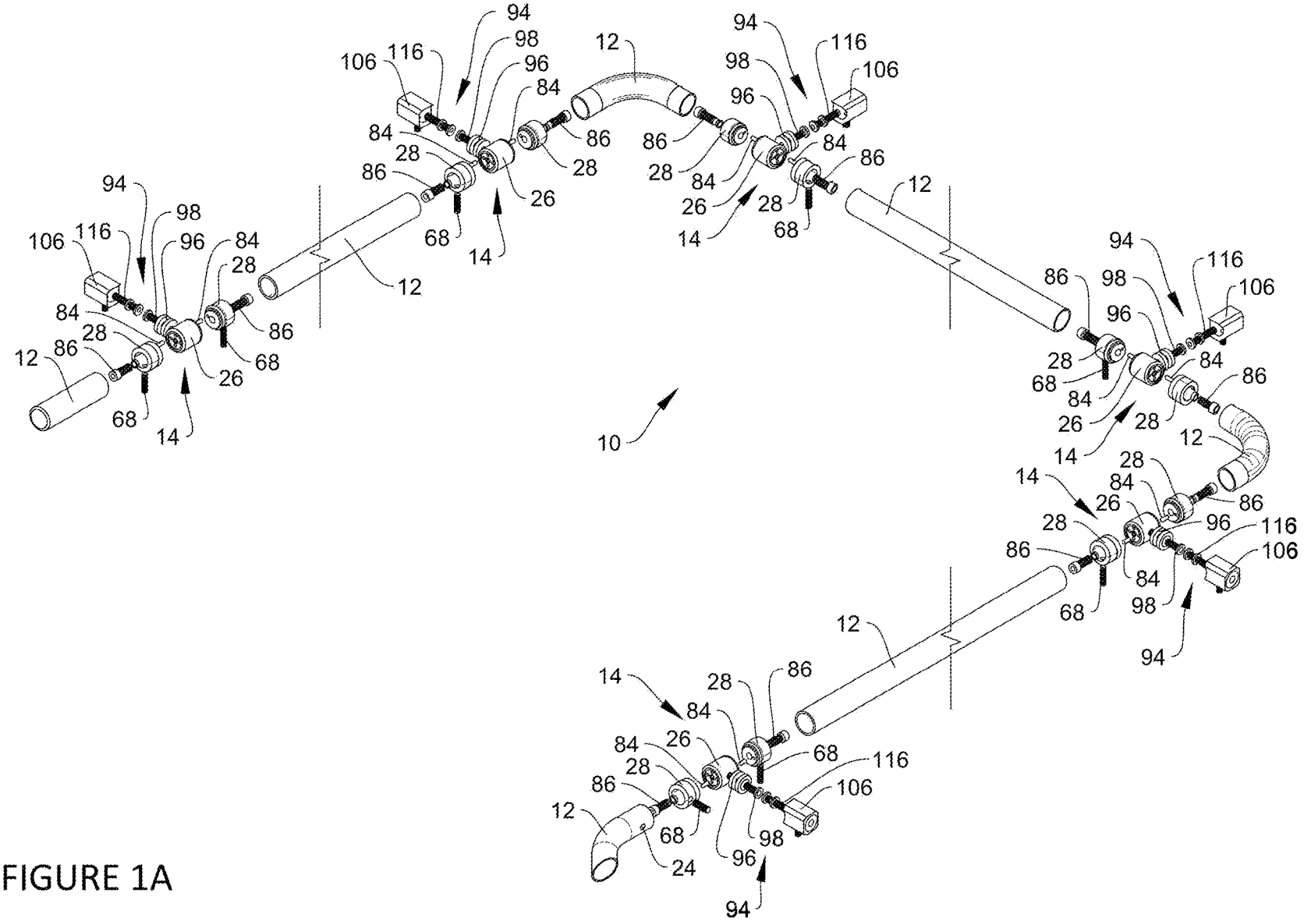
FIG. 1A is an exploded, isometric view showing an embodiment of a rail system comprising a plurality of span members, connectors and mounting assemblies.
Figure 1B:
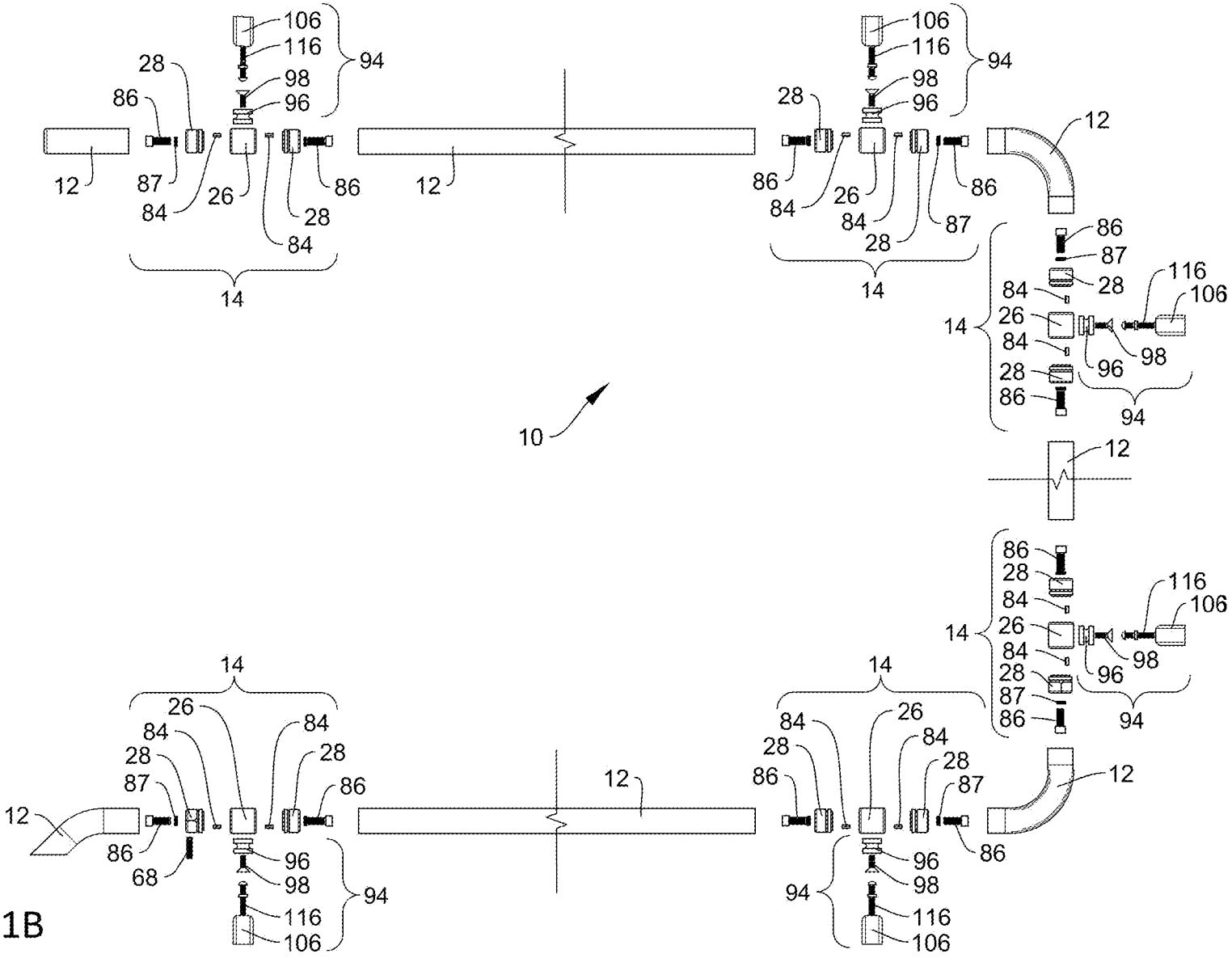
FIG. 1B is a top plan view thereof.
Figure 1C:
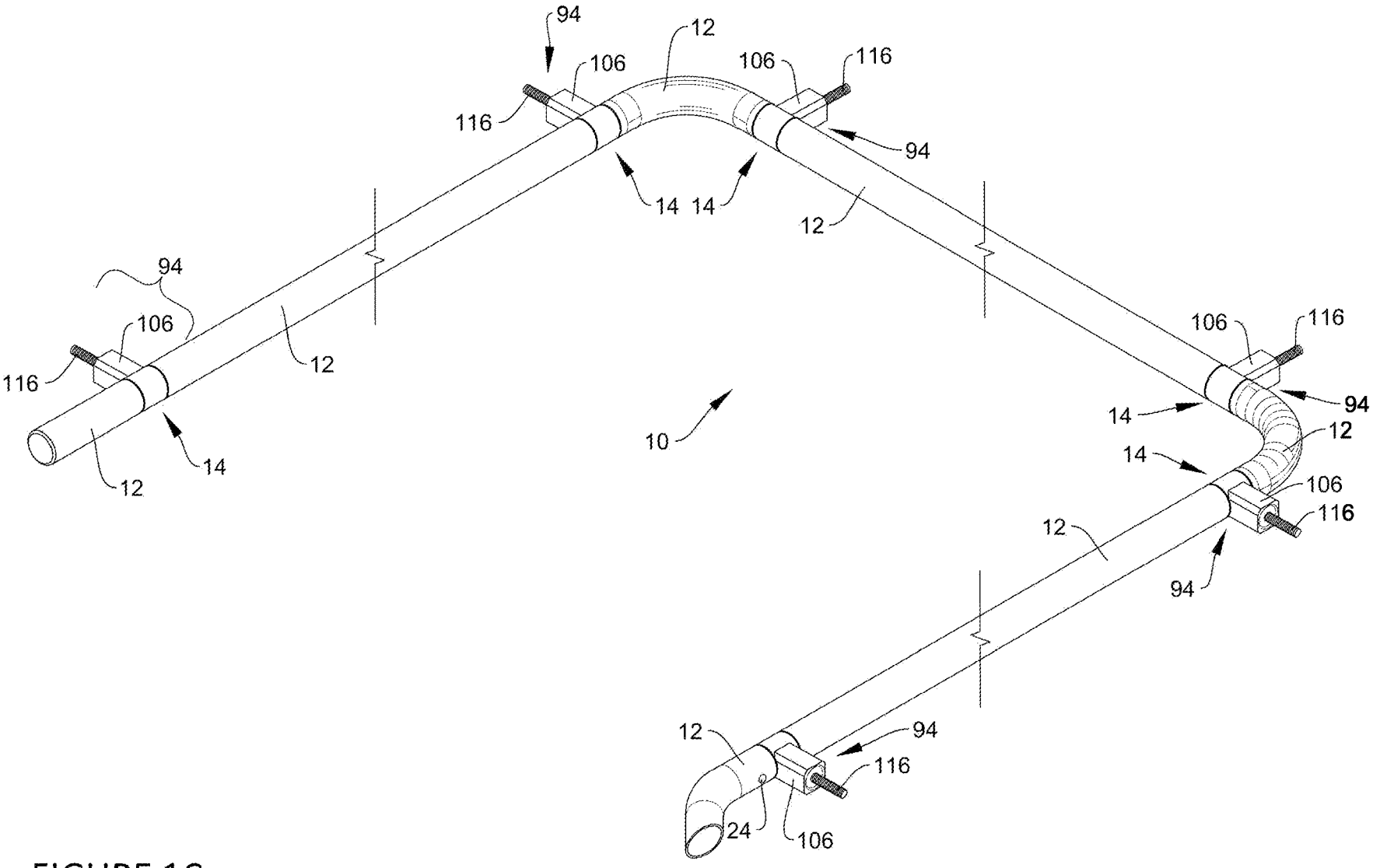
FIG. 1C is an isometric view of the rail system of FIGS. 1A and 1B in an assembled configuration.
Figure 1D:
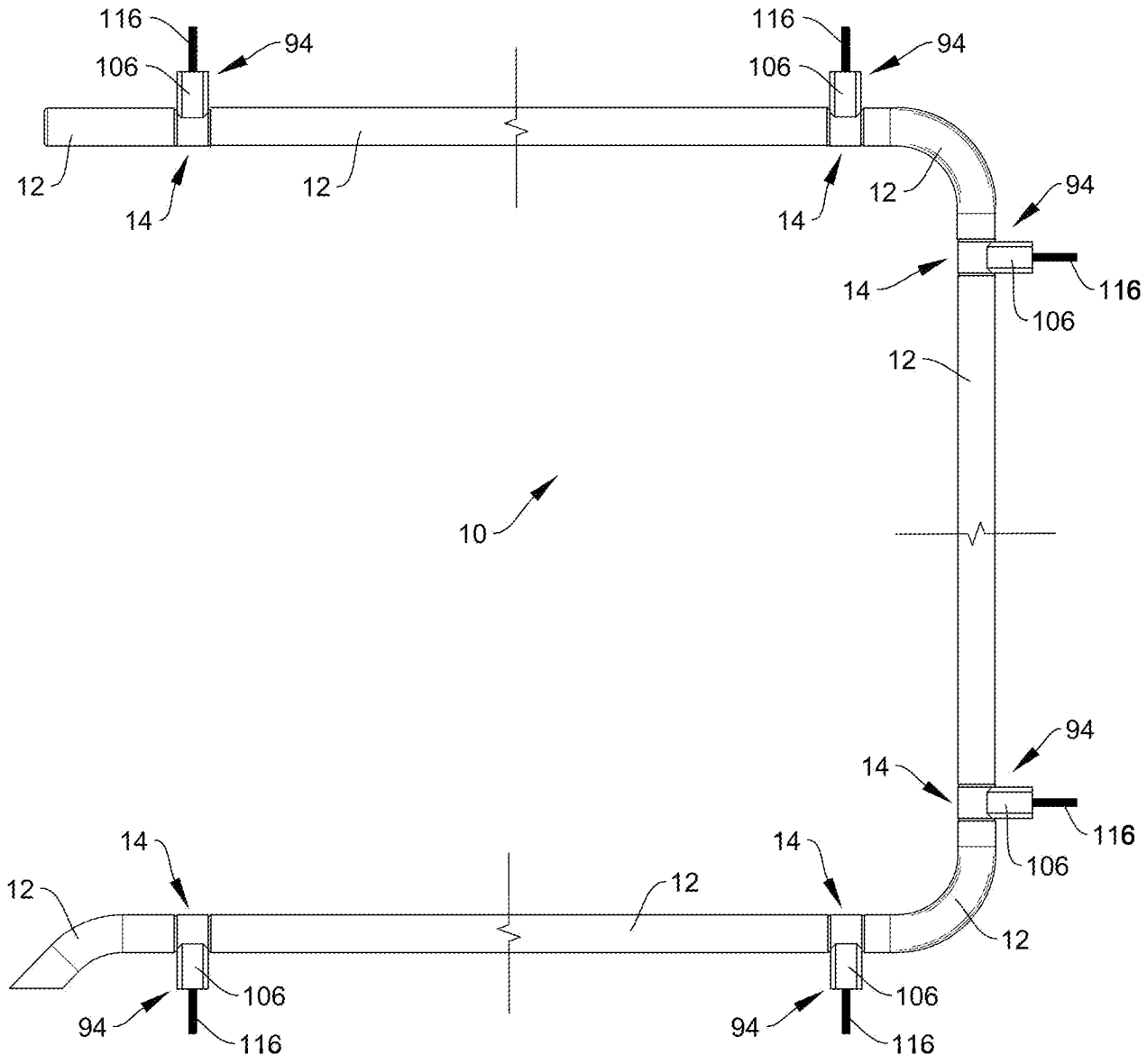
FIG. 1D is a top plan view thereof.
Figure 1E:
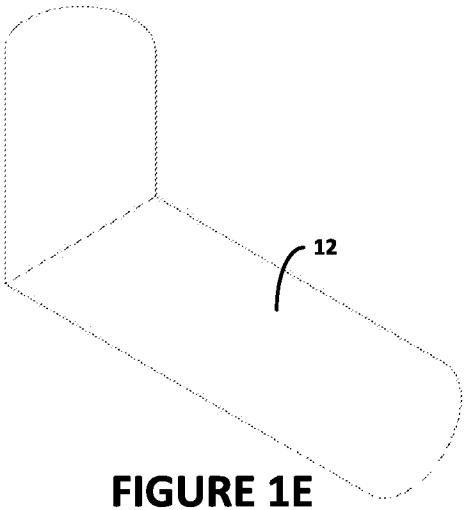
FIG. 1E is an alternative embodiment of a span member having a bent mitre end.
Figure 1F:
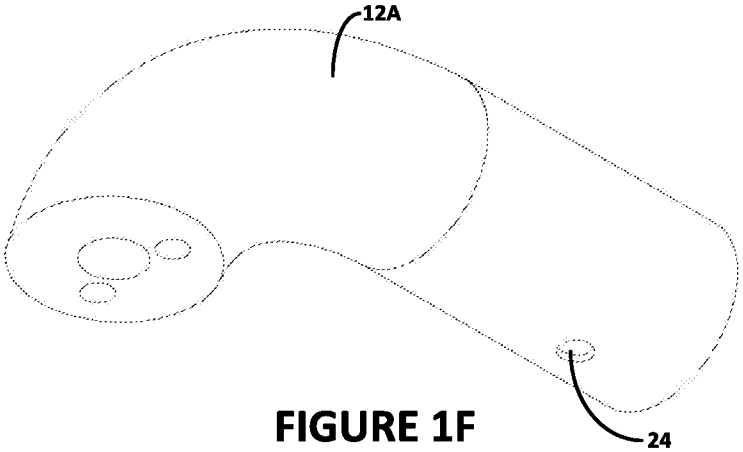
FIG. 1F is a further alternative embodiment of a span member having a radius end.
Figure 1G:
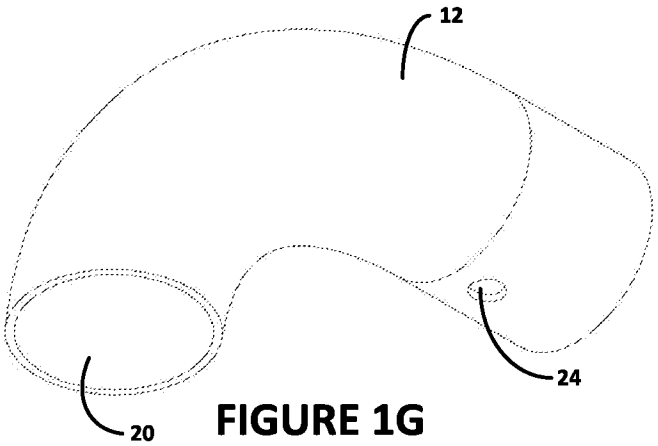
FIG. 1G is a further alternative embodiment of a span member having a radius end.
Figure 1H:
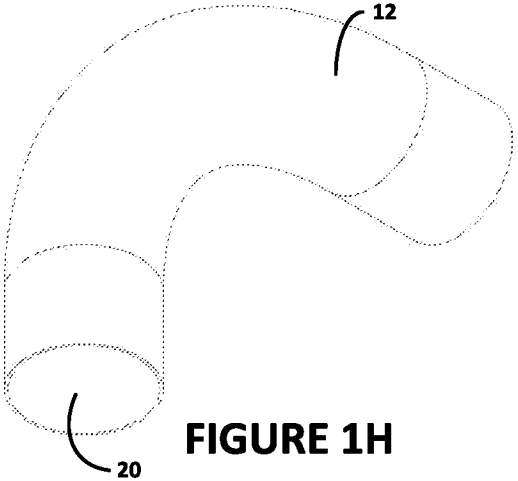
FIG. 1H is a further alternative embodiment of a span member having a 90° end.
Figure 1J:
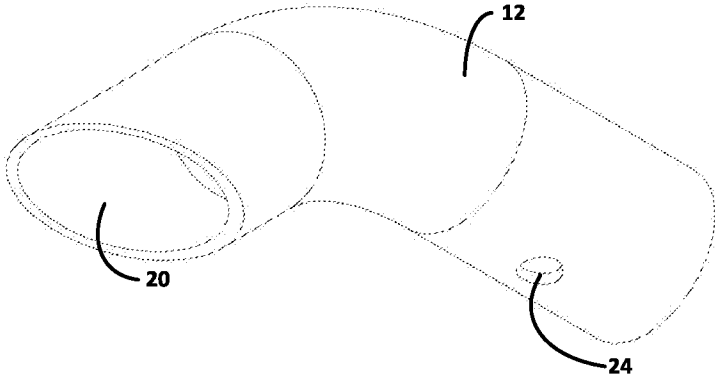
FIG. 1J is a further alternative embodiment of a span member having a kick end.
Figure 1I:
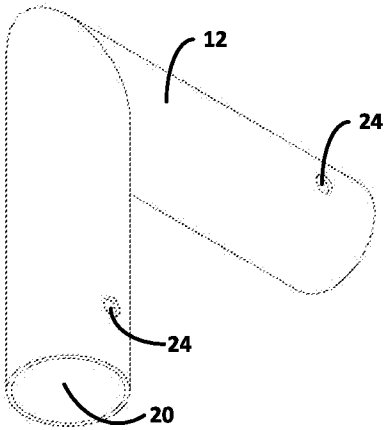
FIG. 1I is a further alternative embodiment of a span member having a mitred shape.
Figure 1L:
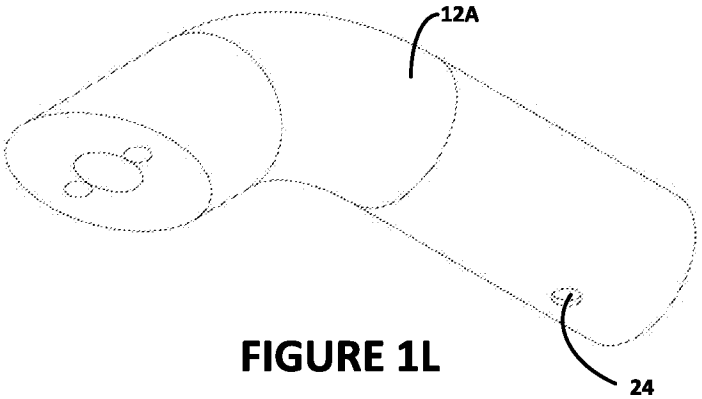
FIG. 1L is a further alternative embodiment of a span member having a kick end.
Figure 1K:
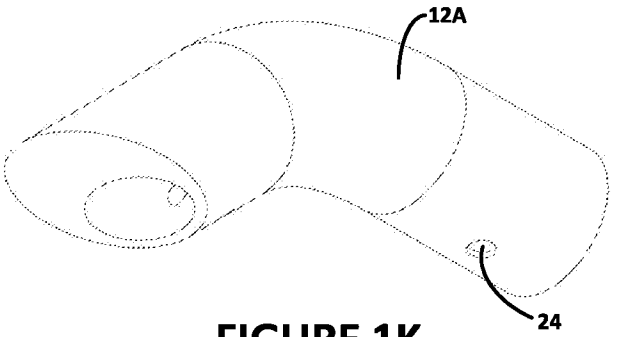
FIG. 1K is a further alternative embodiment of a span member having a kick end.
Figure 1N:
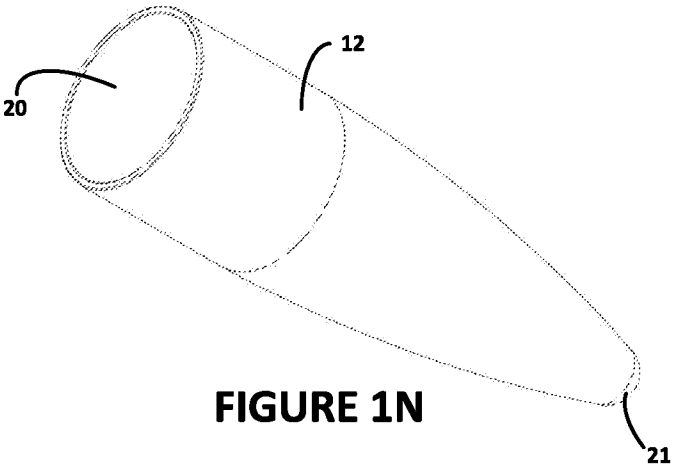
FIG. 1N is a further alternative embodiment of a span member having a bullet end.
Figure 1M:
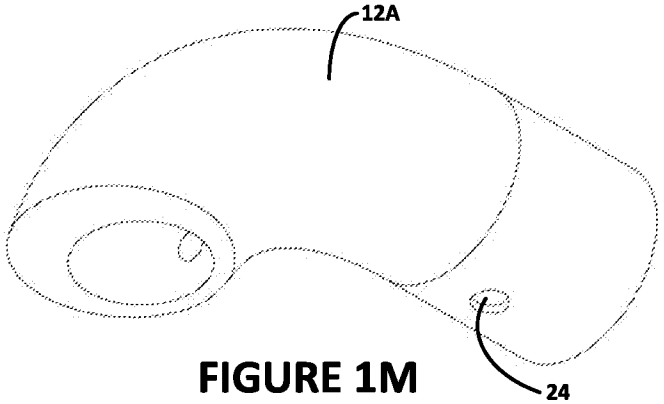
FIG. 1M is a further alternative embodiment of a span member having a radius end.
Figure 1O:
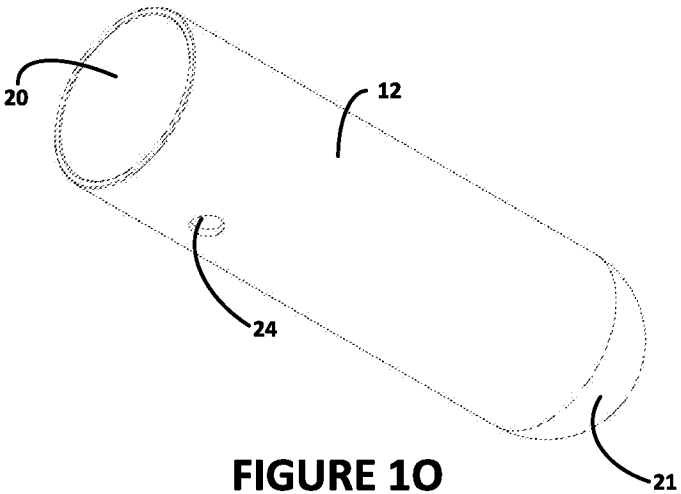
FIG. 1O is a further alternative embodiment of a span member having a bullnose end
Figure 2:
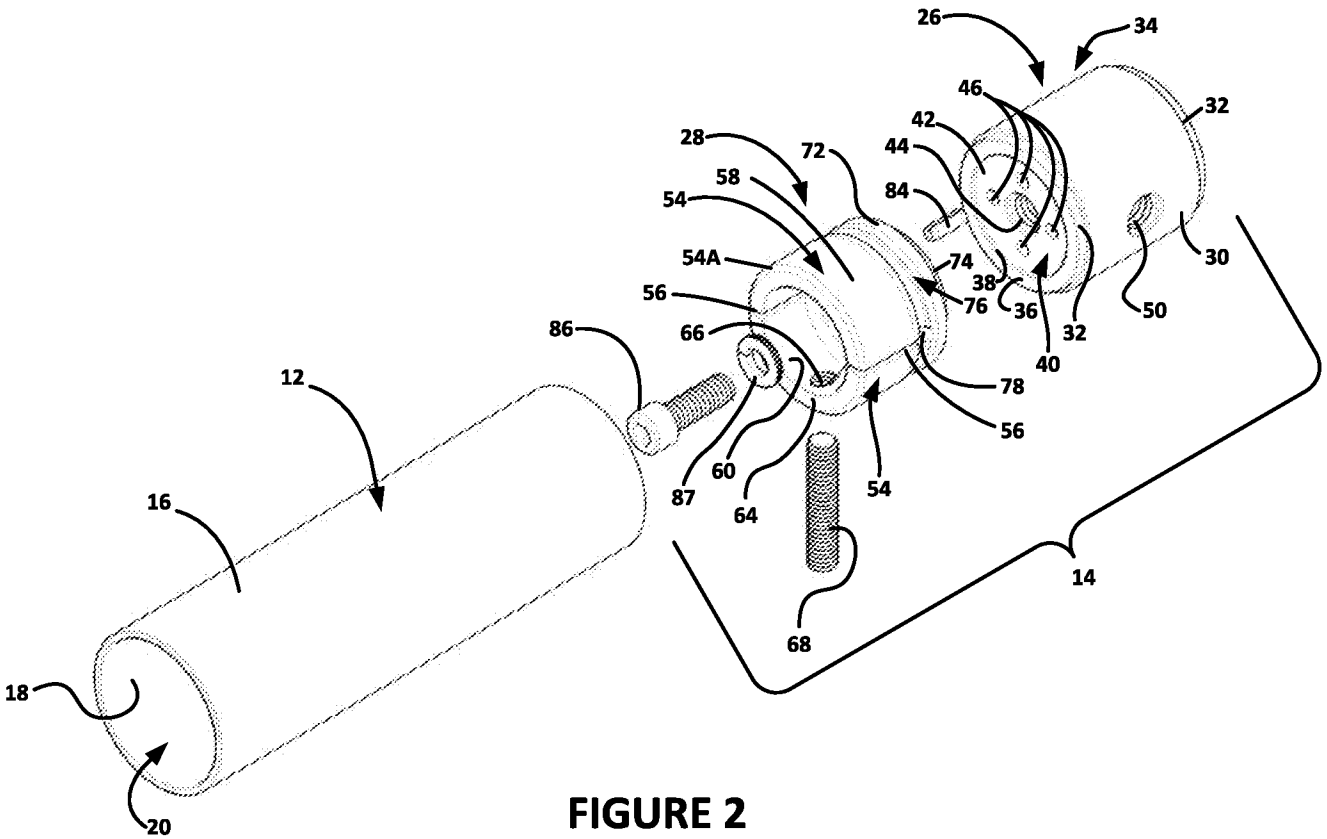
FIG. 2 is an exploded, first isometric view of an embodiment of a span member and connector comprising one expansion member.
Figure 3:
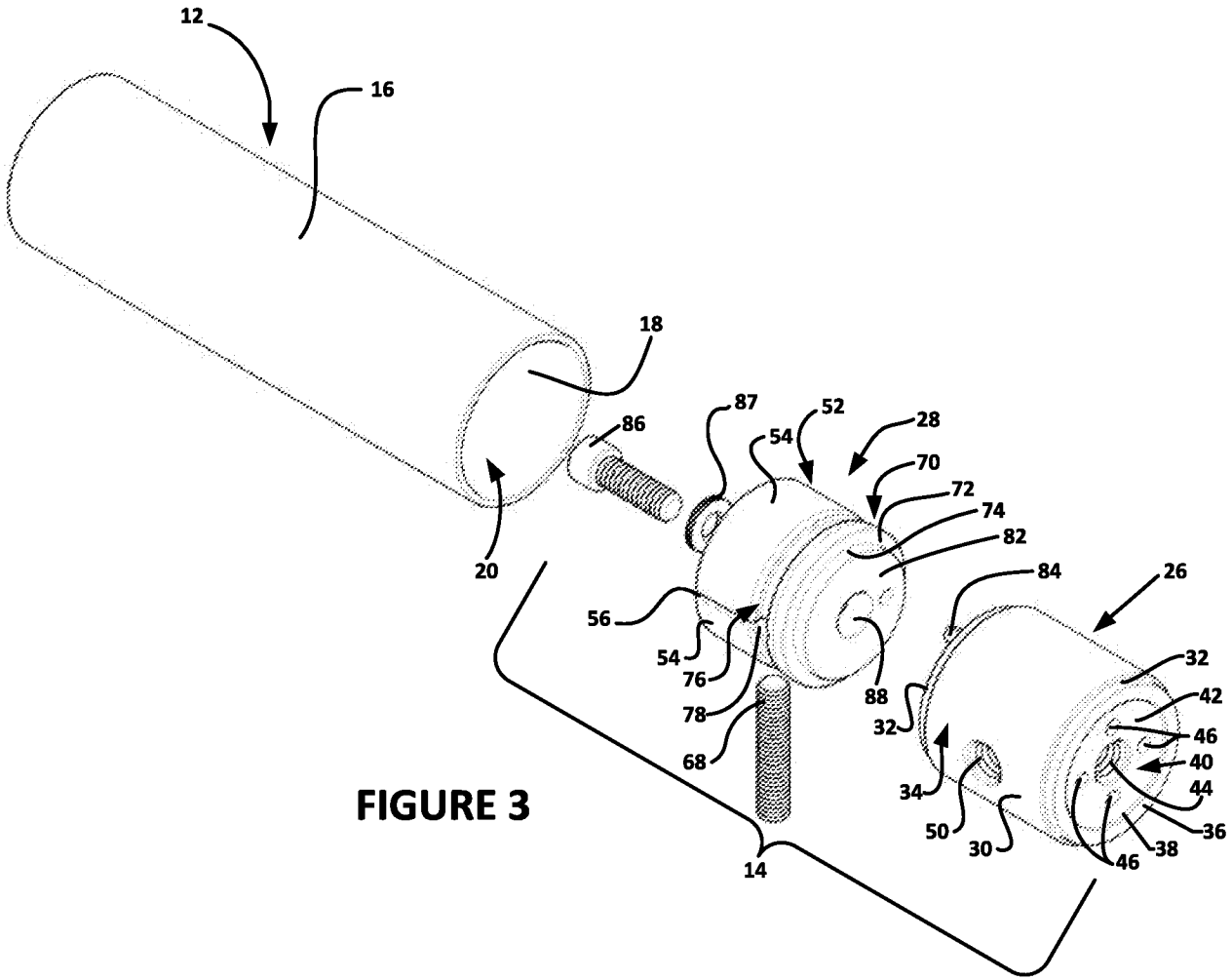
FIG. 3 is an exploded, second isometric view of the span member and connector of FIG. 2.
Figure 4:
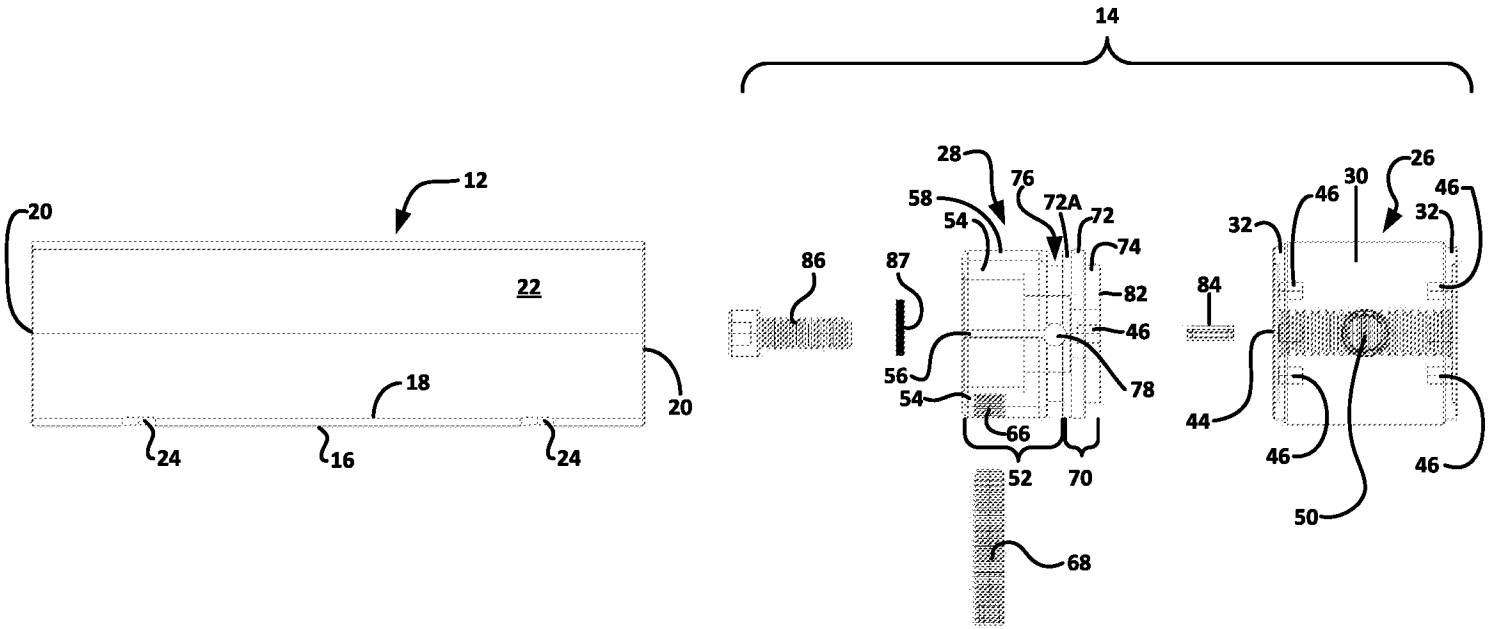
FIG. 4 is an exploded, side elevational view of the span member and connector of FIGS. 2-3.

FIGS. 2-11 illustrates an embodiment of an exemplary span member 12. Span member 12 comprises an outer surface 16, an inner surface 18 and at least one open end 20 (FIGS. 2-4). In some embodiments span member inner surface 18 defines a hollow inner compartment 22 in communication with open end 20 (FIG. 4). In some embodiments span members 12 may be rectilinear tubes. In other embodiments span members 12 may be curvilinear tubes (e.g. FIGS. 1A-1D show span members 12 forming part of a rail system 10; FIGS. 1E-1O show various exemplary span members 12 or 12A in isolation). In some embodiments span members 12 may comprise two open ends 20. In other embodiments span member 12 may comprise one open end 20 and one closed end 21 which may form the terminus of a rail system 10. For example, as shown in FIGS. 1N and 1O, closed end 21 of a span member 12 may formed in many alternative shapes and contours, such as semi-spherical, bullet-shaped, bull-nose, and bent-mitre.

In some embodiments span members 12 may comprise an aperture 24 extending transversely between outer surface 16 and inner surface 18 proximate an open end 20 thereof (FIG. 4). For example, in some embodiments aperture 24 may be spaced approximately 0.5 to 1 inch from open end 20.

Figure 25:
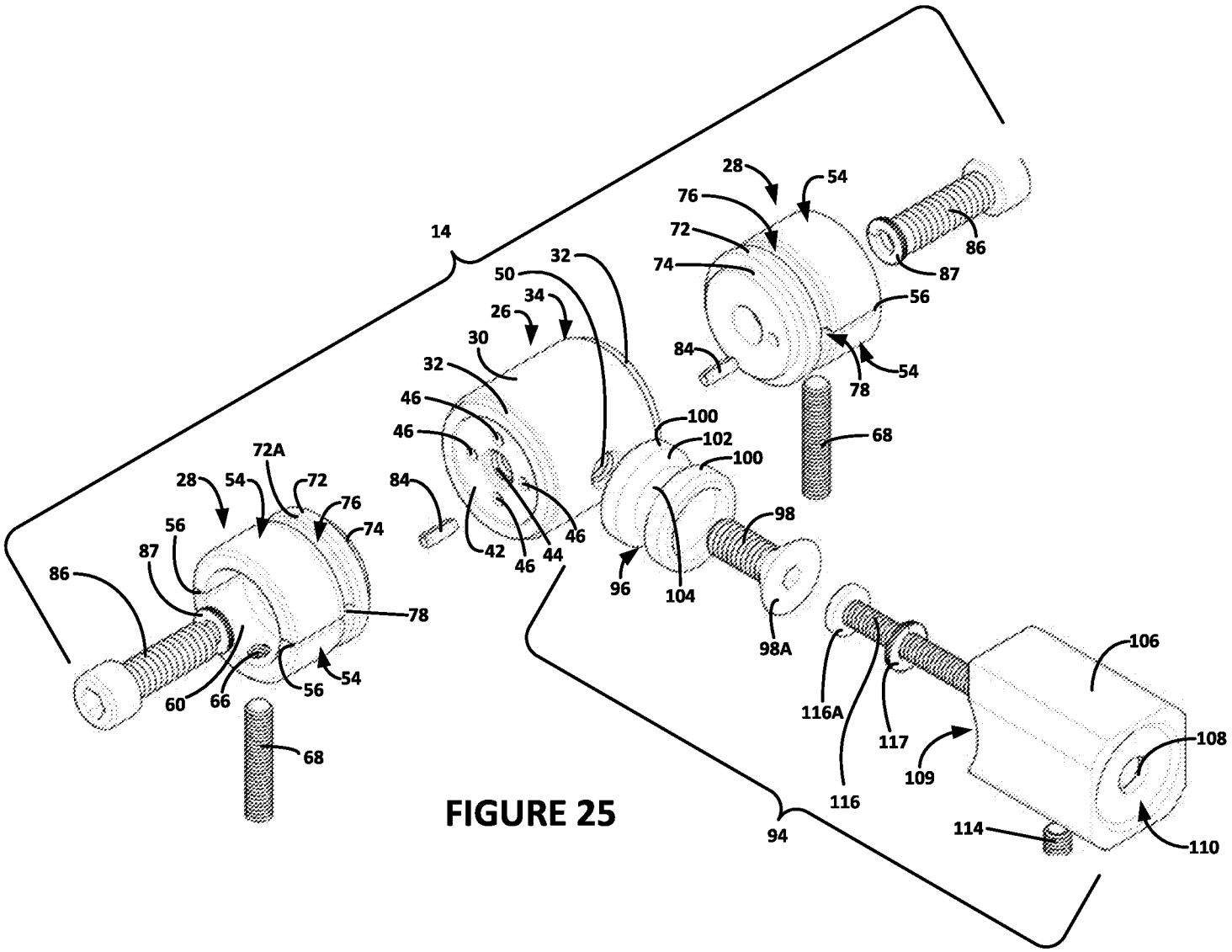
FIG. 25 is an exploded, isometric view of a connector comprising two expansion members and one embodiment of a mounting assembly.
Figure 26:
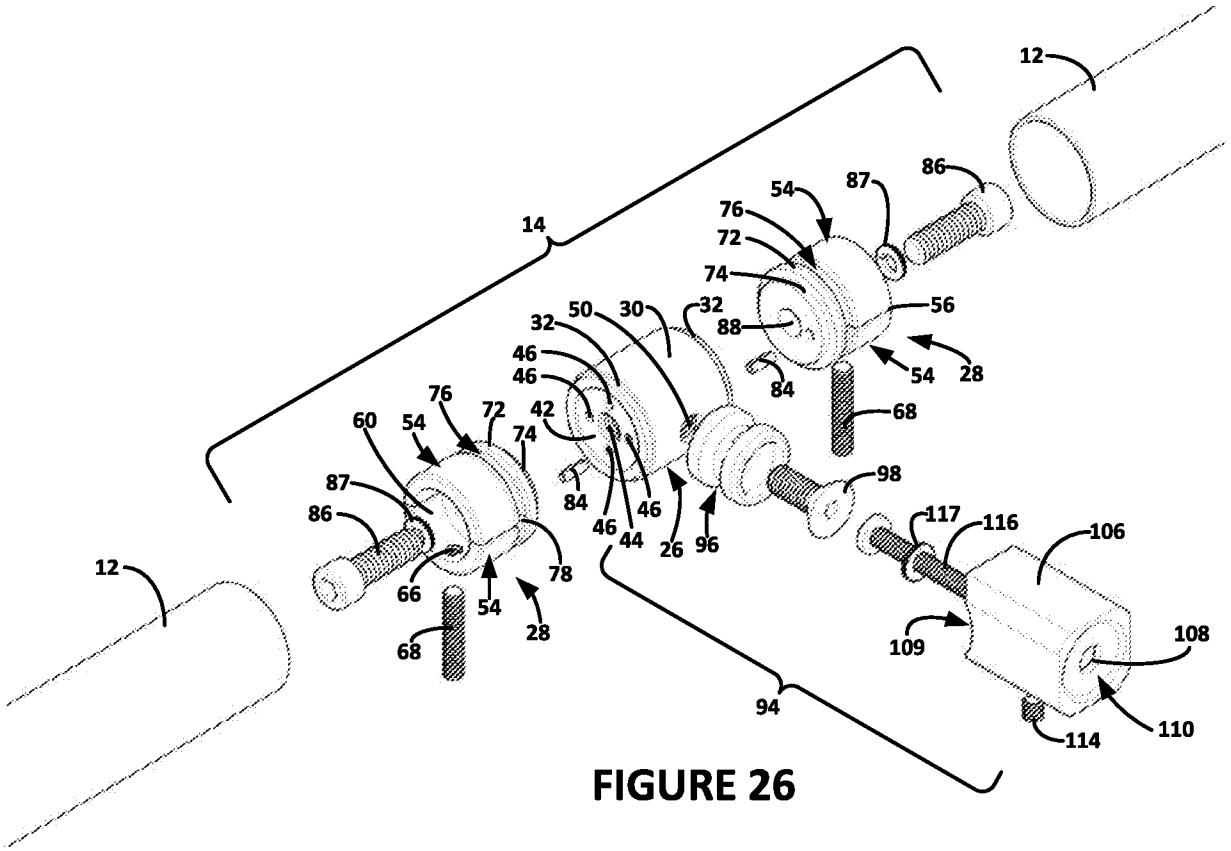
FIG. 26 is an exploded, isometric view thereof showing two span members joined by the connector.
Figure 27:
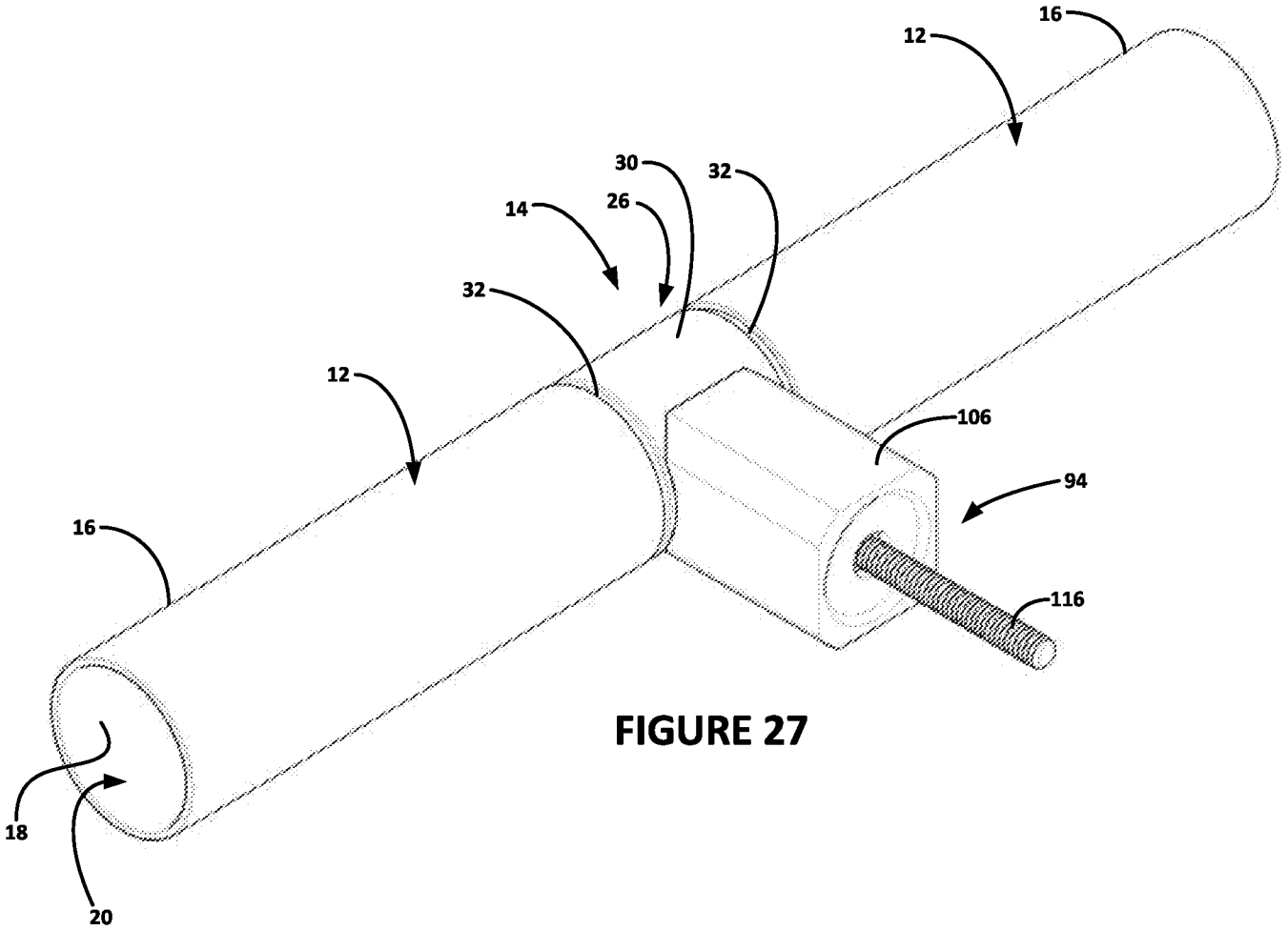
FIG. 27 is an isometric view of the span members, connector and mounting assembly of FIGS. 25-26 in an assembled configuration.
Figure 29:
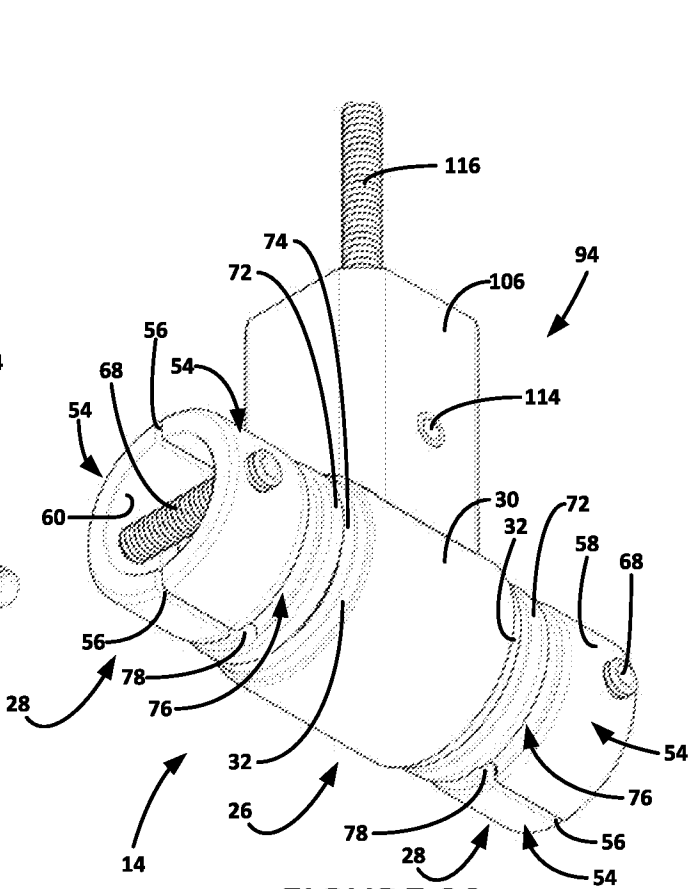
FIG. 29 is an enlarged, assembled, second isometric view thereof.
Figure 28:
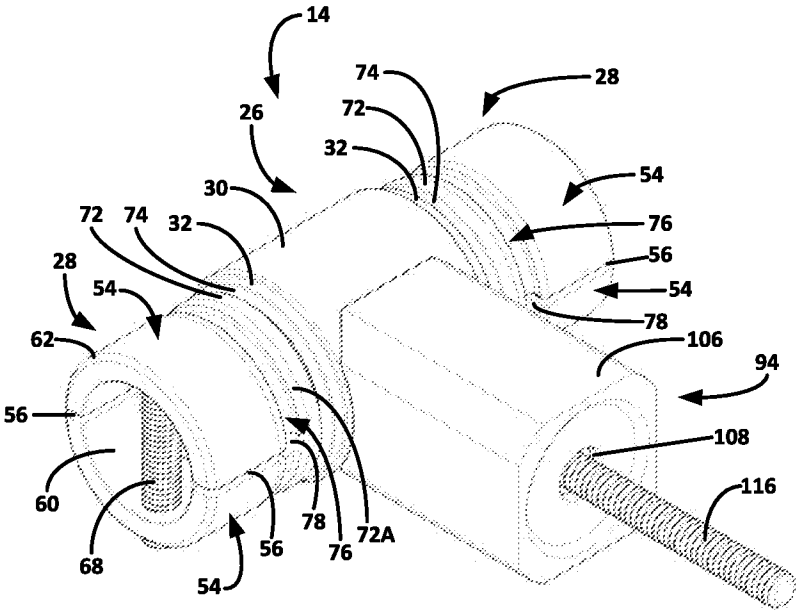
FIG. 28 is an enlarged, assembled, first isometric view of the connector and mounting assembly of FIGS. 25-27.
Figure 30:
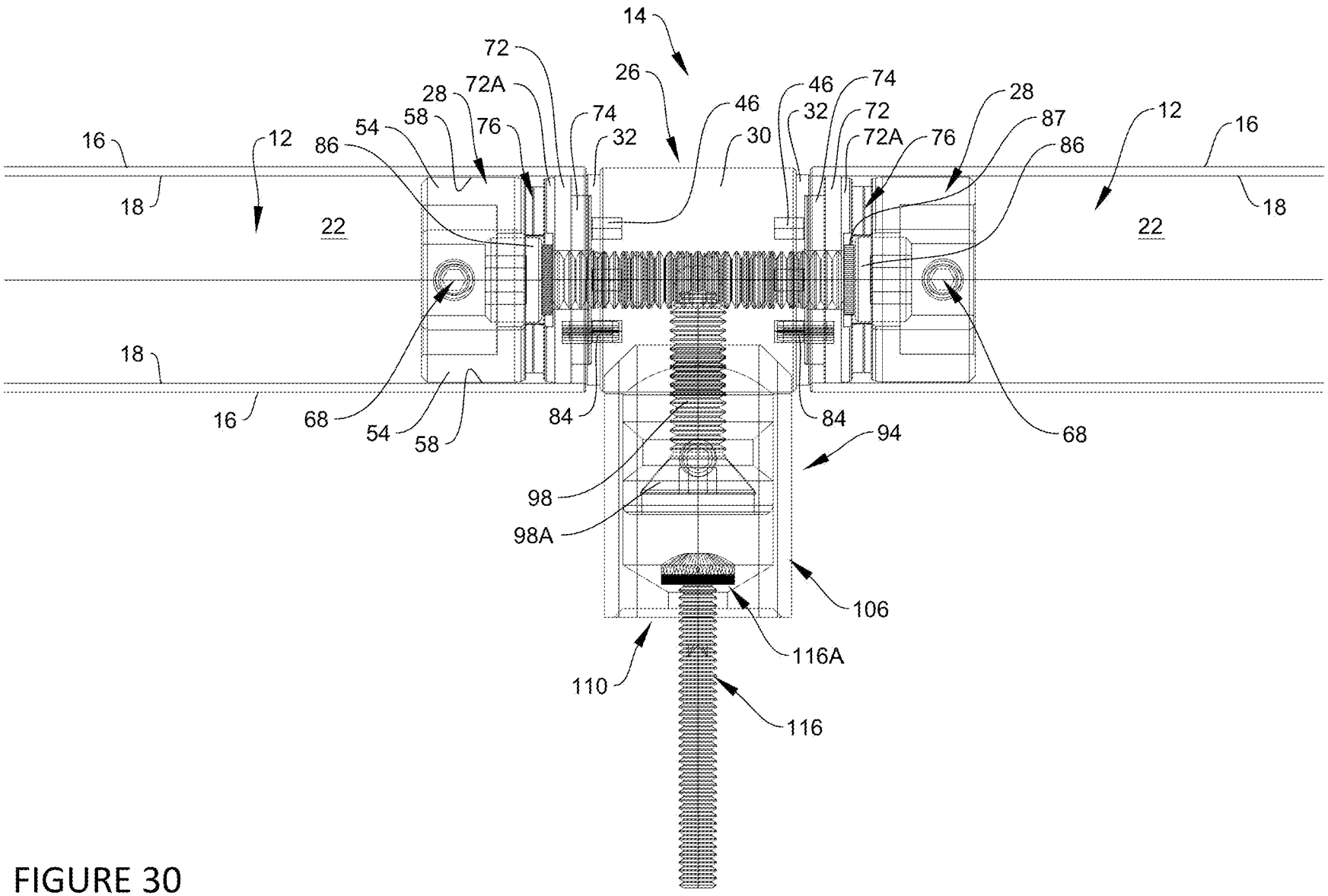
FIG. 30 is a top plan view showing the connector coupling two span members together.

FIGS. 2-19 illustrate an embodiment of connector 14. Connector 14 comprises a connector span 26 and at least one expansion member 28. In some embodiments connector 14 may comprise two expansion members 28 coupled on either end of a connector span 26 (FIGS. 25-27). As discussed further below, in some embodiments connector span 26 and expansion members 28 are releasably connectable (e.g. FIG. 19). In other embodiments connector span 26 and expansion members 28 are integrally connected (e.g. FIG. 20).

Figure 6:
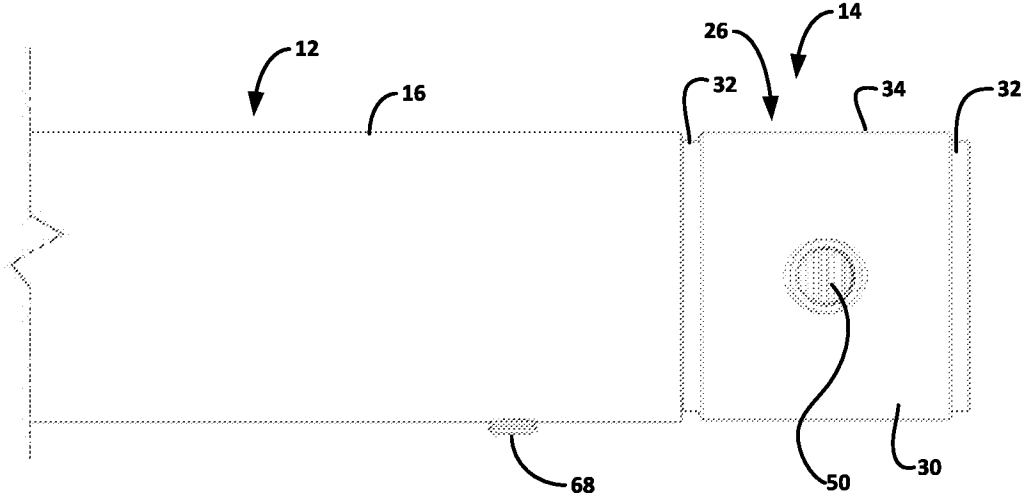
FIG. 6 is an enlarged, side elevational view thereof.
Figure 5:
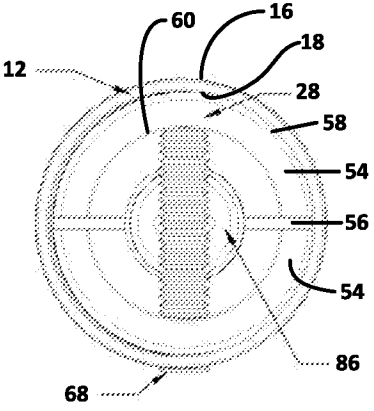
FIG. 5 is an enlarged, end elevational view of an assembled span member and connector of FIGS. 2-3 showing the set screw actuator fully inserted.
Figure 8:
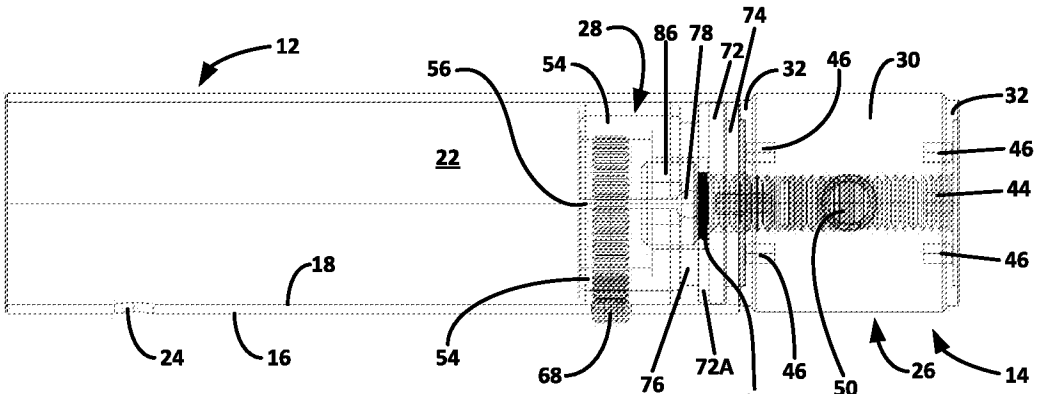
FIG. 8 is a side view of the span member and connector of FIG. 7 with the set screw actuator inserted.
Figure 7:
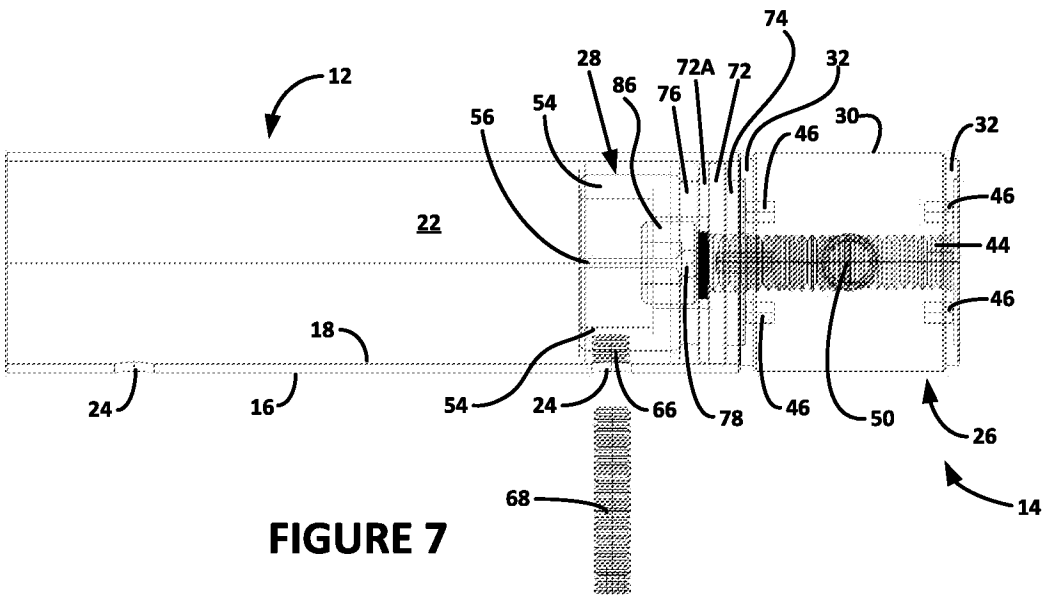
FIG. 7 is a side view of a span member and connector with a set screw actuator removed.
Figure 11:
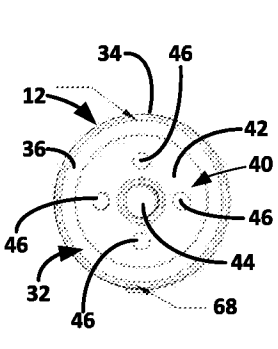
FIG. 11 is a second end view thereof.
Figure 9:
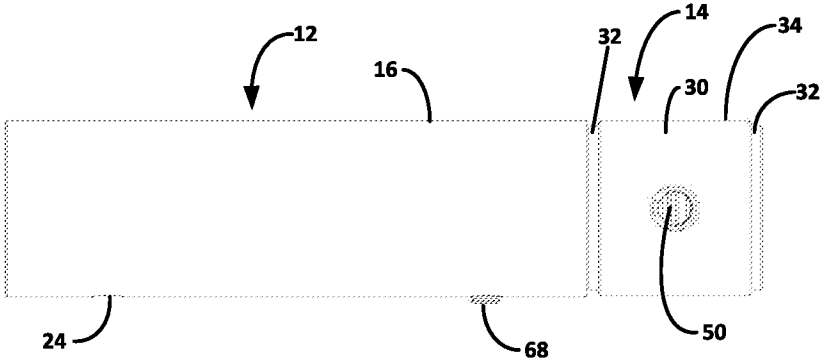
FIG. 9 is a side view of a span member and connector in an assembled configuration with the set screw actuator inserted.
Figure 10:
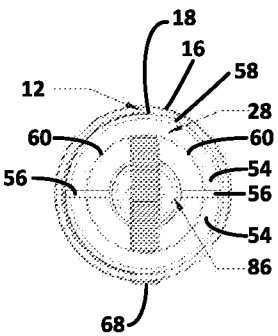
FIG. 10 is a first end view thereof.

In some embodiments connector span 26 is generally cylindrical in shape and comprises a primary span portion 30 having a first outer diameter and flanges 32 formed at either end of connector span 26 and each having a second outer diameter less than the first outer diameter. Flanges 32 thus form slightly recessed narrow end portions of an outer surface 34 of connector span 26 (FIG. 6).

Figure 19:
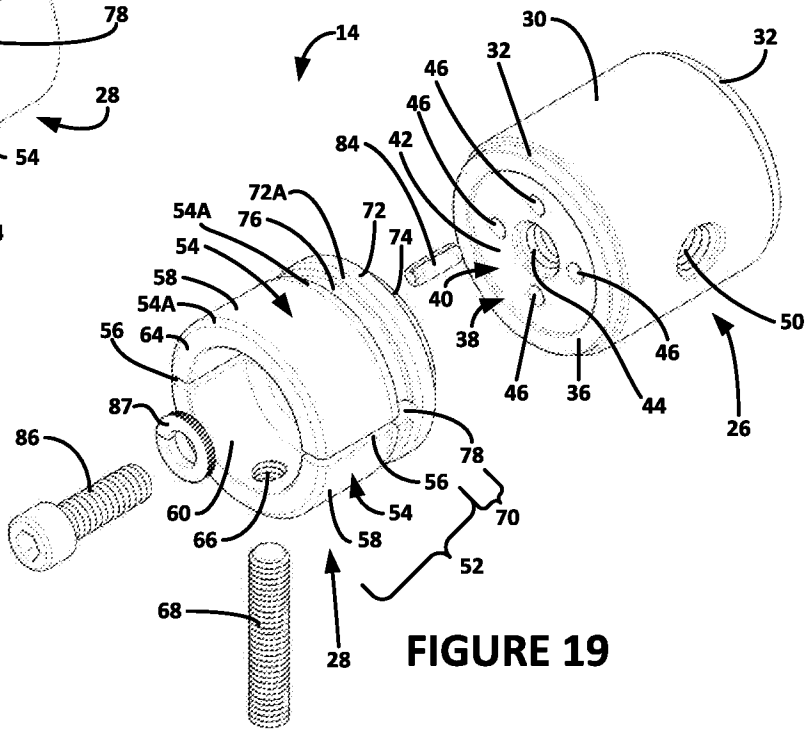
FIG. 19 is an enlarged, exploded isometric view of the connector of FIGS. 16-18.

As shown for example in FIG. 19, each flange 32 has an annular end surface 36 and an inner surface 38 which defines the side wall of a shallow end compartment 40 of connector span 26. The depth of compartment 40 is defined by an end plate 42 surrounded by flange inner surface 38. In some embodiments end plate 42 comprises a first threaded central aperture 44 and one or more secondary apertures 46. In some embodiments central aperture 44 extends longitudinally through the body of connector span 26. As described further below, in some embodiments apertures 44, 46 are used to releasably couple an expansion member 28 to connector span 26 at a selected rotational position.

Connector span 26 may also comprise a threaded aperture 50 which extends transversely through the body of primary span portion 30. In some embodiments transverse aperture 50 is in communication with longitudinal aperture 44, as shown for example in FIG. 31. As described further below, aperture 50 may be used to releasably couple connector span 26 to other modular components of system 10, such as a mounting assembly 94 (FIGS. 25 and 26).

Figure 20:
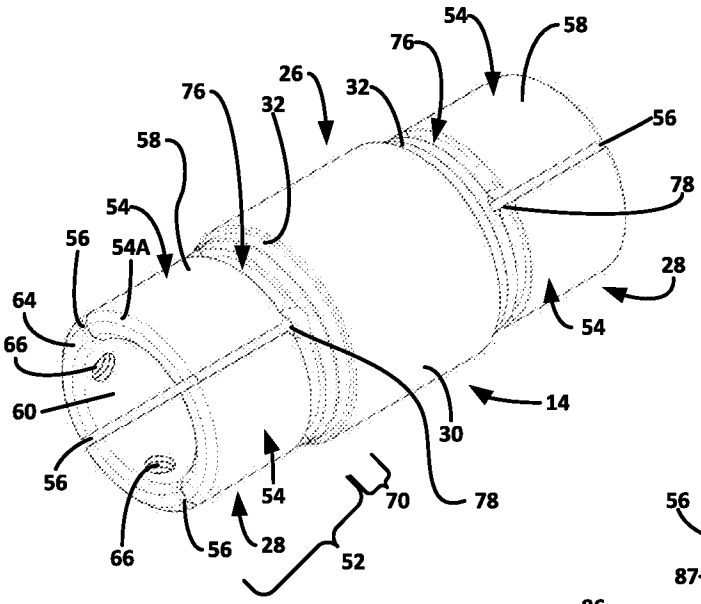
FIG. 20 is an enlarged, isometric view of an alternative embodiment of a connector comprising two integral expansion members.

As shown in FIG. 19, each expansion member 28 is generally cylindrical in shape and has a longitudinal axis which can be aligned with the longitudinal axis of connector span 26. In some embodiments each expansion member 28 comprises a first portion 52 comprising a plurality of wall segments 54 separated by a longitudinal slot 56 extending parallel to the longitudinal axis of member 28 (e.g. FIGS. 4 and 19). Each wall segment 54 has an outer surface 58 and an inner surface 60. In some embodiments wall segment 54 may have chamfered edges 54A merging with an end wall 64. In the embodiment of FIG. 19 first portion 52 comprises two wall segments 54. In the embodiment of FIG. 20 first portion 52 may comprise four or more wall segments 54, each separated from an adjacent wall segment 54 by a slot 56.

Each first portion 52 of an expansion member 28 comprises an aperture 66 extending transversely through at least one of the wall segments 54. In some embodiments aperture 66 is threaded. As described further below, aperture 66 can be aligned with an aperture 24 of a span member 12 when an expansion member 28 is inserted through an open end 20 of a span member 12.

Figure 14:
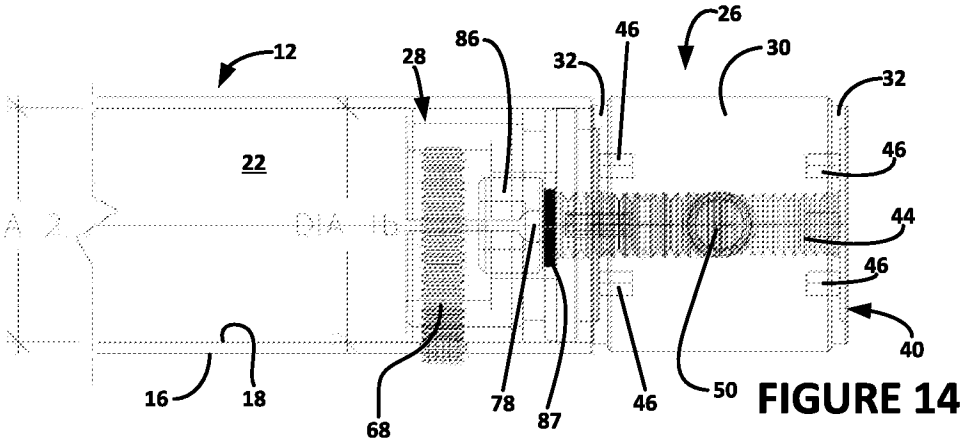
FIG. 14 is an enlarged, side view of a connector having an expansion member inserted within a span member and showing the set screw actuator inserted.
Figure 12:
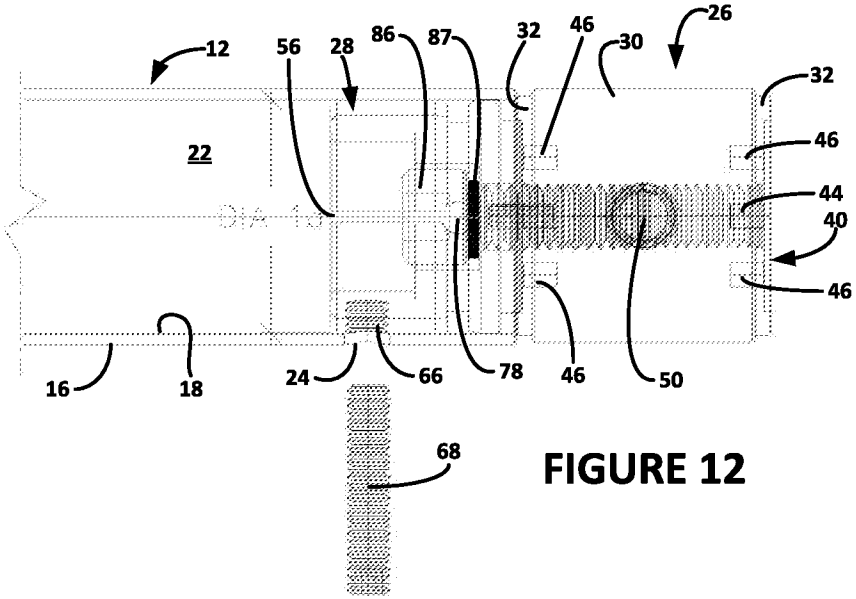
FIG. 12 is an enlarged side view of a connector having an expansion member inserted within a span member and showing the set screw actuator removed.
Figure 15:
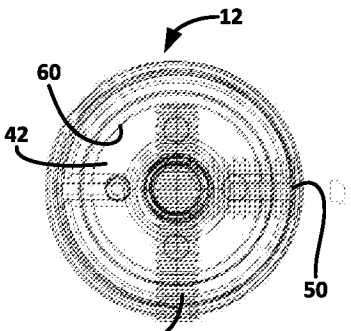
FIG. 15 is an end elevational view thereof.
Figure 13:
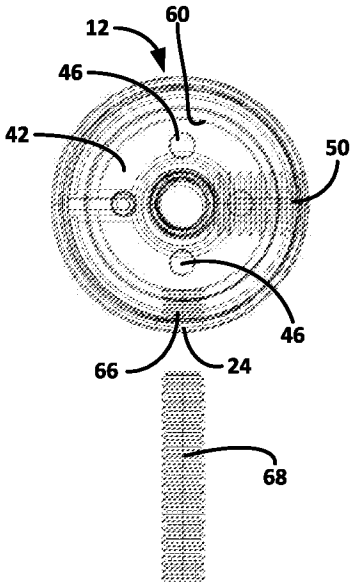
FIG. 13 is an end elevational view thereof.
Figure 18:
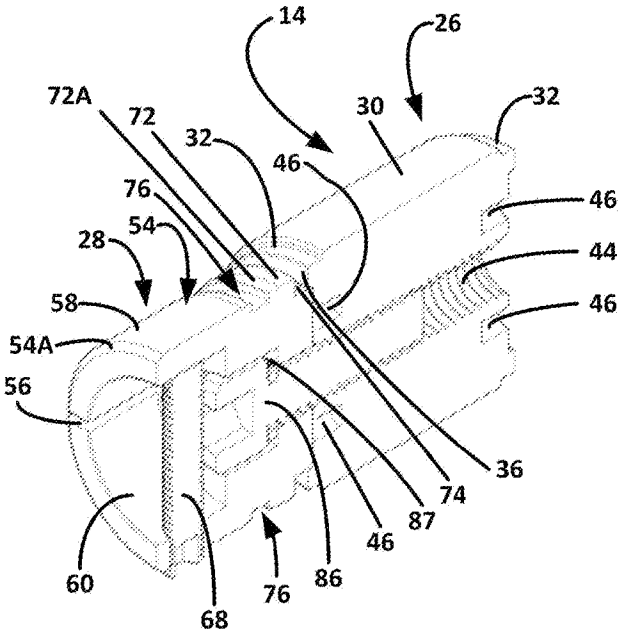
FIG. 18 is a longitudinal sectional view of the connector of FIGS. 16-17.
Figure 16:
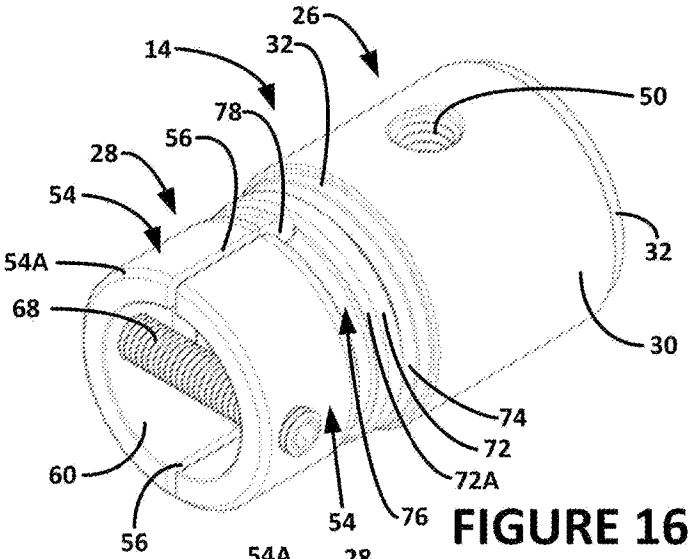
FIG. 16 is a first isometric view of an assembled connector comprising a single expansion member.
Figure 17:
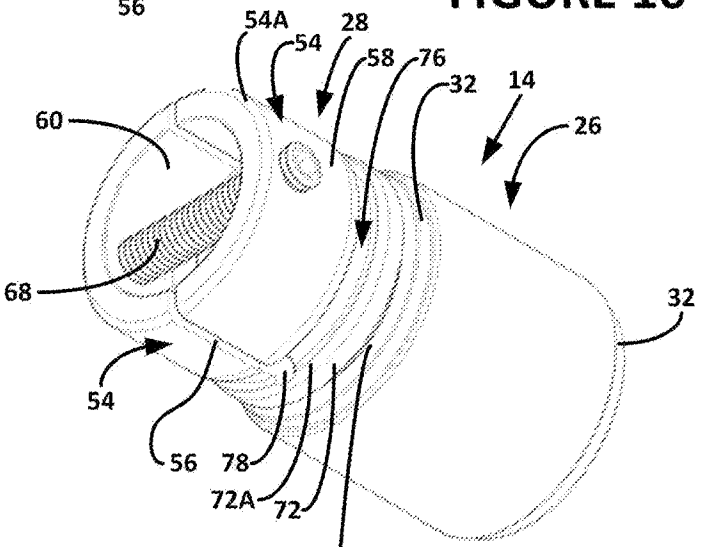
FIG. 17 is a second isometric view of an assembled connector comprising a single expansion member.

Modular rail system 10 further comprises an actuator for adjusting expansion member 28 between a first, reduced-diameter configuration, wherein expansion member 28 is insertable into an open end 20 of a span member 12, and a second, expanded diameter configuration wherein the distance between opposed wall segments 54, and hence the width of slots 56, is increased. As described further below, this enables the outer surfaces 58 of each wall segment 54 to securely engage an inner surface 18 of a span member 12. In some embodiments the actuator may comprise an elongate rod insertable through aligned apertures 24, 66. In a particular embodiment the actuator may be a set screw 68 which threadedly engages aperture 66 and can be rotatably adjusted to extend transversely through expansion member 28 to engage a contact point on the inner surface 60 of wall segment 54 opposite aperture 66, as discussed further below. Further rotation of set screw 68, applies a force to spread opposed wall segments 54 apart, adjusting expansion member 28 from the first, reduced-diameter configuration to the second, expanded diameter configuration. This enables outer surface 58 of wall segment 54 to contact and apply a force to an inner surface 18 of span member 12 opposite aperture 24 to securely couple connector 14 and span member 12 together. Conversely, in order to decouple a span member 10 and a connector 14, set screw 68 may be rotated in the opposite direction, adjusting expansion member 28 from the second, expanded diameter configuration to the first, reduced-diameter configuration. In some embodiments span member 10 cannot be decoupled from connector 14 until set screw 68 is completely removed from aligned apertures 24, 66. This ensures that rail system 10 will remain safely assembled even if one or more set screws 68 become loose. By way of example, FIGS. 12 and 13 show set screw 68 withdrawn from apertures 24, 66 and FIGS. 14 and 15 show set screw fully inserted through apertures aligned 24, 66 and contacting an inner surface 60 of a wall segment 54 opposite aperture 66.

First portion 52 of expansion member 28 further comprises an annular groove or slot 76 and a transverse borehole 78 passing through slot 76 (FIG. 4). Borehole 78 forms an enlarged terminus end of slot 56. This configuration enables a more uniform dispersal of forces as expansion member 28 is adjusted between the reduced diameter and expanded diameter positions described above, avoiding metal fatigue and potential metal deformation and fracture as expansion member 28 flexes. As shown in the drawings, each wall segment 54 is semi-circular or quarter-circular in shape in some embodiments. The location of slot 76 at the base of wall segments 54 facilitates relatively uniform opening and closing of wall segments 54 in a "clam-shell" like manner as set screw 68 is rotated. This helps ensure that substantially the entire outer surface 58 of each wall segment 54 engages inner surface 18 of span 12 rather only a portion of surface 58 in the vicinity of set screw 68.

In some embodiments a shallow groove (not shown) may be formed in an outer circumferential portion of first end portion 52 of expansion member 28. Such a groove is provided for optionally receiving liquid glue or some other adhesive for use in applications where it is desired to more securely or permanently mount connector 14 to a span member 12 or some other modular component or support structure.

Returning to FIGS. 4 and 19, in some embodiments each expansion member 28 includes a second portion 70 joined to first portion 52 for coupling expansion member 28 to a connector span 26. Second portion 70 comprises an annular collar 72 and an end flange 74. Collar 72 may have one or chamfered side edges 72A. As shown for example in FIGS. 3 and 4, end flange 74 defines an end surface 82 of expansion member 28 at one end thereof. Plate 82 has a central aperture 88 formed therein, which is alignable with threaded aperture 44 of connector span 26.

In some embodiments each expansion member 28 may be releasably coupled to a connector span 26. In some particular embodiments expansion member 28 and connector span 26 may be formed from different materials. For example, expansion member 28 may be formed from aluminum to provide enhanced flexibility and flexure characteristics and connector 26 may be formed from stainless steel. When end flange 74 of an expansion member 28 is inserted into a corresponding compartment 40 of connector span 26 apertures 88 and 44 are aligned. A roll or connecting pin 84 projecting from end surface 82 of end flange 74 is selectively positionable within one of the apertures 46 located on end plate 42 of connector span 26 (in some embodiments connecting pin 84 is rigidly connected to end surface 82 although it is illustrated exploded-apart from surface 82 in some figures, such as FIGS. 2-4). This enables each expansion member 28 to be coupled to connector span 26 at a selected rotational position, thereby varying the locations of expansion member apertures 66 relative to connector span aperture 50. For example, it may be desired that aligned apertures 24,66, and set screw 68 passing therethrough, be aligned with connector span aperture 50 which is used to mount a connector 14 on a support structure, such as a support surface 95 as discussed further below. Alternatively, it may be desired that aligned apertures 24,66, and set screw 68, be offset 90° or 180°, or some other angular offset, from aperture 50. This can be achieved by varying the number and position of apertures 46 formed in end plate 42 into which connecting pin 84 is selectively inserted. If desired, the preferred configuration could be decided by an installer on-site. Thus the structure of connectors 14 enhances the versatility and ease of installation of rail system 10 while minimizing the number of required components.

Once an expansion member 28 and connector span 26 have been coupled together in the desired orientation, a fastener 86 may be passed through a washer 87 and coupled to threaded aperture 44 of connector span 26, as shown for example in FIGS. 2-3 and 16-18. Optionally, another expansion member 28 may be similarly coupled to connector span 26 at the other end thereof to form an assembled connector 14 (e.g. FIGS. 1A-1B and 25-27).

Figure 21A:
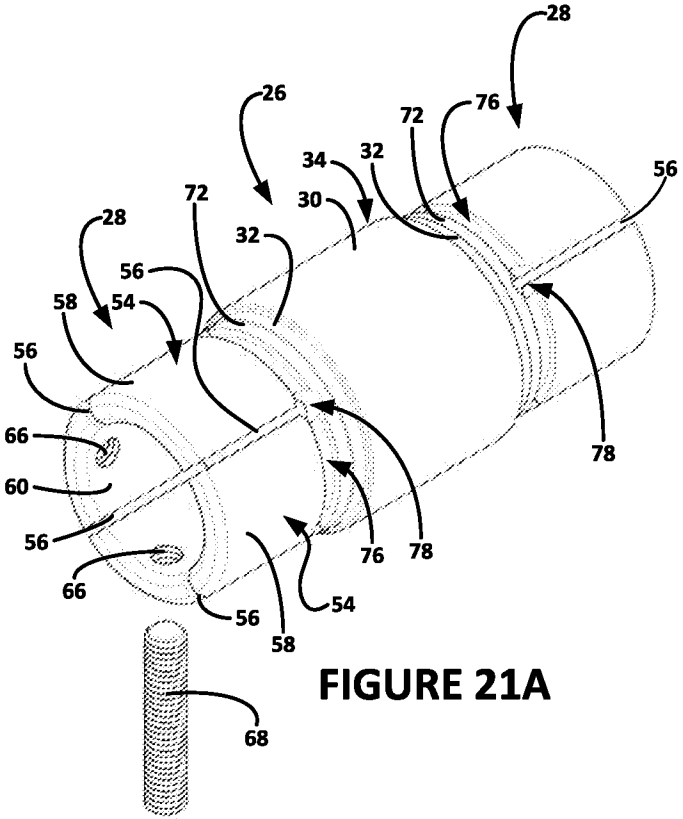
FIG. 21A is a first isometric view of the connector of FIG. 20 showing a set screw actuator withdrawn from an expansion member.
Figure 21B:
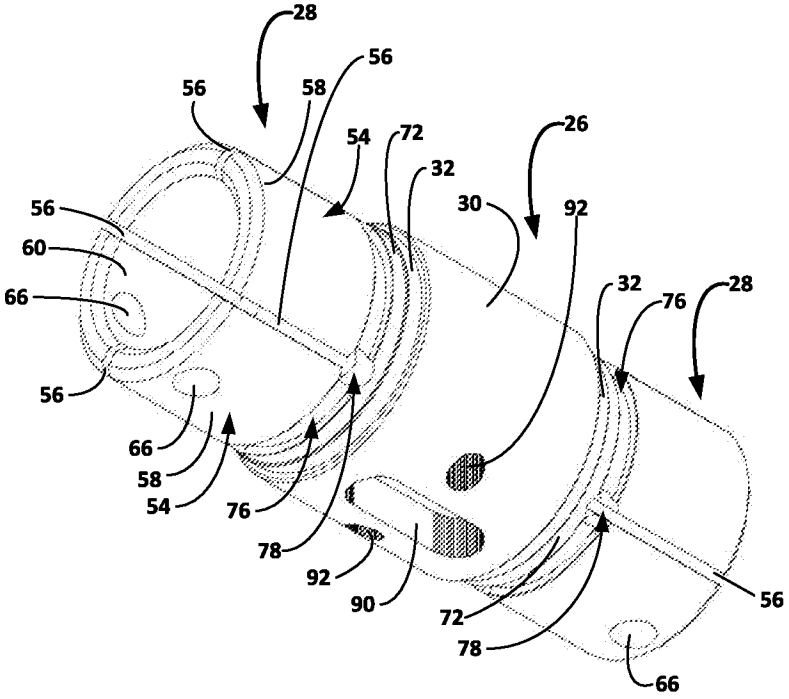
FIG. 21B is a second isometric view of the connector of FIG. 21A showing an elongated slot for receiving an electrical cable and a pair of spaced-apart mounting apertures
Figure 21C:
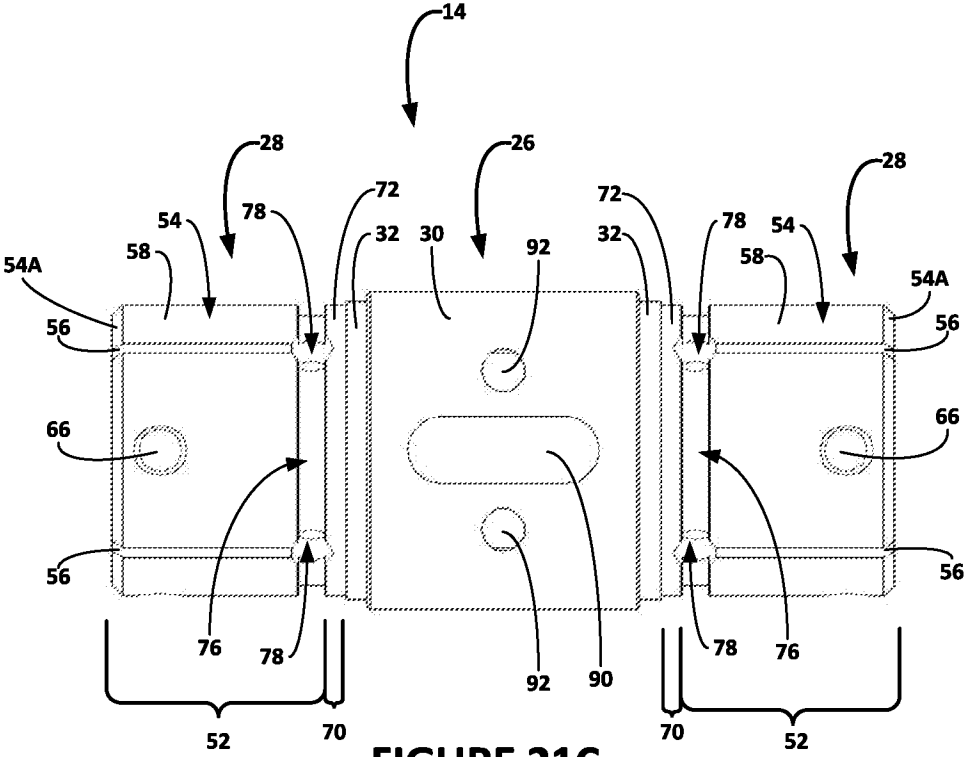
FIG. 21C is side elevational view of the connector of FIG. 21B.
Figure 22:
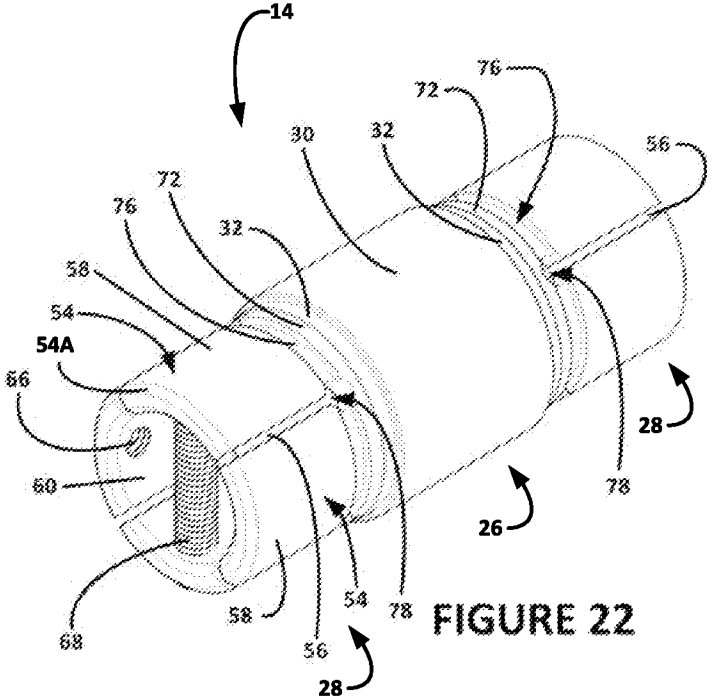
FIG. 22 is an isometric view thereof showing the set screw actuator inserted within an expansion member in a first orientation.
Figure 24:
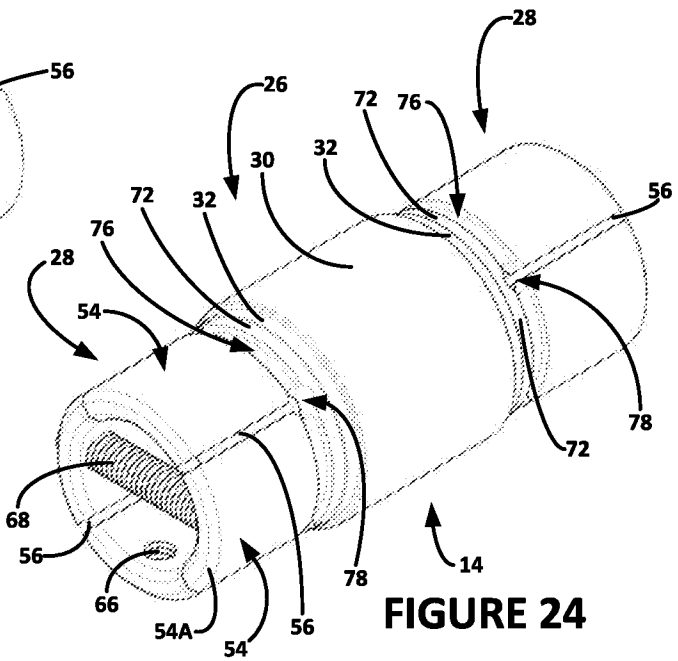
FIG. 24 is an isometric view thereof showing the set screw actuator inserted within an expansion member in a second orientation.
Figure 23:
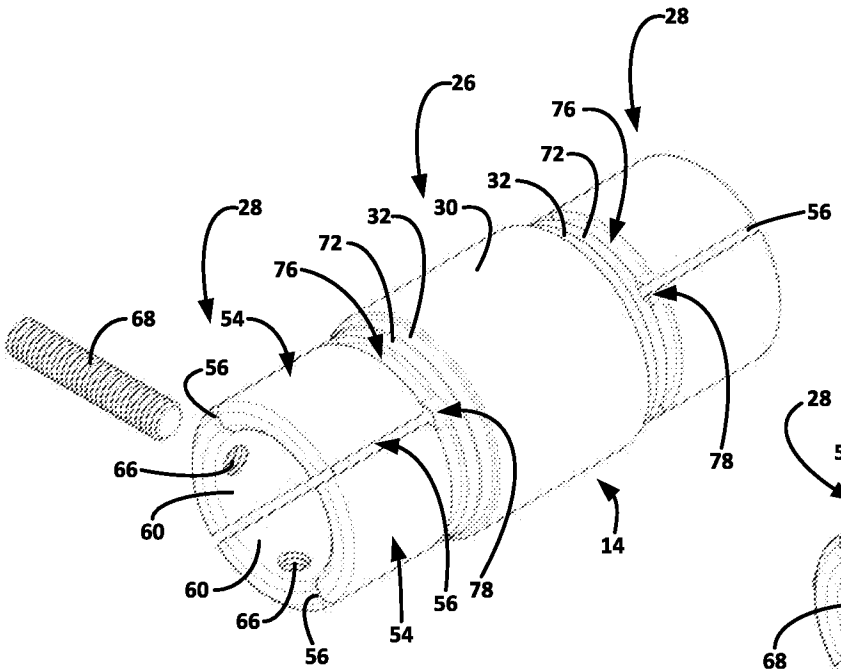
FIG. 23 is an isometric view thereof showing the set screw actuator withdrawn from an expansion member.

FIGS. 20-34 illustrate another embodiment of a connector 14 which is fabricated as an integral unit rather than an assembly of separate expansion member(s) 28 and a connector span 26. In this embodiment each expansion member 28 is integrally connected to connector span 26 and hence end plate 42 of connector span 26 and end plate 82 of each expansion member 28 are omitted. In this embodiment connector span 26 and expansion members 28 define a continuous hollow interior opening, for example for receiving electrical cables 128 as described below. In this embodiment threaded apertures 44 and 50 are omitted. Instead a slot 90 may be formed in primary span portion 30 (FIGS. 21B and 21C). A pair of mounting apertures 92 may also be provided adjacent slot 90. As described further below, apertures 92 may be used for coupling connector 14 to a separate mounting assembly or support.

In the embodiment of FIGS. 20-34, each expansion member 28 comprises four curved (e.g. quarter circular) wall segments 54 and four longitudinal slots 56. Two apertures 66 are provided, spaced at different radial positions on first end portion 52. In the illustrated embodiment, apertures 66 are spaced 90° apart. As discussed further below, this enables connector 14 to be deployed at different rotational positions relative to span 12, for example in a position where a slot 90 is facing a support wall surface or where slot 90 is located on an undersurface of connector 14 facing downwardly.

As shown for example in FIGS. 1C-1D and 27, when an expansion member 28 of a connector 14 is adjusted to the first, reduced-diameter configuration and fully inserted through open end 20 into an inner compartment 22 of a span member 12, an end surface of span member 12 engages end surface 36 of a flange 32. Thus when span member 12 and a connector 14 are fully coupled together narrow recessed flanges 32 are visible. Such flanges 32 thus provide a visual break or "pin stripe" between the outer surfaces of primary span portion 30 of connector span 26 and outer surface 16 of span 12. In some embodiments outer surface 16 of span member 12 and primary span portion 30 of connector span 26 have the same outer diameter. However, since span member 12 and primary span portion 30 are not directly flush but rather are separated by flanges 32, small deviations in their outer diameters, for example due to machining of different materials, different metal tolerances etc., will be less visually noticeable.

FIGS. 1A-1D and 25-35 illustrate an embodiment of a mounting assembly 94 for coupling a connector 14 to a support surface 95, such as an interior wall of an elevator cab. Assembly 94 may include a mount connector 96 and a threaded fastener 98 having a head portion 98A for securing mount connector 96 to aperture 50 formed in the body of primary span portion 30. In the illustrated embodiment mount connector 96, also known as a "spacer lock toggler", is generally hourglass-shaped and includes larger diameter end portions 100 which are each joined by tapered surfaces 102 to a smaller diameter central portion 104 (e.g. FIG. 25).

Figure 31:
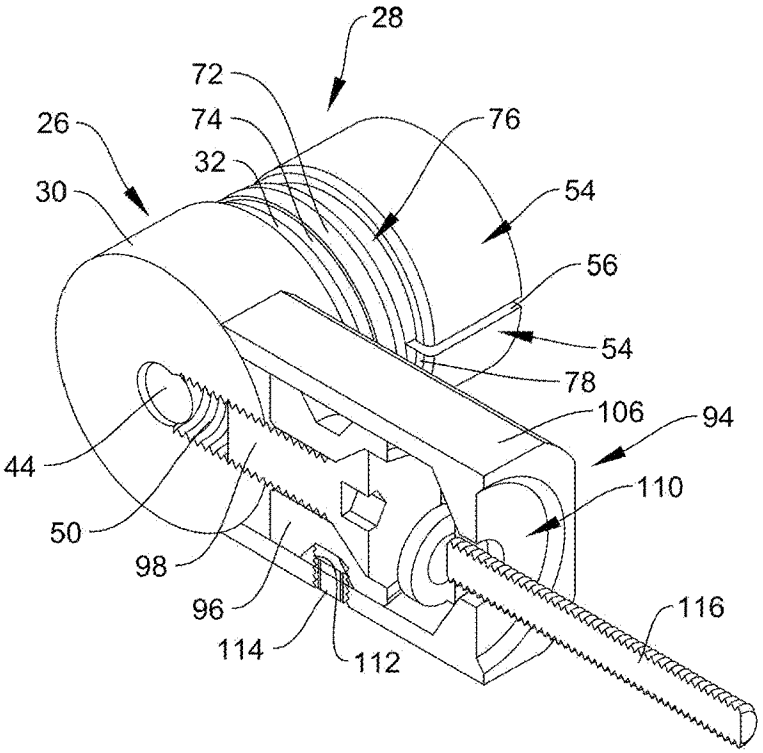
FIG. 31 is an isometric, partially sectional view showing a connector in cross-section and a mounting assembly in longitudinal section.
Figure 32:
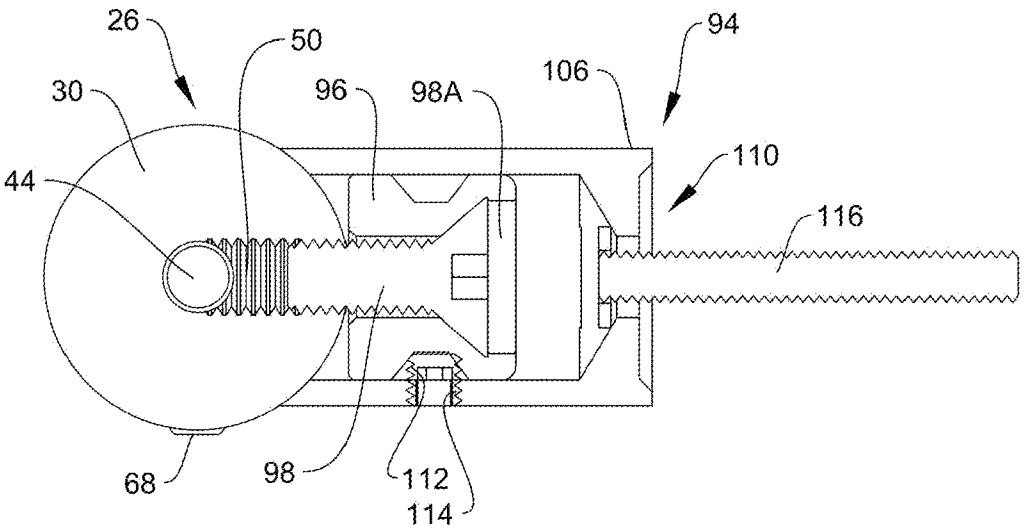
FIG. 32 is a side sectional view of the connector and mounting assembly of FIG. 31.
Figure 33:
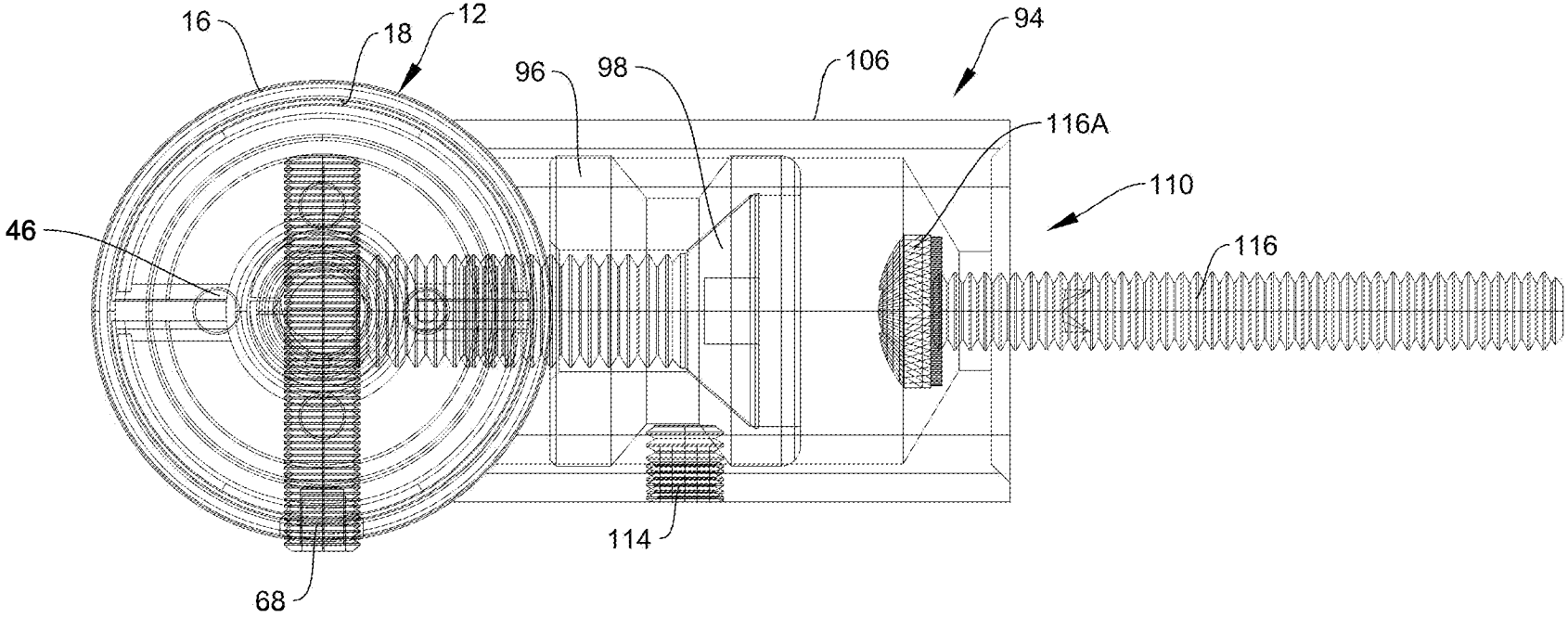
FIG. 33 is a side view of the connector and mounting assembly showing the set screw actuator fully inserted.
Figure 35:
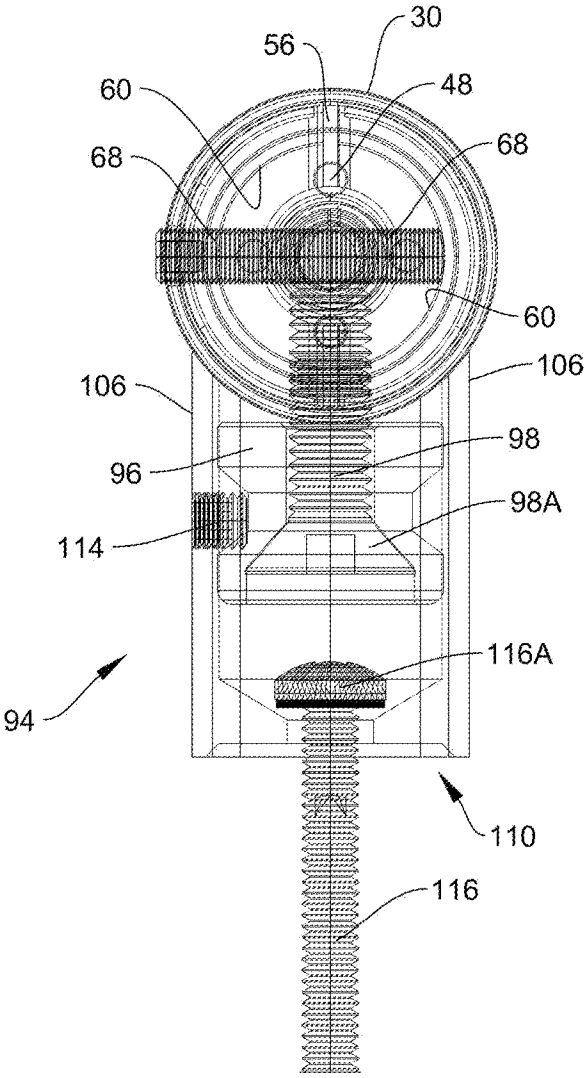
FIG. 35 is an end elevational thereof.
Figure 34:
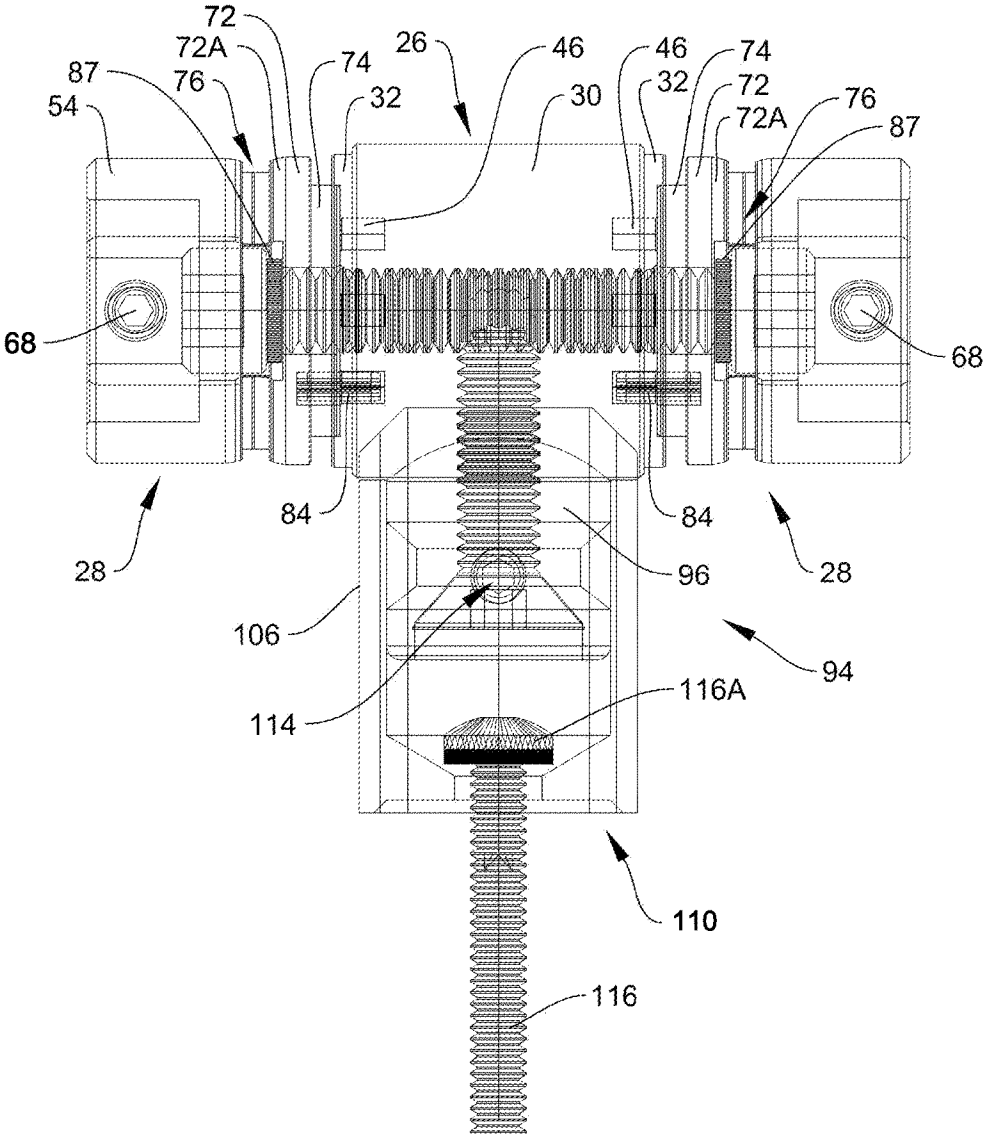
FIG. 34 is a top plan view thereof.
Figures 36A, 36B:
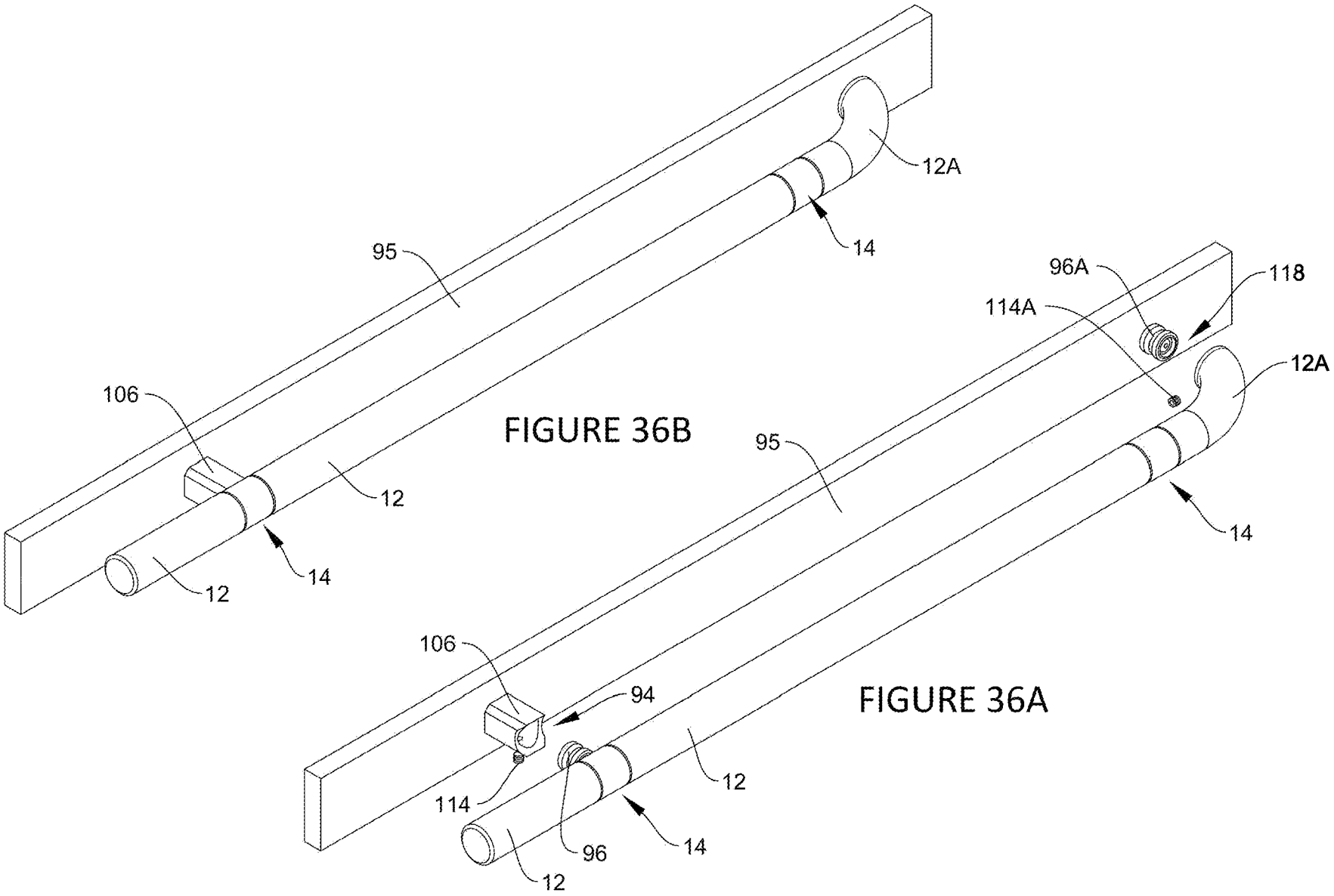
FIG. 36A is a partially exploded, isometric view of an embodiment of a rail system comprising a first mounting assembly for coupling a connector to a support and a second mounting assembly for coupling an end span to the support.
FIG. 36B is an isometric view of the rail system of FIG. 36A in a fully assembled configuration.

Mounting assembly 94 may further comprise a mount housing 106 which is mountable on a support surface with a suitable fastener 116 having a head portion 116A. Fastener 116 may be passed through a washer 117 and an aperture 108 formed in housing 106 to secure housing 106 to a support structure, such as surface 95. Housing 106 includes an interior compartment sized to receive mount connector 96 and comprises end portions 109 and 110 each having a shape and contour to match the surface to which it is secured. For example, end portion 109 may have a concave shape to match the convex curvature of the outer surface 34 of connector span 26 (FIG. 25). In some embodiments end portion 110 may have a flat contour or may comprise a shallow circular compartment for receiving a disk-shaped fixture mounted on the support surface. Housing 106 further includes an aperture 112 through which a threaded fastener 114 can be inserted (FIGS. 31 and 32). When fastener 114 is fully tightened a leading end of fastener 114 engages mount connector 96 to securely couple mount connector 96 and housing 106 together. In some embodiments aperture 112 may be positioned to engage a tapered surface 102 of mount connector 96 such that tightening of fastener 114 causes housing 106 to be drawn toward connector span 26 to engage connector 14 more securely.

As discussed further below, FIGS. 48-54 illustrate an alternative mounting assembly 94A for coupling a connector 14 to a support structure. In particular, in this example mounting assembly 94A is configured for mounting the connector span 26 of FIGS. 21B and 21C to a support surface 95. In this embodiment a mount housing 106A is directly coupled to support surface 95 by means of a pair of fasteners 130 which are threadedly received in mounting apertures 92 formed in primary span member 30. In this embodiment the interior of housing 106A is not configured to receive a mount connector 96 but is hollow to enable the passage of electrical cables 128 from connector 14 through slot 90 formed in primary span portion 30 and further through housing 106A to an electrical power supply 126 mounted on or near support surface 95 (FIG. 50), as described further below.

Figure 37A:
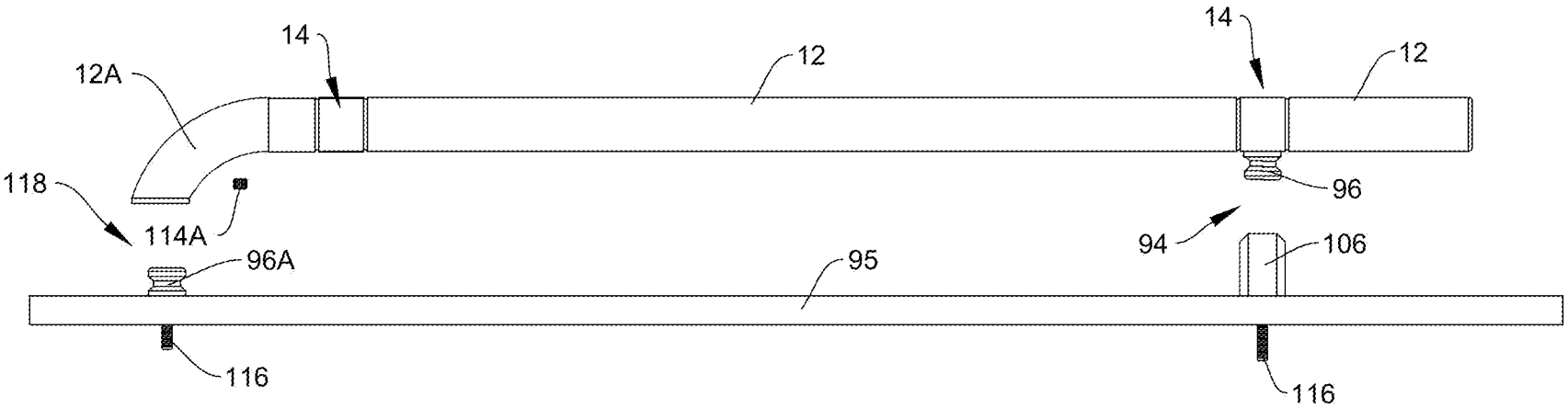
FIG. 37A is a top plan view of the rail system of FIG. 36A.
Figure 37B:
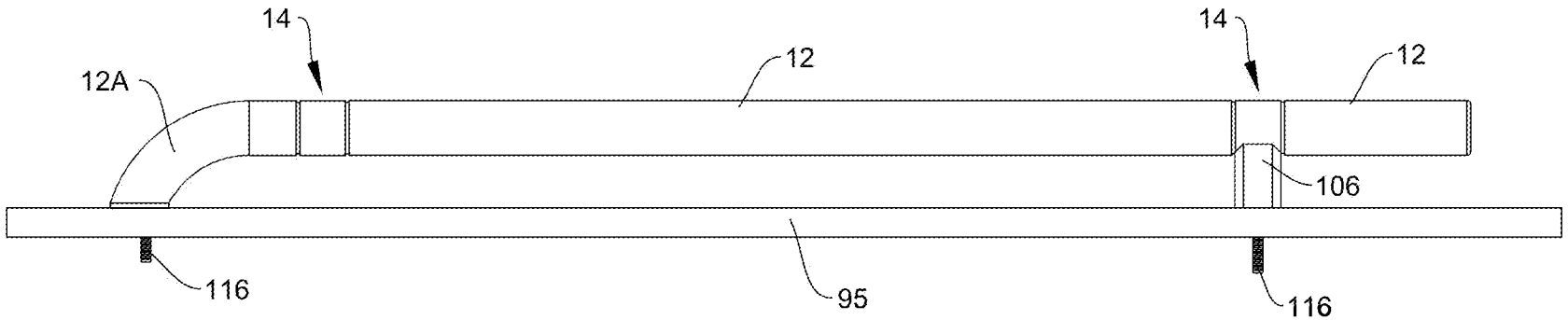
FIG. 37B is a top plan view of the rail system of FIG. 36B.
Figure 38:
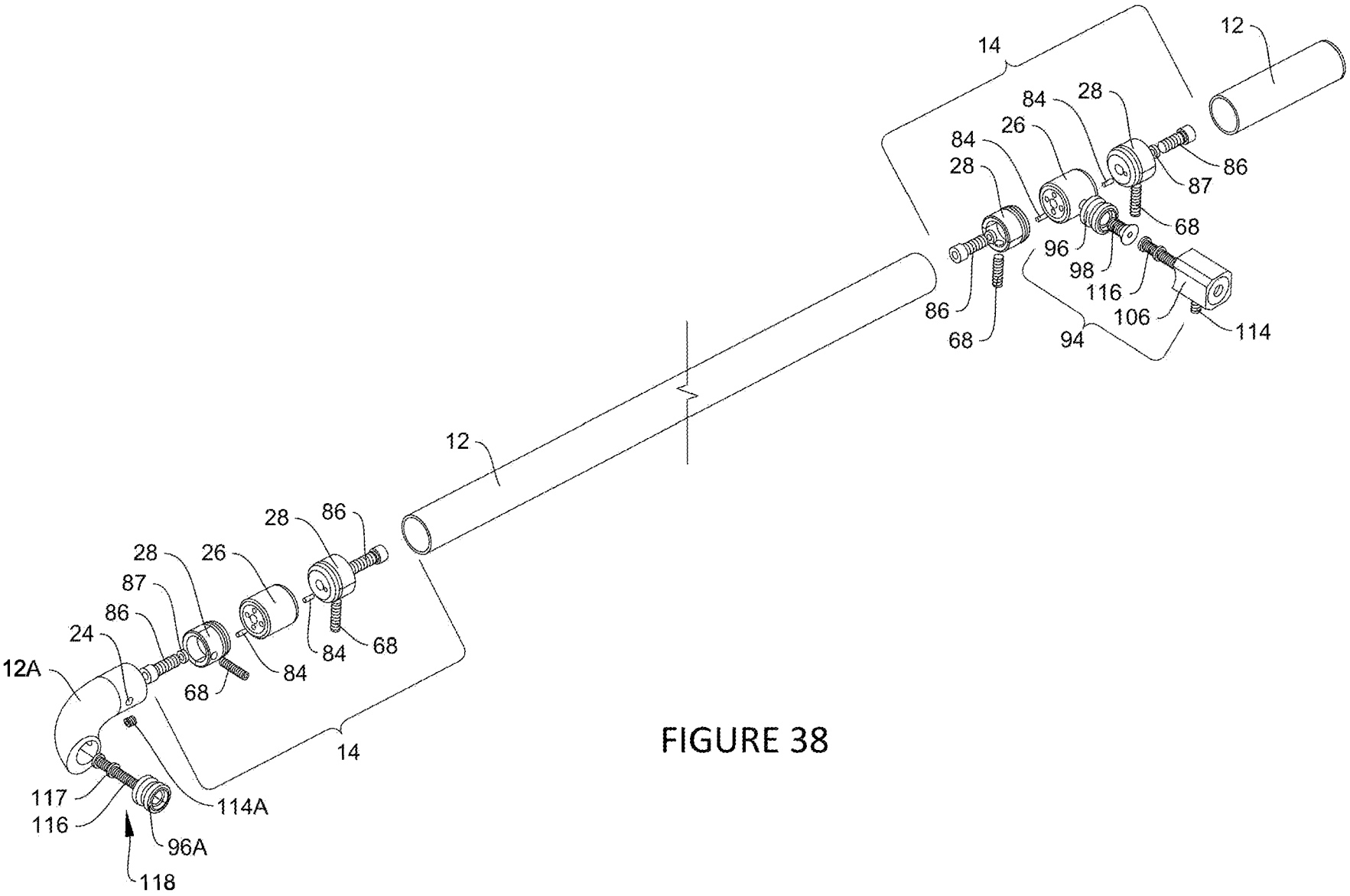
FIG. 38 is a fully exploded, isometric view of the rail system of FIG. 36A shown in isolation from the support.
Figure 39:
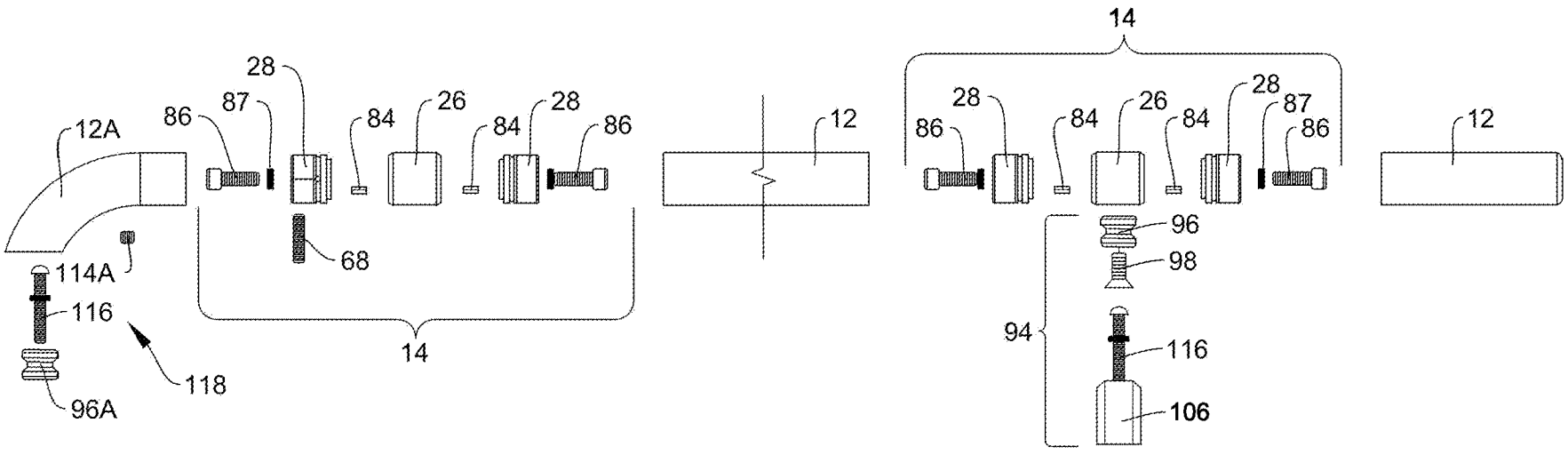
FIG. 39 is a top plan view of the rail system of FIG. 38.
Figure 40:
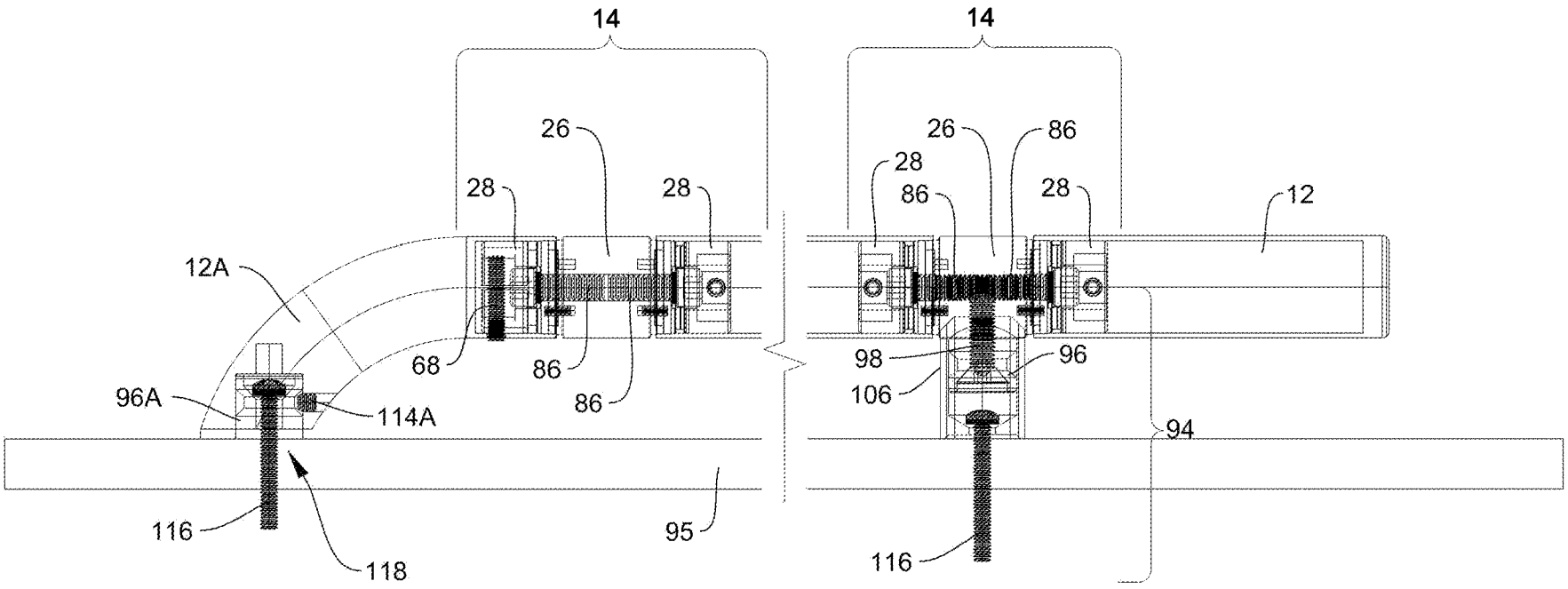
FIG. 40 is a fragmented, enlarged top plan view of the rail system of FIG. 36A showing details of the connector and mounting assemblies.
Figure 41:
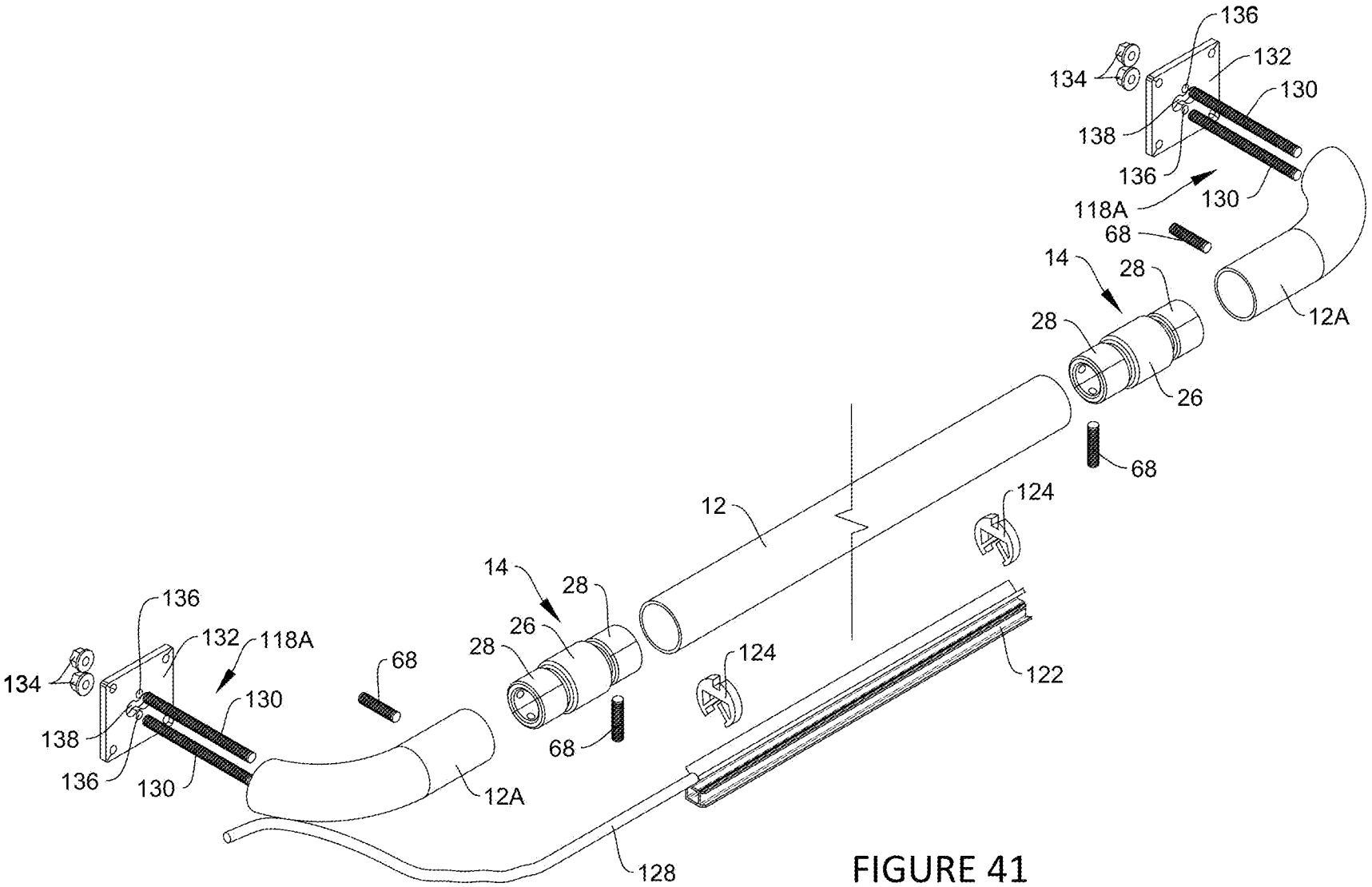
FIG. 41 is an exploded, top isometric view of an embodiment of a rail system configured for receiving a lighting element.

In some other further embodiments rail system 10 may optionally be coupled to support surface 95, such as the interior wall of an elevator cabin, by means of a span member 12 instead of or in addition to a mounting assembly 94 or 94A coupled to a connector span 26. For example, as shown in FIGS. 36A-40, system 10 may comprise at least one curvilinear "ghost mount" span member 12A having one end coupled to a connector 14 as described above and having a terminus end configured for releasable attachment to a support surface 95. By way of a specific example, each ghost mount span member 12A may be coupled to a support surface 95 with a mounting assembly 118 received within an interior compartment 22 of span member 12A near open end 20. Mounting assembly 118 may comprise a threaded fastener 116 for securing a mount connector 96A to support surface 95 (FIG. 37A). Mount connector 96A is received within compartment 22 of span member 12A and may be releasably coupled to span member 12A with a threaded fastener 114A, as shown best in FIG. 40. Ghost mount span member 12A may also optionally incorporate a mounting assembly 118A configured to accommodate the passage of electrical cables 128 through span member 12A and support surface 95, as described further below. Mounting assembly 118A comprises substantially the same components as mounting assembly 94A described above except it is configured to couple a span member 12A to support surface 95 rather than a connector 14.

FIGS. 36A-40 illustrate an embodiment of a rail system 10 comprising one connector 14 coupled to support surface 95 by means of a mounting assembly 94 and one "ghost mount" span member 12A coupled to support surface 95 by means of a mounting assembly 118. In other embodiments rail system 10 could comprise two "ghost mount" span members 12A located at each end of rail system 10, each span member 12A being connected to support surface 95 with a mounting assembly 118 or 118A.

Figure 42:
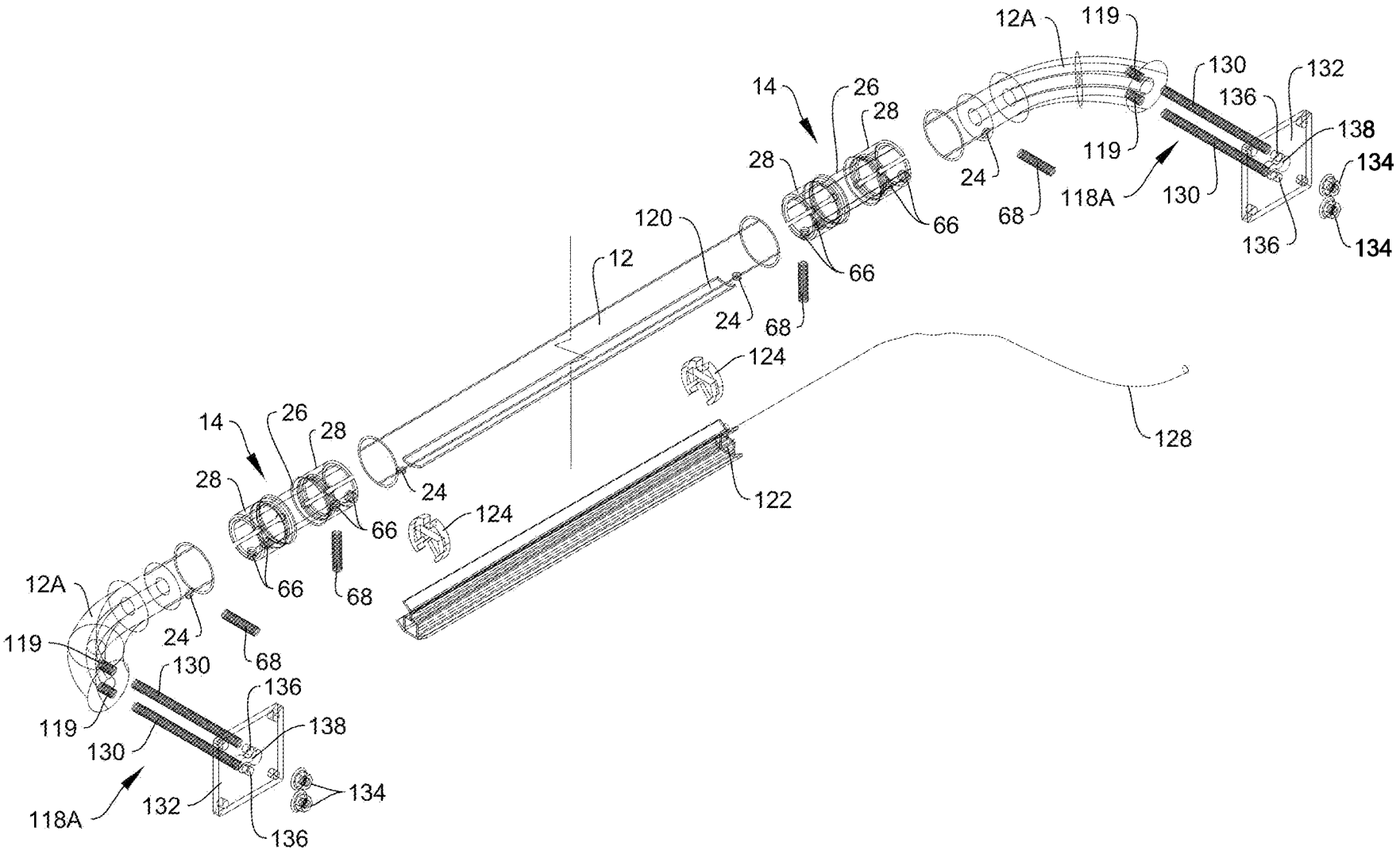
FIG. 42 is an exploded, bottom isometric view of the rail system of FIG. 41.
Figure 43:
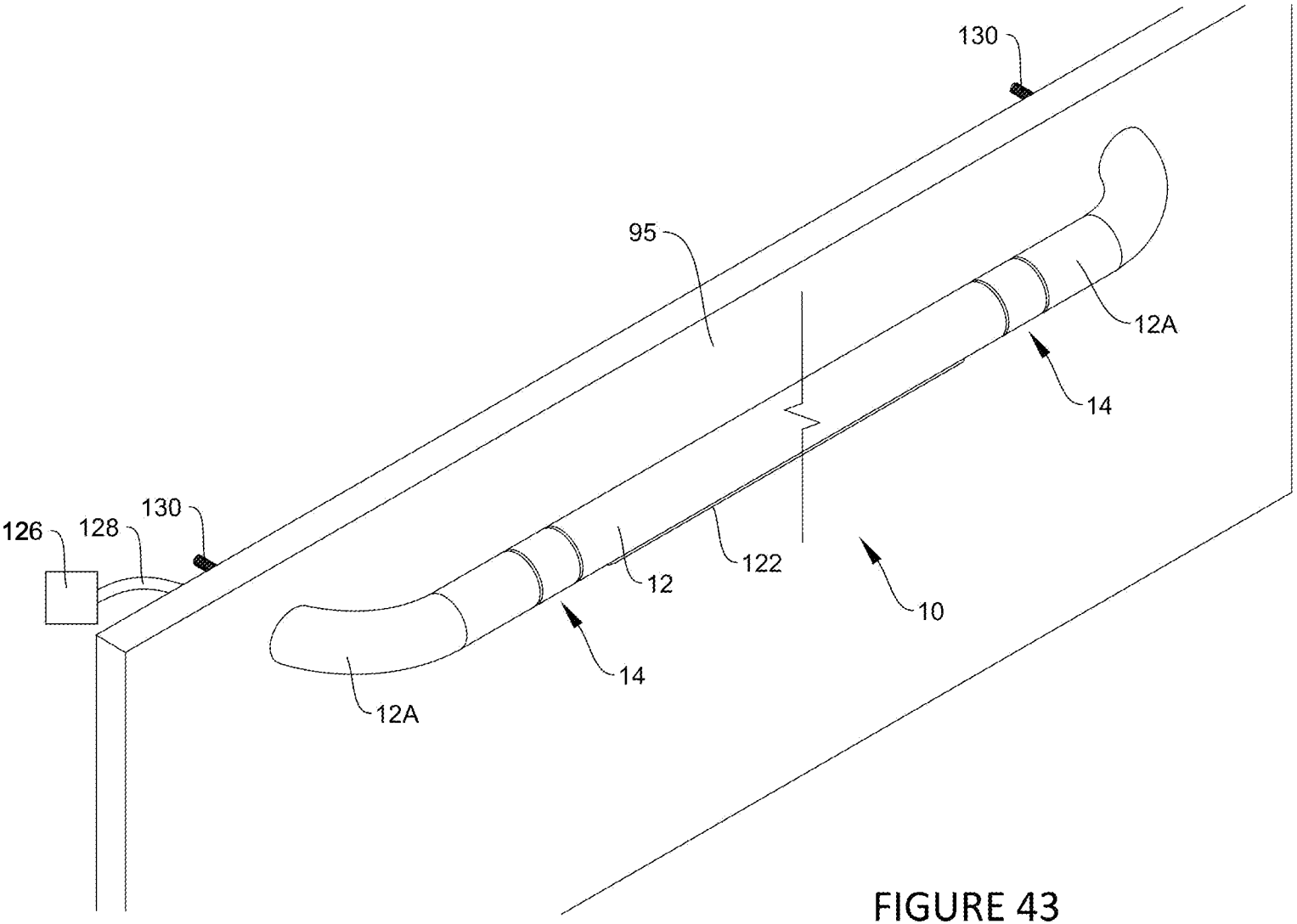
FIG. 43 is a top isometric view of the rail system of FIGS. 41-42 in an assembled configuration.
Figure 44:
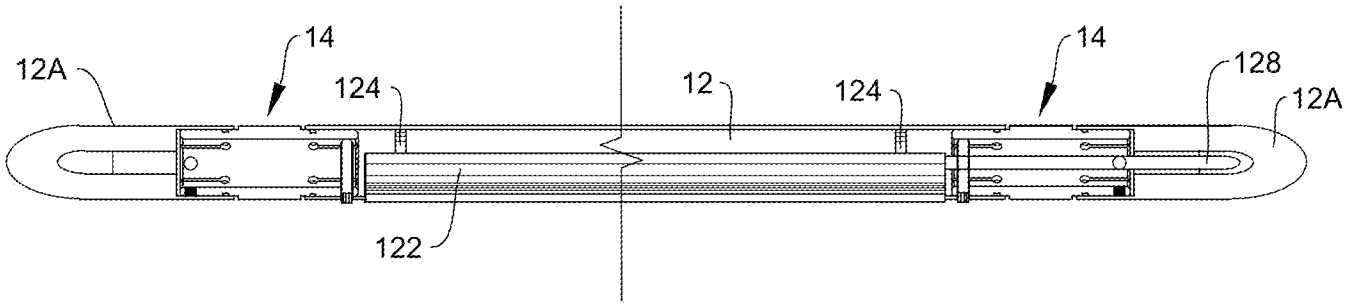
FIG. 44 is a front elevational view thereof.
Figure 45:
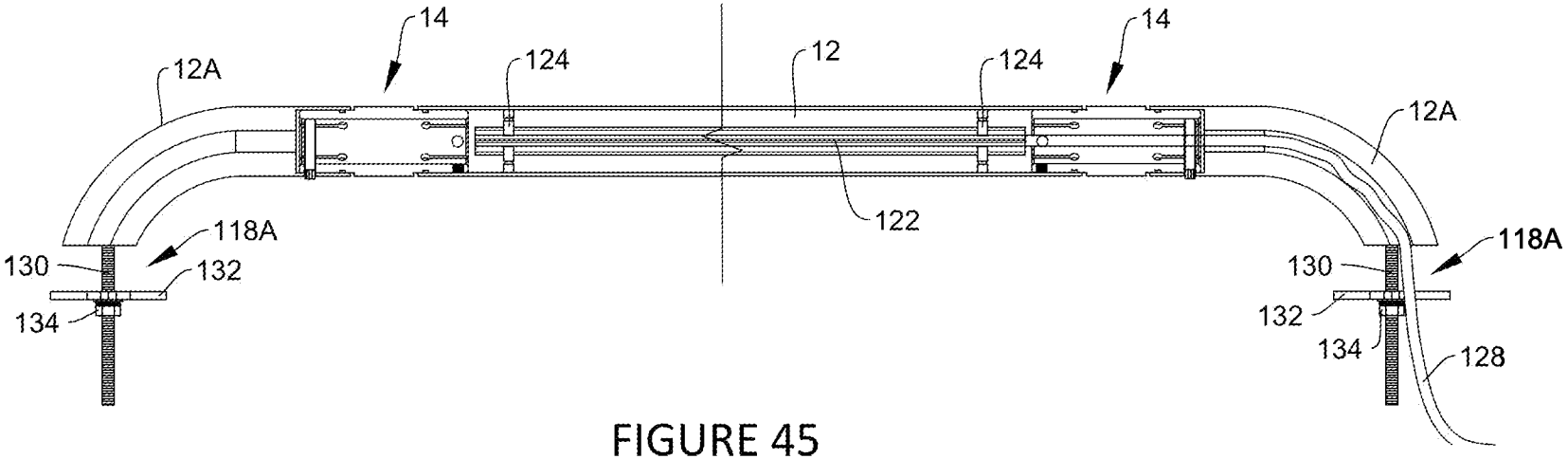
FIG. 45 is a bottom plan view thereof.
Figure 46:
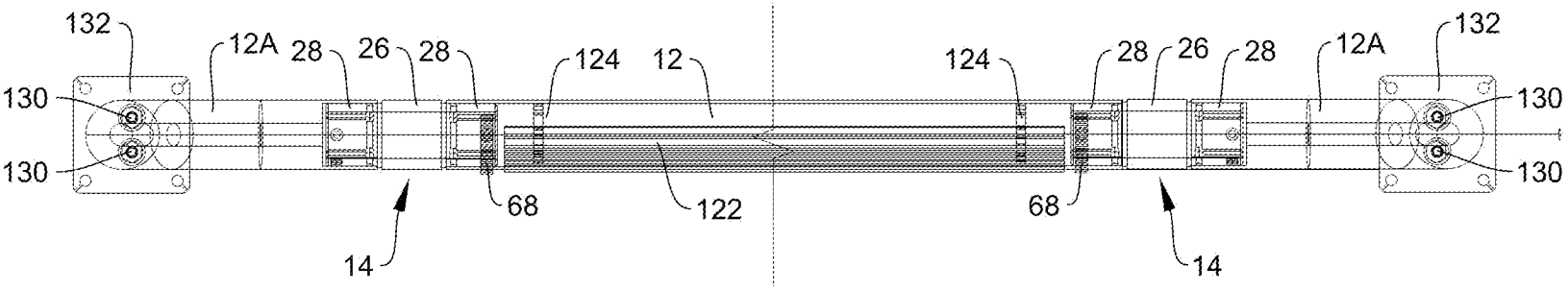
FIG. 46 is a rear elevational view thereof.
Figure 47:
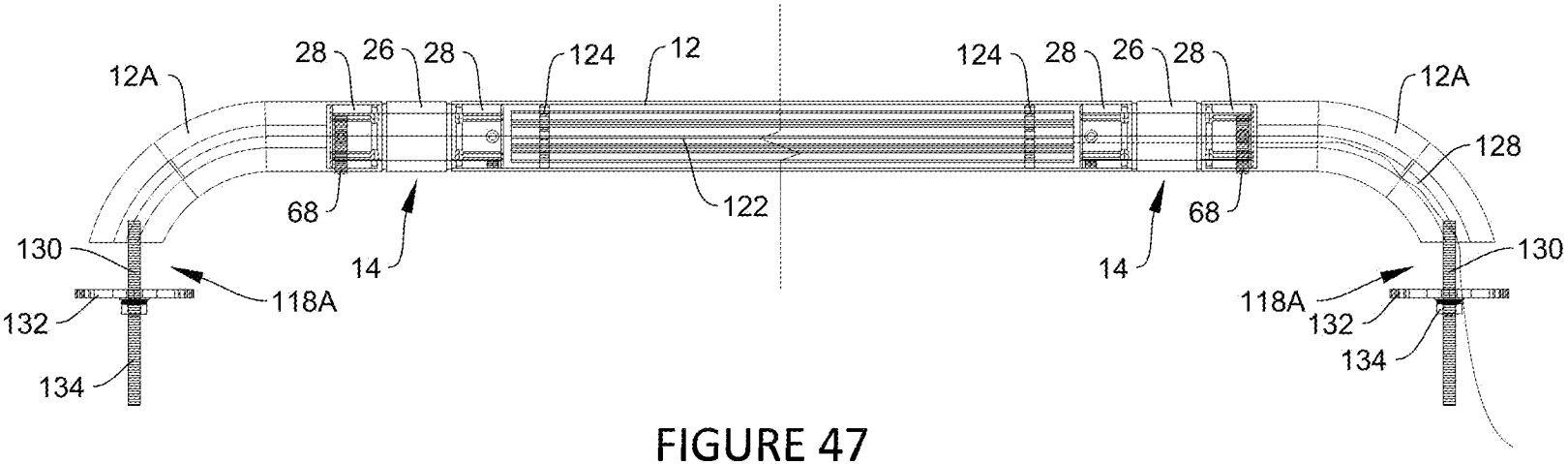
FIG. 47 is a top plan view thereof.
Figure 48:
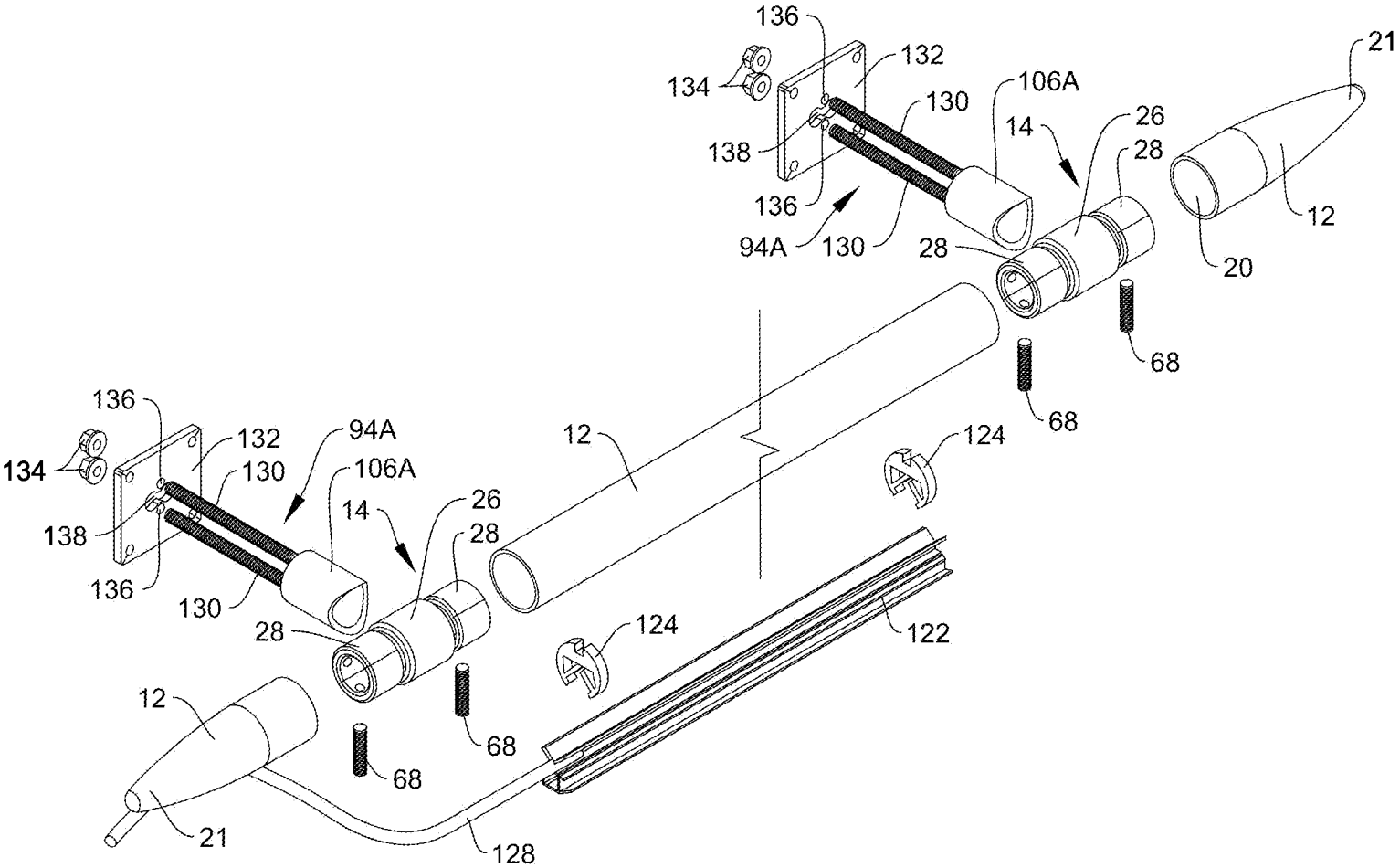
FIG. 48 is an exploded, top isometric view of an embodiment of a rail system comprising an alternative mounting assembly for coupling a connector as illustrated in FIGS. 21A-21C to a support surface.
Figure 49:
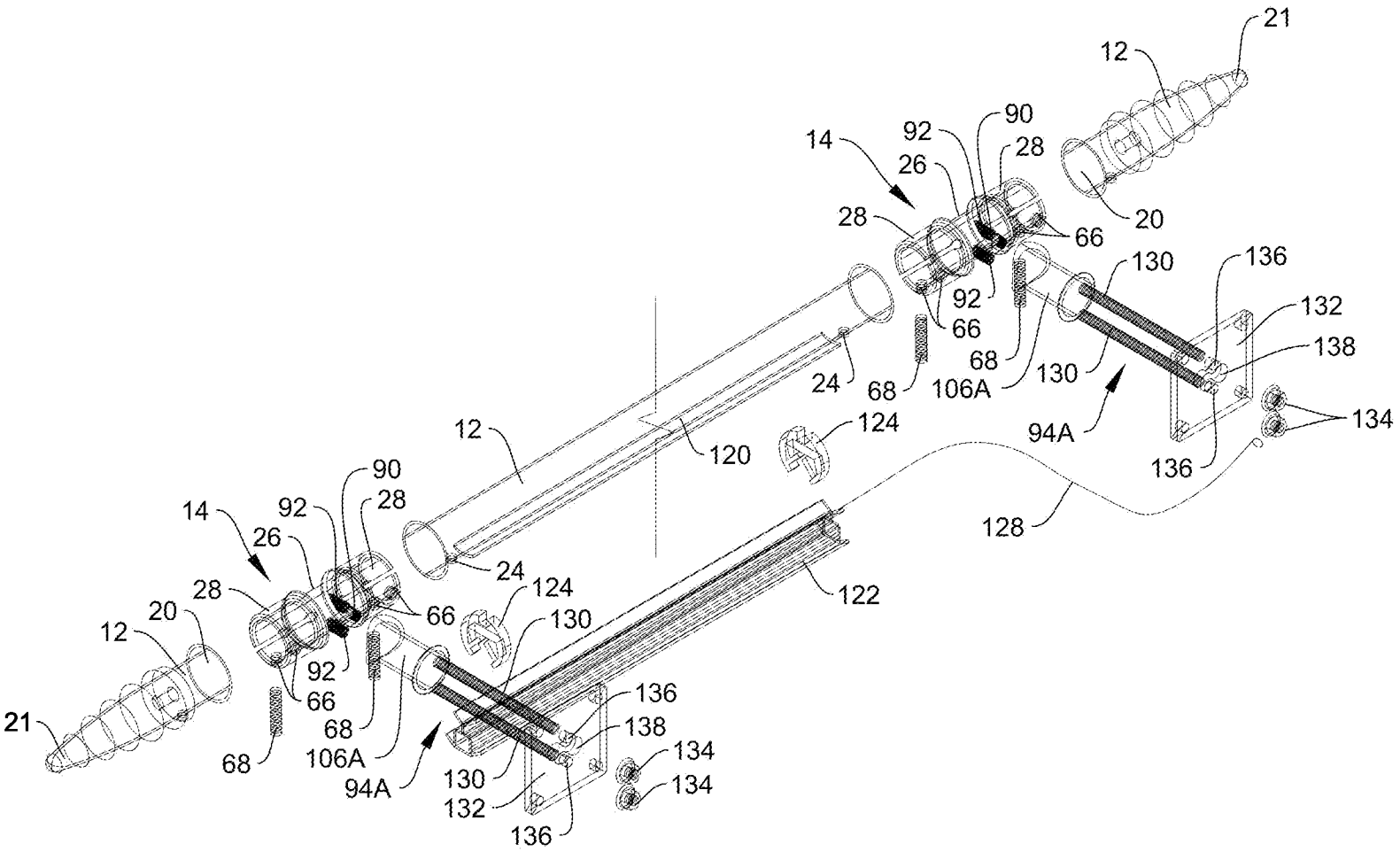
FIG. 49 is an exploded, bottom isometric view of the rail system of FIG. 48.
Figure 50:
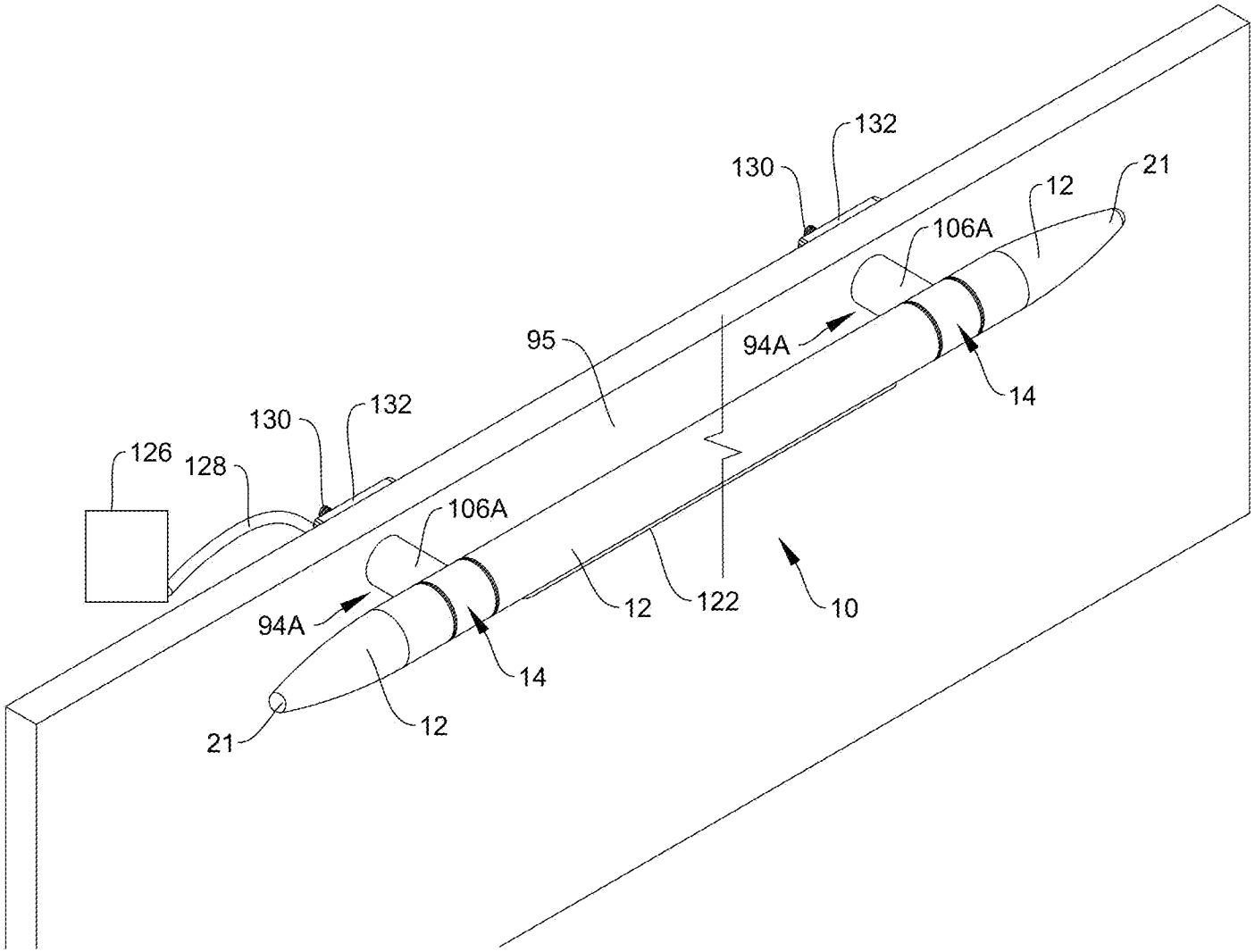
FIG. 50 is an isometric view of the rail system of FIGS. 48-49 in an assembled configuration mounted on a support surface.
Figure 51:
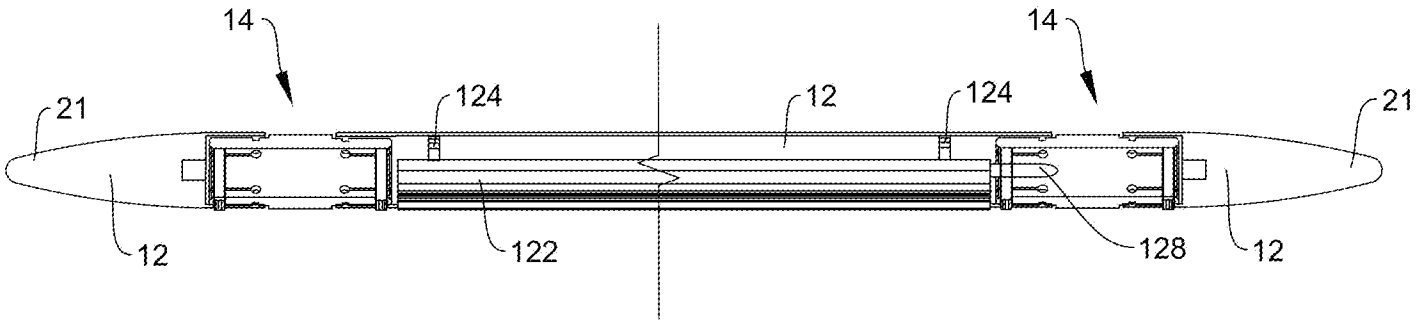
FIG. 51 is a front elevational view thereof.
Figure 52:
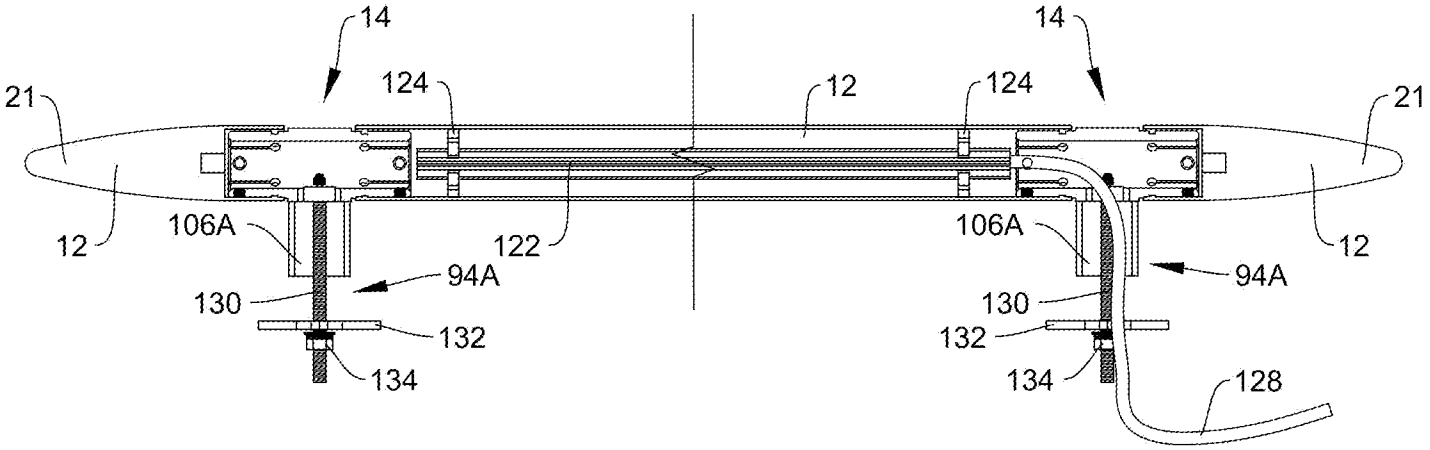
FIG. 52 is a bottom plan view thereof.
Figure 53:
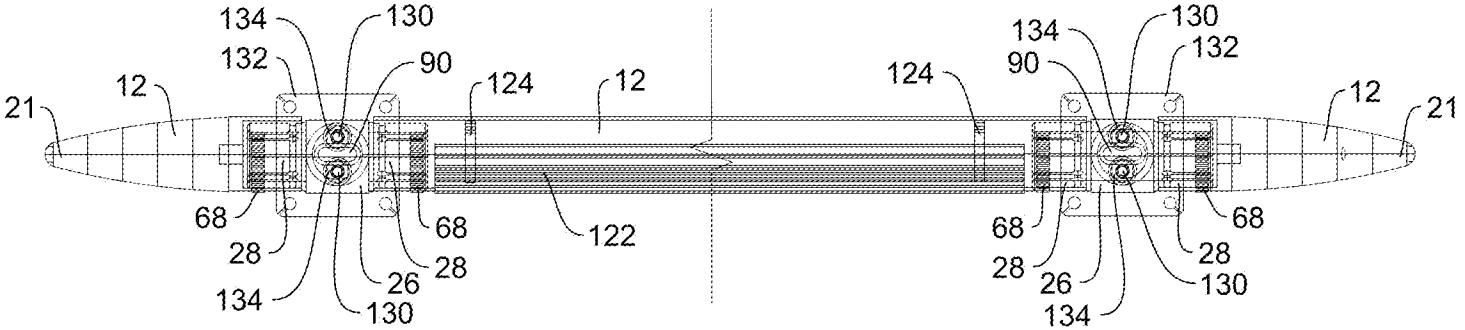
FIG. 53 is a rear elevational view thereof.
Figure 54:
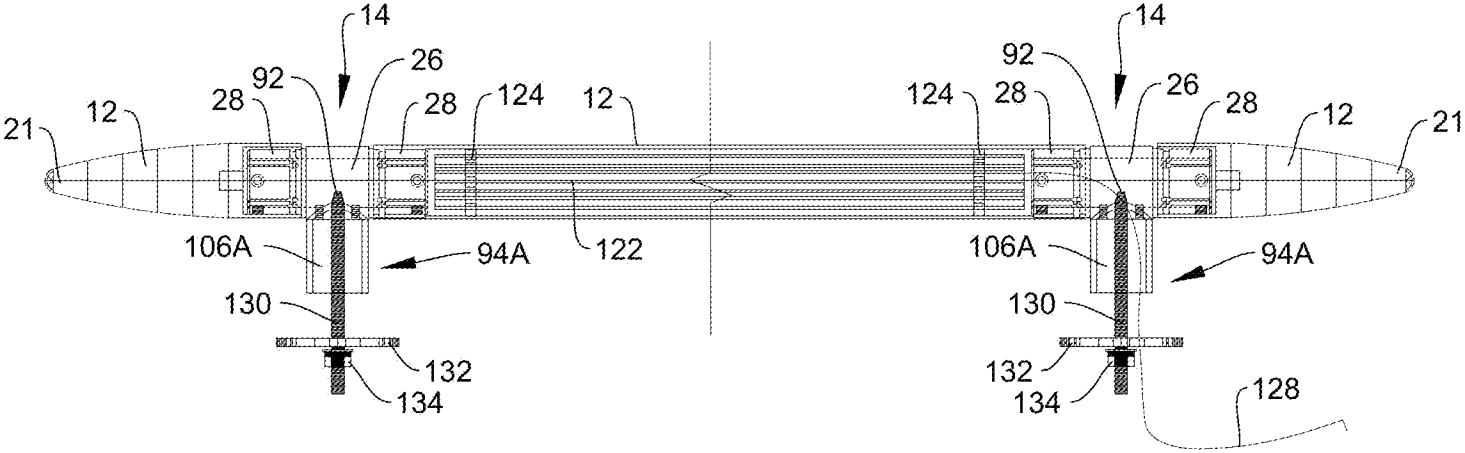
FIG. 54 is a top plan view thereof.

In some embodiments modular rail system 10 may comprise a lighting assembly for illuminating components of system 10. As shown in FIGS. 41-47, in one embodiment a span member 12 may have an elongated slot 120 formed therein (FIG. 42). Slot 120 is sized for receiving a lighting element 122. For example, lighting element 122 may be releasably secured to a pair of clips 124 positionable in spaced-apart relation within the interior of a span member 12. Lighting element 122 may be connectable to a power supply 126 located external of system 10, for example a power supply 126 mounted on or behind support surface 95 or another support structure to which mounting assembly 94A or 118A is secured (FIG. 43). In some embodiments one or more electrical cables 128 connecting lighting element 122 to power supply 126 may be fed through the interior of span members 12, 12A and/or connecting members 14 and are not outwardly visible. For example, as shown in FIGS. 41-47, an electrical cable 128 may be passed through a ghost mount span member 12A to power supply 126. As illustrated in FIGS. 48-54, alternatively or additionally an electrical cable 128 may be passed through a connecting member 14 to power supply 126, for example using a connector 14 as illustrated in FIGS. 21B and 21C having a continuous interior opening. In particular, an electrical cable 128 may be fed through the interior of span member(s) 12 and through a slot 90 of a connector 14, and further through the interior of a mount housing 106A to connect to power supply 126 (FIG. 50). In this embodiment rail system 10 comprises an alternative mounting assembly 94A including a mounting housing 106A as described above having an internal cavity for receiving an electrical cable 128, as best shown in FIG. 52.

In the embodiment of FIGS. 41-47 mounting assembly 118A for coupling rail system 10 to a support surface 95 comprises a pair of internally threaded apertures 119 formed in an end portion of each "ghost mount" span member 12A. Each aperture 119 receives one end of an elongated fastener 130 which may be coupled at its other end to a mounting plate 132 by means of a nut 134. In one embodiment plate 132 could be mounted on an interior wall of support surface 95, such as an inner wall within an elevator shaft ordinarily hidden from view. Mounting plate 132 comprises a pair of apertures 136 each for receiving a fastener 130 and a central aperture 138 for receiving an electrical cable 128. In one embodiment power supply 126 could also be mounted within the elevator shaft proximate mounting plate 132.

In the embodiment of FIGS. 48-54 a mounting assembly 94A comprising components substantially the same as mounting assembly 118A of FIGS. 41-47 is employed. In this embodiment elongated fasteners 132 are received in threaded apertures 92 formed in connector 14 (FIGS. 21B and 21C) rather than apertures 119 of span member 12A. Also, as discussed above, a mounting housing 106A is employed rather than a span member 12A for coupling rail system 10 to support surface 95. As in the embodiment of FIGS. 41-47 a mounting plate 132 could be mounted on an inner wall of mounting surface 95 (FIG. 50) for receiving fasteners 130 and electrical cable 128.

In another embodiment all or a portion of span members 12 and/or connectors 14 may be transparent or translucent to enable light to be emitted from an interior thereof to an exterior thereof. In one embodiment shown in FIGS. 55-61, lighting element 122 may comprise one or more lighting elements 122A, which may be in the form of annular discs or "pucks", which are positionable within the interior of a span member 12 and/or a connector 14 to emit light through a transparent or translucent window formed in that span member 12 or an adjacent span member 12. For example, as shown in FIGS. 55-61, a translucent, colored span member 12B may be provided which is disposed between two non-translucent span members 12C each coupled to a respective connector 14. Colored span members 12B may consist of acrylic rods and adjacent span members 12C may be formed from metal, for example. The light emitting lighting element 122A may be mounted within the interior of at least one of span members 12C to project light into adjacent span member 12B (e.g. FIG. 59), causing span member 12B to emit light of the desired color. In this example, one end of each span member 12C is connected to a connector 14 with a set screw 68 extendable through an aperture 24 and the other end is connected directly to colored span member 12B with a screw fastener 69 extendable through an aperture 24A. Each light emitting lighting element 122A may be coupled to a power supply 126 by means of an electrical cable 128 passing through the interior of rail system 10, as shown in FIG. 57 and as discussed above.

In some embodiments modular rail system 10 can be used for example to create a customized rail 10 to illuminate a wall and/or a floor surface of an elevator. For example, in the embodiment of FIG. 42 a rail system 10 is illustrated comprising a span member 12 having an elongated slot 120 for receiving a lighting element 122. In this embodiment lighting element 122 is configured to direct light downwardly, e.g. toward the floor of an elevator. Slot 120 is in alignment with apertures 24 for coupling the slotted span member 12 between a pair of connectors 14 as discussed above. Thus in this embodiment set screws 68, which each extend through aligned apertures 24, 66 for coupling an end of the slotted span member 12 to a respective connector 14, are hidden from view on the undersurface of rail system 10. The set screw 68 for coupling each ghost mount span member 12A to a respective connector 14 is also hidden from view on the back side of span members 12A facing support surface 95, such as the interior wall surface of an elevator cabin.

In the embodiment of FIGS. 41-47 a connector 14 suitable for illuminated rail systems 10 could be used (FIGS. 20-24) having an aperture 66 positioned in-line with slot 90. Optionally, in some configurations, connector 14 may be mounted on a support surface 95 of the elevator cab using a mounting assembly 94A projecting therefrom. Either before or after connector 14 is coupled to mounting assembly 94A, span member 12 may be coupled to connector 14 such that an expansion member 28 of connector 14 is inserted into an open end of span member 12 and apertures 24 and 66 are aligned. As discussed above, a lighting element 122 may be mounted in slot 120 and the electrical cable 128 may be fed through the interior of span member 12 and connector 14. In one embodiment cable 128 may be passed through a ghost mount span connector 12A for connection to a power supply 126 as shown in FIG. 43 and discussed above. In another embodiment cable 128 may be passed through aperture 90 of connector 14 (FIGS. 21B and 21C) and a mounting assembly 94A comprising a mount housing 106A for connection to a power supply 126 as shown in FIG. 50 and discussed above. Span member 12 and a respective connector 14 may be securely engaged by tightening set screw 68 to cause expansion member 28 to be adjusted from the reduced diameter first position to the expanded diameter second position as described above. Since set screw 68 will be located on the undersurface of rail system 10 facing downwardly as discussed above it will not be readily visible.

In another example, both aligned apertures 24, 66 receiving a set screw 68 and lighting element 122 may be oriented facing support surface 95, such as an interior wall of the elevator cab. Thus in in this embodiment slot 120 is once again in alignment with apertures 24 but light emitted from rail system 10 is directed inwardly toward surface 95 rather than downwardly.

In other embodiments it may be desirable to direct the light emitted from lighting element 122 in some other direction such as upwardly or outwardly toward the interior of the elevator cab. At the same time, it is desired to position the aligned apertures 24, 66 of span member 12 and adjacent connector 14 on the back side of rail system 10 facing the support surface 95, or the undersurface of rail system 10 facing downwardly, so such apertures, and the set screw 68 which releasably couples each span member 12 and a respective connector 14 together, are hidden from view.

In such alternative embodiments elongated slot 120 of a span member 12 may be located at a position offset from apertures 24, for example if it is desired to direct light from lighting element 122 upwardly or outwardly into the interior of the elevator cab. Alternatively, slot 120 may be aligned with an aperture 24 of span member 10, but during assembly of rail system 10 aperture 24 could be aligned with an aperture 66 of connector 14 which is not in-line with slot 90 (FIGS. 21B and 21C). Either way, in this example, set screw 68 will again be located on the back or undersurface of rail system 10 where it will not be readily visible and lighting element 122 will be configured to direct light upwardly, outwardly or in some other desired direction. Thus, as in the examples described above relating to embodiments of connector 14 where expansion member(s) 28 are releasably connectable to connector span 26 at different selected rotational positions (e.g. FIG. 19), connector 14 can be configured so that aligned apertures 24,66 receiving set screw 68 are in a desired orientation relative to slot 120 (and hence lighting element 122).

Figure 55:
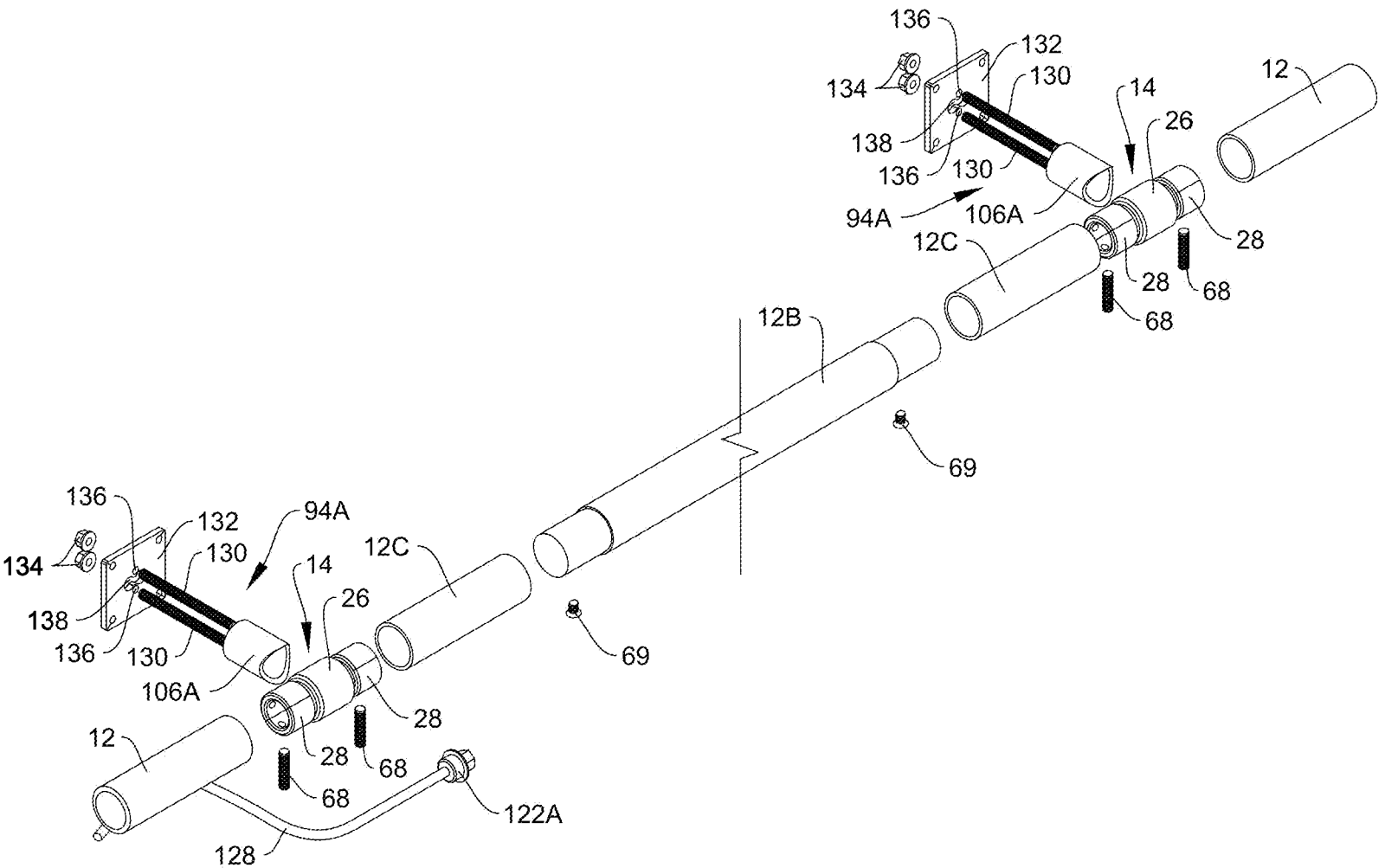
FIG. 55 is an exploded, top isometric view of an embodiment of a rail system configured for receiving an alternative embodiment of a lighting element.
Figure 56:
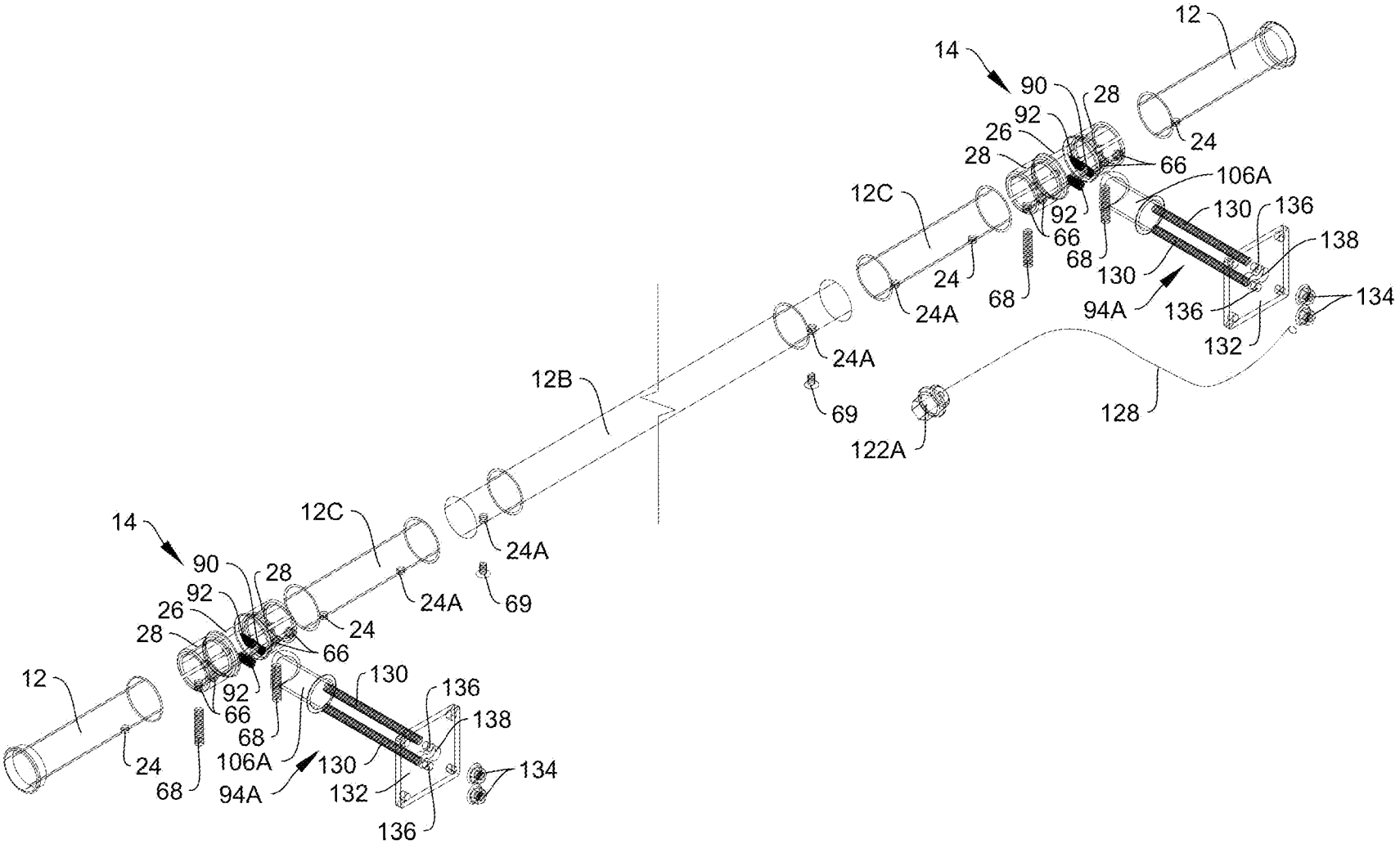
FIG. 56 is an exploded, bottom isometric view of the rail system of the rail system of FIG. 55.
Figure 57:
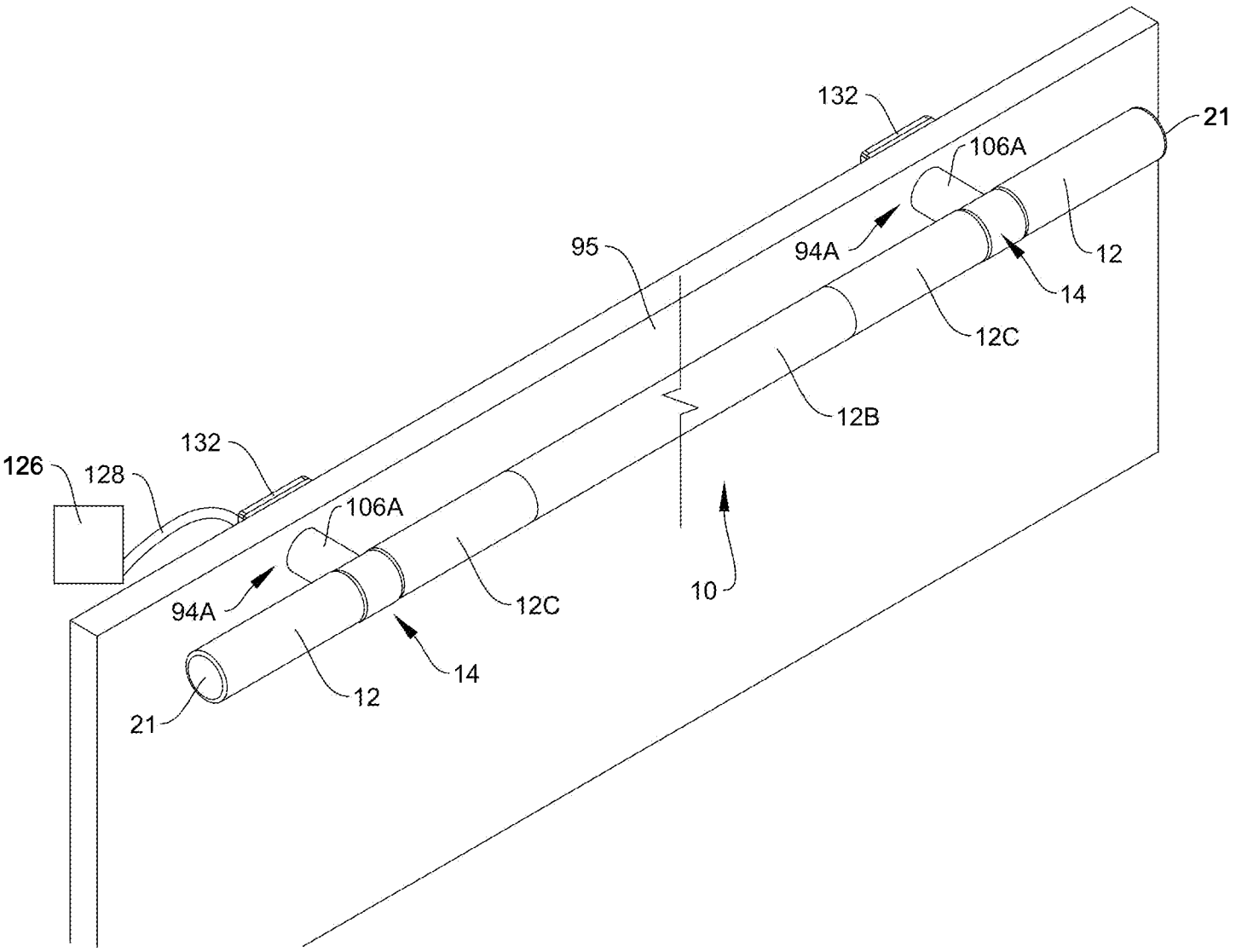
FIG. 57 is an isometric view of the rail system of FIGS. 55-56 in an assembled configuration mounted on a support surface.
Figure 58:
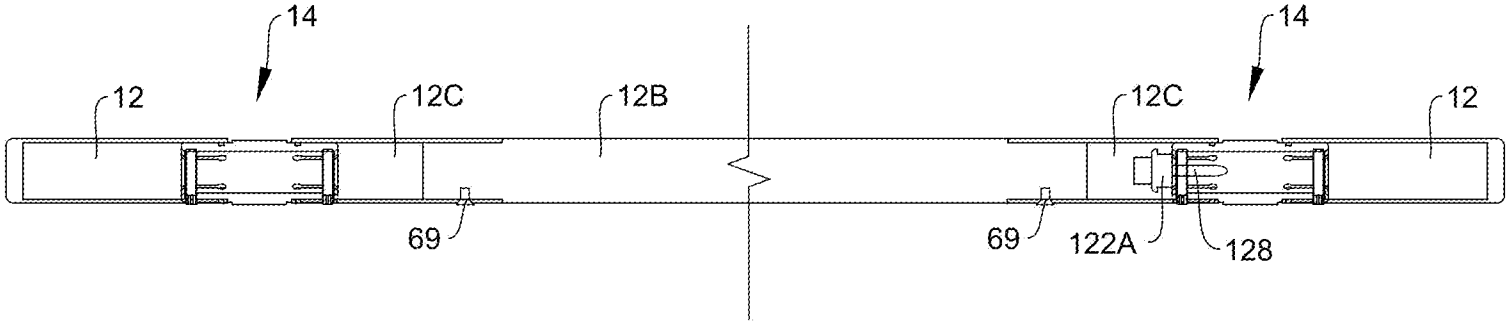
FIG. 58 is a front elevational view thereof.
Figure 59:
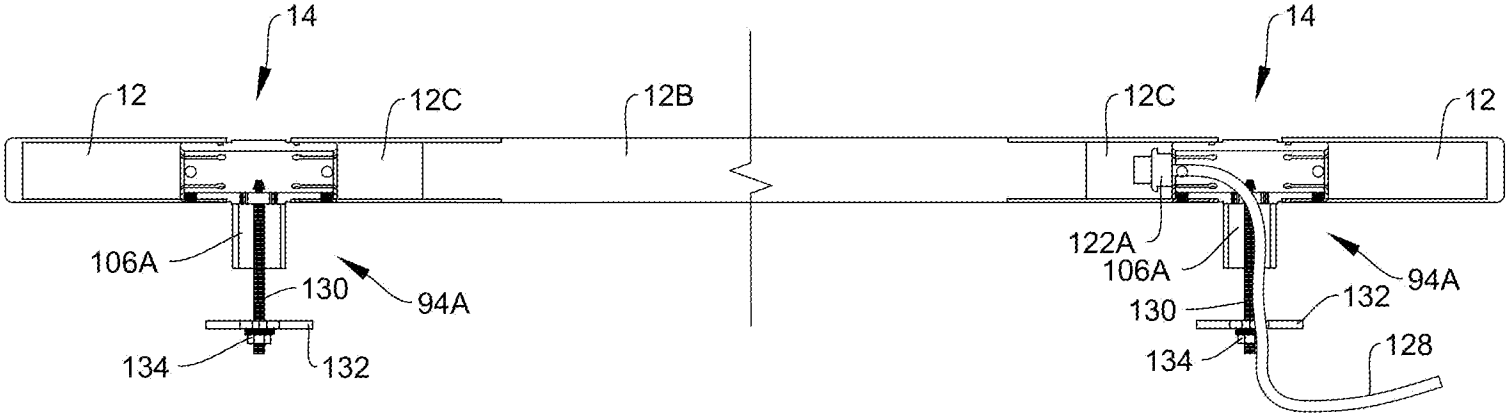
FIG. 59 is a top plan view thereof.
Figure 60:
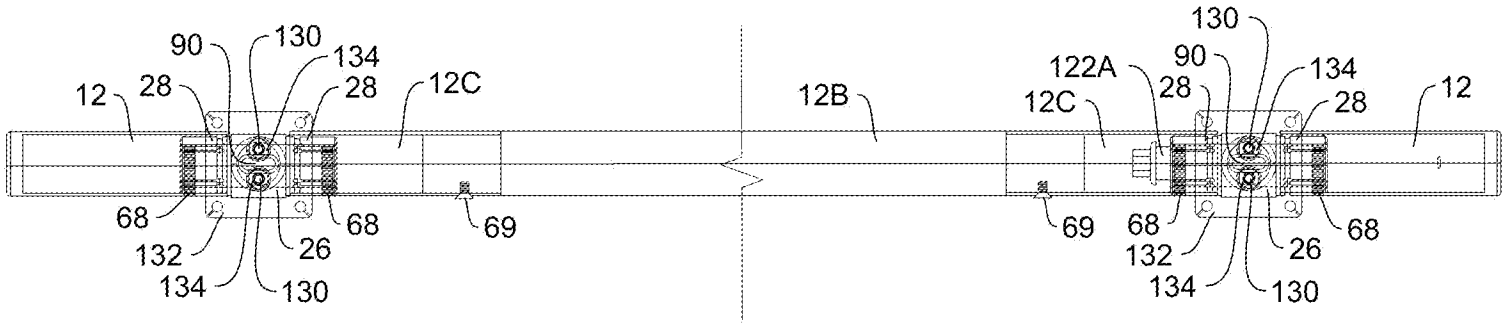
FIG. 60 is a rear elevational view thereof.
Figure 61:
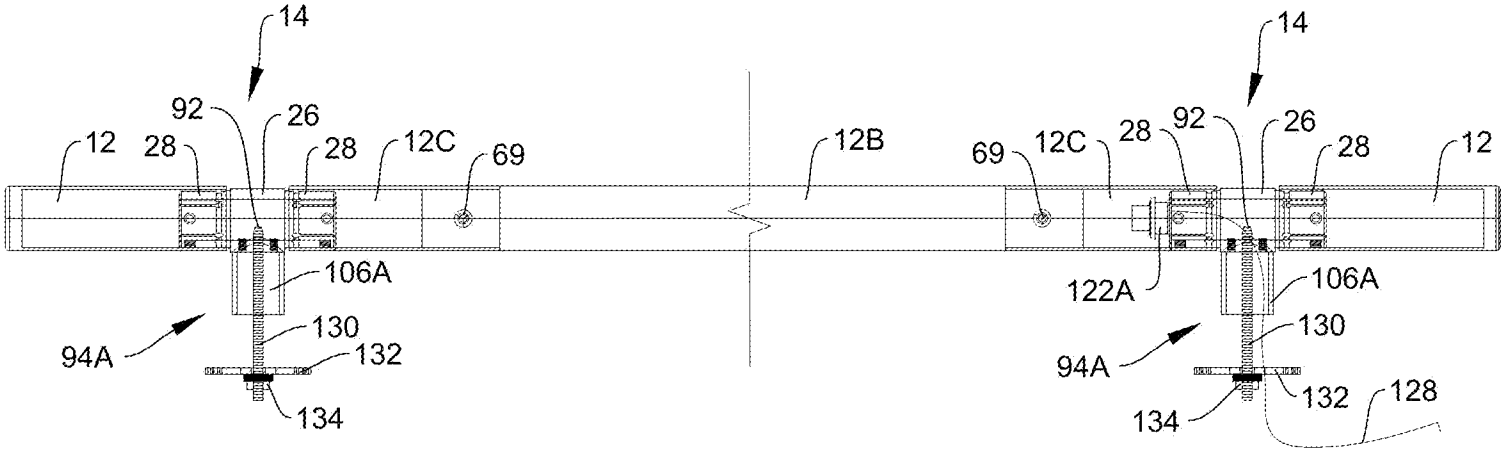
FIG. 61 is a bottom plan view thereof.

Referring to the embodiment of FIGS. 55-61, span member 12B may be configured to emit light emanating from lighting element 122A from all or part of the circumferential surface of span member 12B while set screws 68 and screw fasteners 69 may be located at a position ordinarily hidden from view, for example on the undersurface of rail system 10 (e.g. FIGS. 55-56).

As will be apparent to a person skilled in the art, in other embodiments of the invention, rail system 10 may be assembled to mount span members 12 and connectors 14 in many different orientations to direct light in many different desired orientations.

As explained above, span members 12 may be produced in many different materials and finishes and combinations thereof. Examples of suitable materials include stainless steel, yellow brass, copper, carbon fibre, aluminum, anodized black, bronze and anodized oxidized bronze. Examples of suitable finishes include brushed, polished, knurled and diamond-shaped textures. As explained above, since connectors 14 provide a visual break between adjacent spans 12, materials of different materials, finishes or colors can either be grouped together or separated depending on the visual effect desired.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A modular rail system comprising:

(a) at least one connector having a longitudinal axis and comprising a connector span and at least one expansion member, wherein said expansion member is adjustable between a first configuration having a first diameter and a second configuration having a second diameter larger than said first diameter;

(b) at least one span member having an outer surface and an inner surface and at least one open end, and (c) at least one actuator for adjusting said expansion member between said first and second configurations, wherein said expansion member is insertable into an interior of said span member in said first configuration and is adjustable to said second configuration within said span member to securely engage said inner surface of said span member to releasably couple said connector and said span member together, wherein said actuator is insertable through a first aperture formed in said span member proximate said open end to adjust said expansion member between said first and second configurations.

2. The system as defined in claim 1, wherein said expansion member comprises at least one first wall segment and at least one second wall segment opposite said first wall segment and wherein said first wall segment comprises a second aperture alignable with said first aperture when said expansion member is inserted within said interior of said span member.

3. The system as defined in claim 2, wherein said actuator is an elongate rod insertable through said first and second apertures when said apertures are in alignment, wherein said elongate rod is mechanically adjustable to contact an inner portion of said second wall segment to increase the distance between said first and second wall segments, thereby adjusting said expansion member from said first configuration to said second configuration.

4. The system as defined in claim 3, wherein said elongate rod extends transversely relative to said longitudinal axis of said connector.

5. The system as defined in claim 4, wherein elongate rod is threadedly connectable to said second aperture.

6. The system as defined in claim 5, wherein said elongate rod is a threaded screw.

7. The system as defined in claim 6, wherein the length of said screw exceeds the distance between said first and second wall segments such that said screw protrudes outwardly from said first aperture when said expansion member is not in said second configuration, thereby preventing decoupling of said connector and said span member until said screw is removed from said expansion member.

8. The system as defined in claim 2, wherein each of said first and second wall segments is semi-circular.

9. The system as defined in claim 8, comprising at least one slot located between said first and second wall segments extending parallel to said longitudinal axis of said connector, wherein a width of said slot varies when said expansion member is adjusted between said first and second configurations.

10. The system as defined in claim 2, wherein each of said first and second wall segments is quarter-circular.

11. The system as defined in claim 2, wherein said first and second wall segments comprise an end portion of said expansion member distal from said connector span, and wherein said expansion member further comprises a collar for coupling said end portion of said expansion member to said connector span.

12. The system as defined in claim 11, wherein each of wall segments comprises a wall outer surface for securely engaging said inner surface of said span member in said second configuration and wherein said collar comprises an annular groove having a diameter less than the distance between said wall outer surface of said first wall segment and said wall outer surface of second wall segment.

13. The system as defined in claim 12, wherein said slot terminates at said groove.

14. The system as defined in claim 12 wherein said expansion member comprises a borehole extending transversely through said expansion member in the vicinity of said groove.

15. The system as defined in claim 1, wherein said expansion member is integrally connected to said connector span.

16. The system as defined in claim 1, wherein said expansion member is releasably connectable to said connector span.

17. The system as defined in claim 1, wherein said connector span comprises a primary span portion and first and second flanges formed at end portions thereof, wherein each of said first and second flanges has an outer diameter less than an outer diameter of said primary span portion.

18. The system as defined in claim 17, wherein an outer diameter of said connector span is approximately equal to an outer diameter of said span member.

19. The system as defined in claim 18, wherein one of said first and second flanges forms a visible spacer between said primary span portion of said connector and said span member when said connector and said span member are securely coupled together in said second configuration.

20. The system as defined in claim 19, wherein each of said first and second flanges defines an open end of said connector span for receiving an end portion of asaid collar of said expansion member.

21. The system as defined in claim 19, where each of said first and second flanges comprising an outer rim which contacts said span member in said second configuration.

22. The system as defined in claim 21, wherein an outer diameter of each of said flanges is slightly larger than the outer diameter of said collar.

23. The system as defined in claim 1, wherein said system comprises a mounting assembly for releasably coupling said connector to a support surface.

24. The system as defined in claim 23, wherein said mounting assembly comprises a mounting aperture formed in said connector span, a mount housing connectable to said support surface, and a first fastener insertable into said mounting aperture for releasable securing said connector span to said mount housing.

25. The system as defined in claim 24, wherein said mounting assembly comprises a mount connector releasably connectable to said connector span with said first fastener.

26. The system as defined in claim 23, wherein said mounting assembly comprises a mount housing mountable on said support surface; a mount connector positionable within said mount housing and releasably connectable to said connector span; and a second fastener for releasably coupling said mount housing and said mount connector together.

27. The system as defined in claim 26, comprising a first fastener for releasably coupling said mount connector to said connector span.

28. The system as defined in claim 27, wherein said first fastener and said second fastener are threaded screws.

29. The system as defined in claim 23, wherein said mounting assembly comprises at least one mounting rod for mounting said connector on said support surface.

30. The system as defined in claim 1, wherein said at least one span member comprises a first span member and a second span member, and wherein said at least one expansion member comprises a first expansion member located at a first end of said connector and a second expansion member located at a second end of said connector, wherein said first span member is connectable to said first expansion member and said second span member is connectable to said second expansion member to couple said first and second span members together.

31. The system as defined in claim 30, wherein said connector has a color and/or texture contrasting with at least one of said first and second span members.

32. The system as defined in claim 31, wherein said connector has a color and/or texture contrasting with both of said first and second span members.

33. The system as defined in claim 1, wherein said at least one span member comprises a plurality of span members and wherein said at least one connector comprises a plurality of connectors, wherein each of said connectors couples an adjacent pair of span members together.

34. The system as defined in claim 33, wherein said plurality of span members and said plurality of connectors form a handrail mountable on a support surface.

35. The system as defined in claim 34, wherein said support surface is the interior of an elevator cab.

36. The system as defined in claim 33, wherein said plurality of span members comprise a first group of span members having first and second open ends and a second group of span members having an open first end and a closed second end for forming an end portion of said rail system.

37. The system as defined in claim 36, wherein said closed second end has a shape selected from the group consisting of semi-spherical, bullet-shaped and cylindrical.

38. The system as defined in claim 33, wherein at least some of said plurality of span members are linear tubes and a least some of said plurality of span members are curved tubes.

39. The system as defined in claim 33, wherein said plurality of span members and said plurality of connectors are configurable to form a rail comprising rail segments having contrasting textures, finishes and/or colors.

40. The system as defined in claim 33, wherein said plurality of span members comprise at least one end span member.

41. The system as defined in claim 40, wherein said at least one end span member has a closed end.

42. The system as defined in claim 40, wherein said at least one end span member is configured for releasably engaging a support surface.

43. The system as defined in claim 40, wherein said at least one end span member comprises an end portion defining a cavity for receiving an insert mountable on said support surface, and a fastener for releasably coupling said end portion to said insert.

44. The system as defined in claim 43, wherein said end portion is shaped for engaging said support surface.

45. The system as defined in claim 33, wherein said plurality of span members and said plurality of connectors are each formed from metal selected from the group consisting of aluminum and stainless steel.

46. The system as defined in claim 33, wherein at least one of said plurality of span members is a light emitting span member configured for receiving a lighting element.

47. The system as defined in claim 46, wherein said light emitting span member is an elongated tube having a slot formed therein for receiving said lighting element.

48. The system as defined in claim 47, wherein the system is configurable to direct light emitted from said lighting element in a desired direction relative to a support surface.

49. The system as defined in claim 47, comprising a mounting assembly for mounting at least one of said plurality of connectors to a support surface, wherein said lighting element is connectable to an electrical supply externally of said rail system.

50. The system as defined in claim 49, wherein said electrical supply is mountable on said support surface.

51. The system as defined in claim 49, wherein said lighting element comprises an electrical supply cable extendable through said connector and said mounting assembly.

52. The system as defined in claim 46, wherein at least part of said light emitting span member comprises a transparent or translucent window.

53. The system as defined in claim 52, comprising a lighting element positionable within an interior of said light emitting span member for illuminating said window.

54. The system as defined in claim 33, wherein said plurality of span members and said plurality of connectors are each between 1 and 2 inches in diameter.

55. The system as defined in claim 1, wherein said expansion member is connectable to said connector span at a selected one of a plurality of rotational positions.

56. The system as defined in claim 55, wherein said connector span comprises a plurality of spaced apertures and said expansion member comprises at least one connecting pin positionable in a selected one of said apertures.

57. A modular kit comprising a plurality of connectors, plurality of span members, and a plurality of actuators as defined in claim 1.

58. The kit as defined in claim 57, comprising a mounting assembly for mounting at least one of said connectors to a support surface.

59. A modular rail system comprising:

(a) at least one connector having a longitudinal axis and comprising a connector span and at least one expansion member, wherein said expansion member is adjustable between a first configuration having a first diameter and a second configuration having a second diameter larger than said first diameter;

(b) at least one span member having an outer surface and an inner surface and at least one open end, and (c) at least one actuator for adjusting said expansion member between said first and second configurations, wherein said expansion member is insertable into an interior of said span member in said first configuration and is adjustable to said second configuration within said span member to securely engage said inner surface of said span member to releasably couple said connector and said span member together, wherein said actuator is insertable through a first aperture formed in said span member proximate said open end to adjust said expansion member between said first and second configurations; and (d) at least one span mounting assembly for mounting a span member to a support.

60. A rail system as defined in claim 59, wherein said span mounting assembly couples an end span member to said support.

61. The rail system as defined in claim 59, comprising at least one connector mounting assembly for mounting a connector to said support.

62. The rail system as defined in claim 59, wherein said span mounting assembly comprises a mount securable to said support, a fitting within said span member sized to receive said mount, and a fastener for releasably coupling said span member to said mount.

63. The rail system as defined in claim 59, wherein said expansion member is releasably connectable to said connecting span at a selected one of a plurality of rotational positions.

64. A modular rail system comprising:

(a) at least one connector having a longitudinal axis and comprising a connector span and at least one expansion member, wherein said expansion member is adjustable between a first configuration having a first diameter and a second configuration having a second diameter larger than said first diameter; and (b) at least one span member having an outer surface and an inner surface and at least one open end, wherein said expansion member is insertable into an interior of said span member in said first configuration and is adjustable to said second configuration within said span member to securely engage said inner surface of said span member to releasably couple said connector and said span member together, wherein said connector span comprises a primary span portion and first and second flanges formed at end portions thereof, wherein each of said first and second flanges has an outer diameter less than an outer diameter of said primary span portion, wherein an outer diameter of said connector span is approximately equal to an outer diameter of said span member, wherein one of said first and second flanges forms a visible spacer between said primary span portion of said connector and said span member when said connector and said span member are securely coupled together in said second configuration, and wherein each of said first and second flanges defines an open end of said connector span for receiving an end portion of a collar of said expansion member.

65. A modular rail system comprising:

(a) at least one connector having a longitudinal axis and comprising a connector span and at least one expansion member, wherein said expansion member is adjustable between a first configuration having a first diameter and a second configuration having a second diameter larger than said first diameter; and (b) at least one span member having an outer surface and an inner surface and at least one open end, wherein said expansion member is insertable into an interior of said span member in said first configuration and is adjustable to said second configuration within said span member to securely engage said inner surface of said span member to releasably couple said connector and said span member together, wherein said expansion member is connectable to said connector span at a selected one of a plurality of rotational positions, and wherein said connector span comprises a plurality of spaced apertures and said expansion member comprises at least one connecting pin positionable in a selected one of said apertures.

* * * * *